US009840368B1

(12) United States Patent
Bennett et al.

(10) Patent No.: US 9,840,368 B1
(45) Date of Patent: Dec. 12, 2017

(54) DUAL RECYCLABLE AND NON-RECYCLABLE WASTE COLLECTION DEVICE AND METHOD

(71) Applicant: Hybrid Containers, LLC, Gilbert, AZ (US)

(72) Inventors: David Bennett, Gilbert, AZ (US); James A. Spahn, Gilbert, AZ (US); Steven D. Veatch, Tempe, AZ (US)

(73) Assignee: Hybrid Containers, LLC, Gilbert, AZ (US)

( * ) Notice: Subject to any disclaimer, the term of this patent is extended or adjusted under 35 U.S.C. 154(b) by 0 days.

(21) Appl. No.: 14/599,796

(22) Filed: Jan. 19, 2015

Related U.S. Application Data

(60) Continuation-in-part of application No. 14/065,100, filed on Oct. 28, 2013, which is a division of application No. 12/419,968, filed on Apr. 7, 2009, now Pat. No. 8,646,664.

(51) Int. Cl.

| | |
|---|---|
| ***B65D 1/24*** | (2006.01) |
| ***B65F 1/00*** | (2006.01) |
| ***B65F 1/12*** | (2006.01) |
| ***B65F 1/16*** | (2006.01) |
| ***B65F 3/02*** | (2006.01) |

(52) U.S. Cl.
CPC ..... *B65F 1/0053* (2013.01); *B65F 1/122* (2013.01); *B65F 1/1615* (2013.01); *B65F 3/02* (2013.01); *B65F 2001/0086* (2013.01); *B65F 2220/108* (2013.01)

(58) Field of Classification Search
CPC ..... Y10S 220/909; B65F 1/122; B65F 1/004; B65F 3/001
USPC ..... 220/524
See application file for complete search history.

(56) References Cited

U.S. PATENT DOCUMENTS

| | | | | |
|---|---|---|---|---|
| 2,606,675 | A | 8/1952 | Jones | |
| 3,042,238 | A | 7/1962 | Bryan et al. | |
| 3,823,972 | A * | 7/1974 | Ramer | B65F 1/122 220/1.5 |
| 3,823,973 | A | 7/1974 | Ramer | |
| 3,826,973 | A | 7/1974 | Pflaum | |
| 4,290,352 | A | 9/1981 | Schmidt et al. | |
| 4,930,653 | A | 6/1990 | Machado | |
| 5,092,480 | A | 3/1992 | Waterston | |
| 5,186,330 | A | 2/1993 | McClure | |
| 5,213,382 | A | 5/1993 | Dawdy et al. | |
| 5,222,619 | A | 6/1993 | Gregory | |

(Continued)

*Primary Examiner* — Shawn M Braden
(74) *Attorney, Agent, or Firm* — Booth Udall Fuller, PLC

(57) ABSTRACT

A dual purpose waste collection device comprising a first container, a second container, a first pair of lifting sleeves coupled to first and second opposing sides surfaces of the first container, a second pair of lifting sleeves coupled to first and second opposing sides of the second container, and a third pair of lifting sleeves attached to the first pair of lifting sleeves and coupled to the second pair of lifting sleeves with an interlocking geometry. A method of collection of waste comprising identifying a waste collection device comprising a first pairs of lifting sleeves and a second pairs of lifting sleeves, positioning forks of a waste collection vehicle within lifting sleeves, and raising the forks of the waste collection vehicle to lift the waste collection device and to empty a content of the waste collection device into the waste collection vehicle.

13 Claims, 62 Drawing Sheets

(56) References Cited

U.S. PATENT DOCUMENTS

| | | | | |
|---|---|---|---|---|
| 5,490,606 | A * | 2/1996 | Lombardo | B65F 1/004 220/324 |
| 5,547,097 | A * | 8/1996 | Lyon | B65D 88/129 220/23.83 |
| 6,325,587 | B1 | 12/2001 | Wysocki et al. | |
| 7,237,689 | B2 | 7/2007 | Maggio, Sr. et al. | |
| 2009/0090711 | A1 | 4/2009 | Barcham | |

* cited by examiner

DUAL RECYCLABLE AND NON-RECYCLABLE WASTE COLLECTION DEVICE AND METHOD

RELATED APPLICATIONS

This application claims priority to, and is a continuation-in-part application of, U.S. patent application Ser. No. 14/065,100, titled "Dual Recyclables and Non-Recyclable Waste Collection Device and Method Therefor," filed Oct. 28, 2013, which is a divisional application of U.S. patent application Ser. No. 12/419,968, titled "Dual Recyclables and Non-Recyclable Waste Collection Device and Method Therefor," filed Apr. 7, 2009, now U.S. Pat. No. 8,646,644, the disclosures of which are hereby incorporated by this reference.

TECHNICAL FIELD

The present disclosure relates to waste collection; and more specifically, to a dumpster-like device that integrates a container for non-recyclable waste and a container for recyclables within the same space provided by current single-dumpster areas and enclosures; and, provides a method for the separate collection of the contents of each of the two containers using existing industry-standard waste removal vehicles and facilities.

BACKGROUND

Recycling programs are beneficial for many reasons. For example: 1) Many American companies rely on recycling programs to provide the raw materials they need to make new products. Recycling in the U.S. is a $236 billion a year industry. 2) More than 56,000 recycling and reuse enterprises employ 1.1 million workers nationwide. 3) The average American business discards one hundred pounds of garbage every day. Most of this garbage goes into landfills, where it is compacted and buried. 4) Recycling can provide advantages over placing materials into landfills, such as requiring less energy, using fewer natural resources, and keeping waste from accumulating in landfills. 5) Recycling can offer energy savings over manufacturing with new or virgin materials. For example, manufacturing with recycled aluminum cans uses 95% less energy. 6) Recycling can preserve existing landfill space. 7) In the year 2000, recycling of solid waste prevented the release of an estimated 32.9 million metric tons of carbon equivalent (MMTCE, the unit of measure for greenhouse gases) into the air. 8) Making goods from recycled materials generates less water pollution than manufacturing from virgin materials. 9) Using recycled materials reduces the need to damage forests, wetlands, rivers, and other places essential to wildlife. 10) Recycling and buying recycled products creates demand for more recycled products, decreasing waste and helping our economy.

Notwithstanding the benefits of recycling, large quantities of recyclable materials are estimated to be deposited in landfills every year.

SUMMARY

A need exists to decrease an amount of recyclable materials that are not recycled. Accordingly, a dual purpose waste collection device can comprise a first container, a second container, a first pair of lifting sleeves coupled to first and second opposing sides surfaces of the first container, a second pair of lifting sleeves coupled to first and second opposing sides of the second container, and a third pair of lifting sleeves fixedly attached to the first pair of lifting sleeves and releasably coupled to the second pair of lifting sleeves with an interlocking geometry.

The dual purpose waste collection device can further comprise the first container disposed behind the second container, wherein the front and back of the waste collection device, first container, and second container are determined with respect to a relative position of a waste collection vehicle positioned to insert forks of the waste collection vehicle into either the first pair of lifting sleeves, the second pair of lifting sleeves, or the third pair of lifting sleeves. The first container can be stacked over the second container, and the first container can comprise a bottom surfaces that matches a contour of a top surface of the second container. The second container can comprise at least one support member coupled to a bottom surface of the second container that extends behind the second container to a distance greater than a distance of sidewall of the first container such that the at least one support can extend beyond a footprint of the first container and second container. The first pair of lifting sleeves and the second pair of lifting sleeves can be horizontally separated in a side-by-side arrangement. The second pair of lifting sleeves and the third pair of lifting sleeves can be vertically separated in an over-under arrangement. The over-under arrangement of the second pair of lifting sleeves and the third pair of lifting sleeves can comprise an opening with slanted sides used as an alignment device for releasably coupling the interlocking geometry of the second pair of lifting sleeves and the third pair of lifting sleeves. The first container and second container can be releasably coupled to each other with at least one wheel.

In accordance with another aspect of the dual purpose waste collection device, the device can comprise an interior surface defining a space for waste collection, an exterior surface opposite the interior surface, a first pair of lifting sleeves coupled to the exterior surface, and a second pair of lifting sleeves coupled to the exterior surface.

The dual purpose waste collection device can further comprise the first pair of lifting sleeves or second pair of lifting sleeves comprising a length in a range of 0.6-1.3 meters (m), and the first pair of lifting sleeves and the second pair of lifting sleeves comprising a height in a range of 20-31 centimeters (cm), and further comprising a width in a range of 10-21 cm. The dual purpose waste collection device can further comprise an opening into the space for waste collection, a lid disposed over the opening and comprising an area greater than or equal to an area of the opening, and a locking mechanism coupled to the exterior surface and rotatably positioned with an arc of movement that comes into direct contact with the lid. The first pair of lifting sleeves and the second pair of lifting sleeves can each comprise at least one sleeve coupled to either a left side surface of the waste collection device or a right side surface of the waste collection device disposed opposite the left side surface of the waste collection device, wherein the left and right sides are determined with respect to a relative position of a waste collection vehicle positioned to insert forks of the waste collection vehicle into either the first pair of lifting sleeves or the second pair of lifting sleeves. A third pair of lifting sleeves can comprise a form that interlocks with a form of the first pair of lifting sleeves or the second pair of lifting sleeves. A support member can be coupled to at least one sleeve of the first pair of lifting sleeves or the second pair of lifting sleeves, the support member comprising a length that extends an entire distance between a left side surface of the waste collection device and the right side surface of the waste collection device. The first pair of lifting sleeves and the second pair of lifting sleeves can be coupled to a bottom surface of the waste collection device.

In accordance with another aspect of the dual purpose waste collection device, a method of selective collection of recyclable and non-recyclable waste can comprise identifying a waste collection device comprising a first pairs of lifting sleeves and a second pairs of lifting sleeves, positioning forks of a waste collection vehicle within the first pairs of lifting sleeves or the second pairs of lifting sleeves, and raising the forks of the waste collection vehicle to lift the waste collection device and to empty a content of the waste collection device into the waste collection vehicle.

The method of selective collection of recyclable and non-recyclable waste can further comprise activating a locking device to release a lid from over at least a portion of the waste collection device. The method can further comprise activating the locking device by positioning forks of a waste collection vehicle within the first pairs of lifting sleeves or the second pairs of lifting sleeves. The method can further comprise positioning forks of the waste collection vehicle within the first pairs of lifting sleeves or the second pairs of lifting sleeves disposed below a bottom surface of the waste collection device. The method can also comprise positioning forks of the waste collection vehicle within the first pairs of lifting sleeves or the second pairs of lifting sleeves coupled to opposing side surfaces of the waste collection device.

BRIEF DESCRIPTION OF THE DRAWINGS

Embodiments of the disclosure will become more fully understood from the detailed description and the accompanying drawings, wherein.

DETAILED DESCRIPTION

Figure 1A:
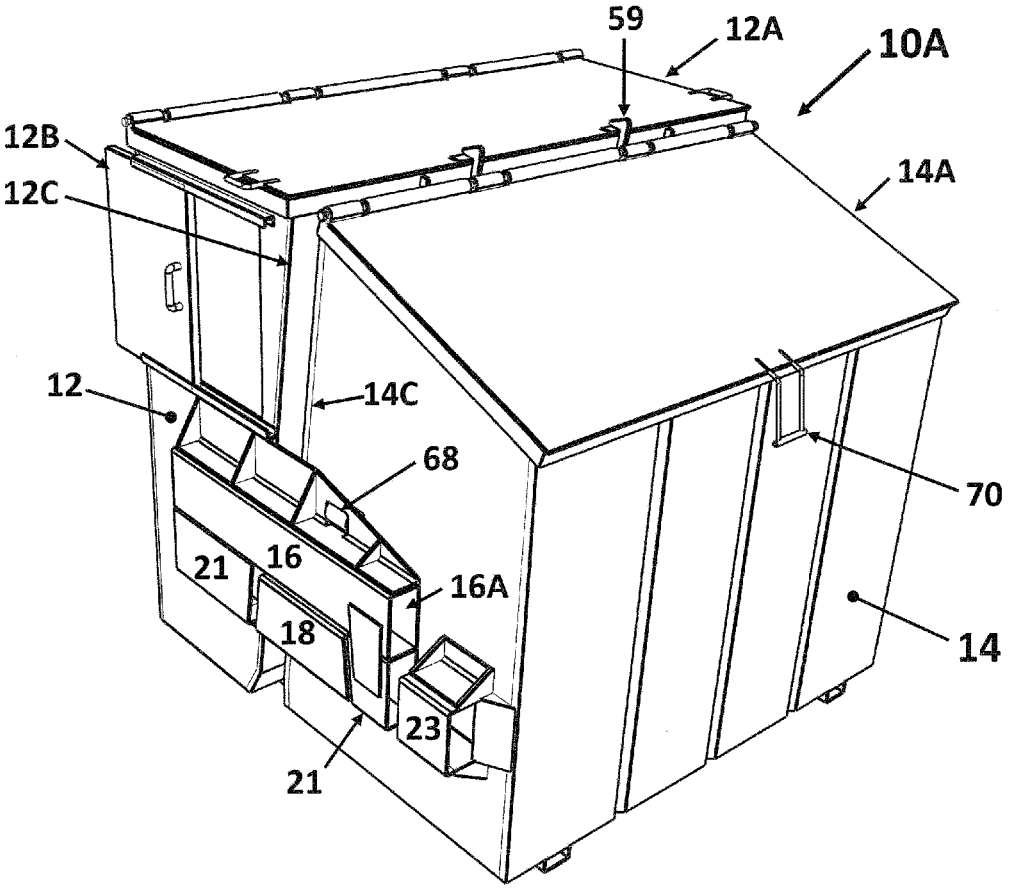
FIGS. 1A-1C show various views of an embodiment of a dual waste collection device.
Figure 1B:
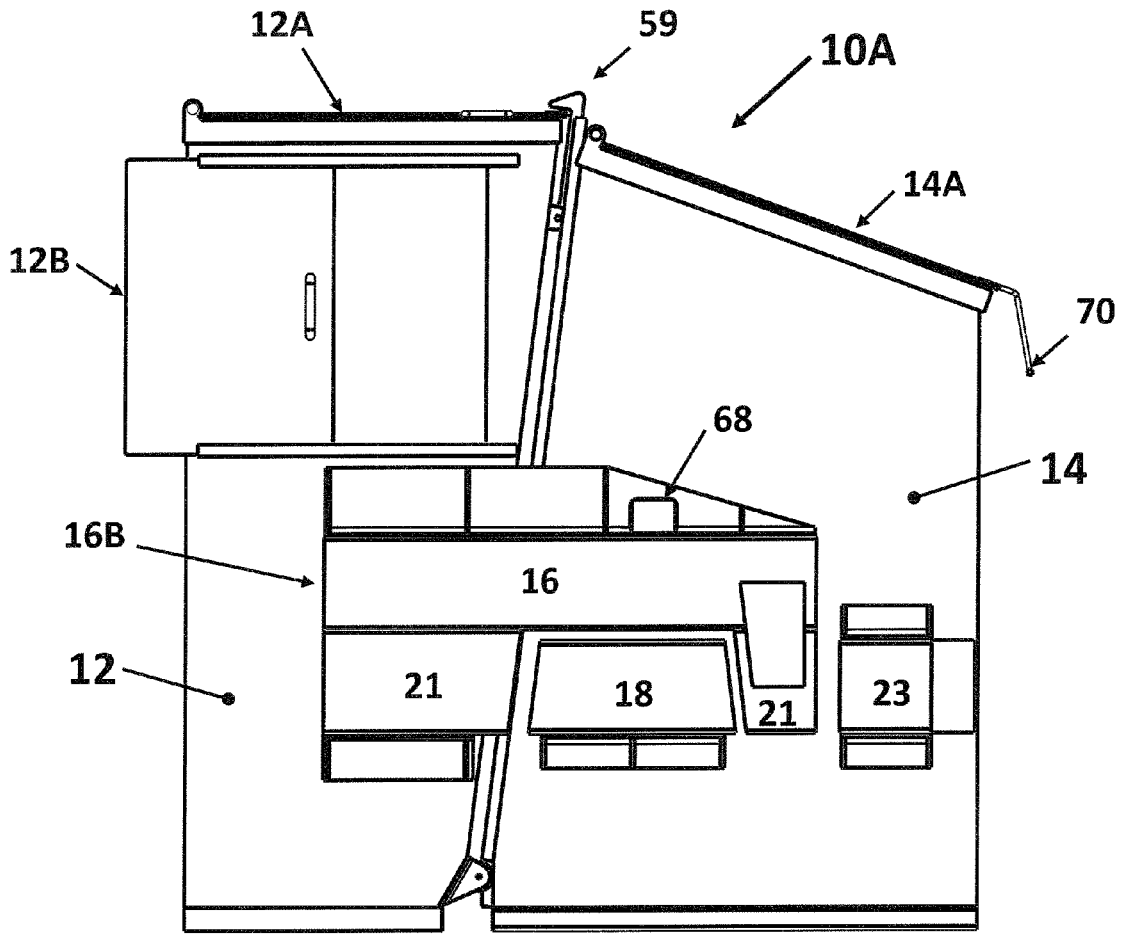
Figure 1C:
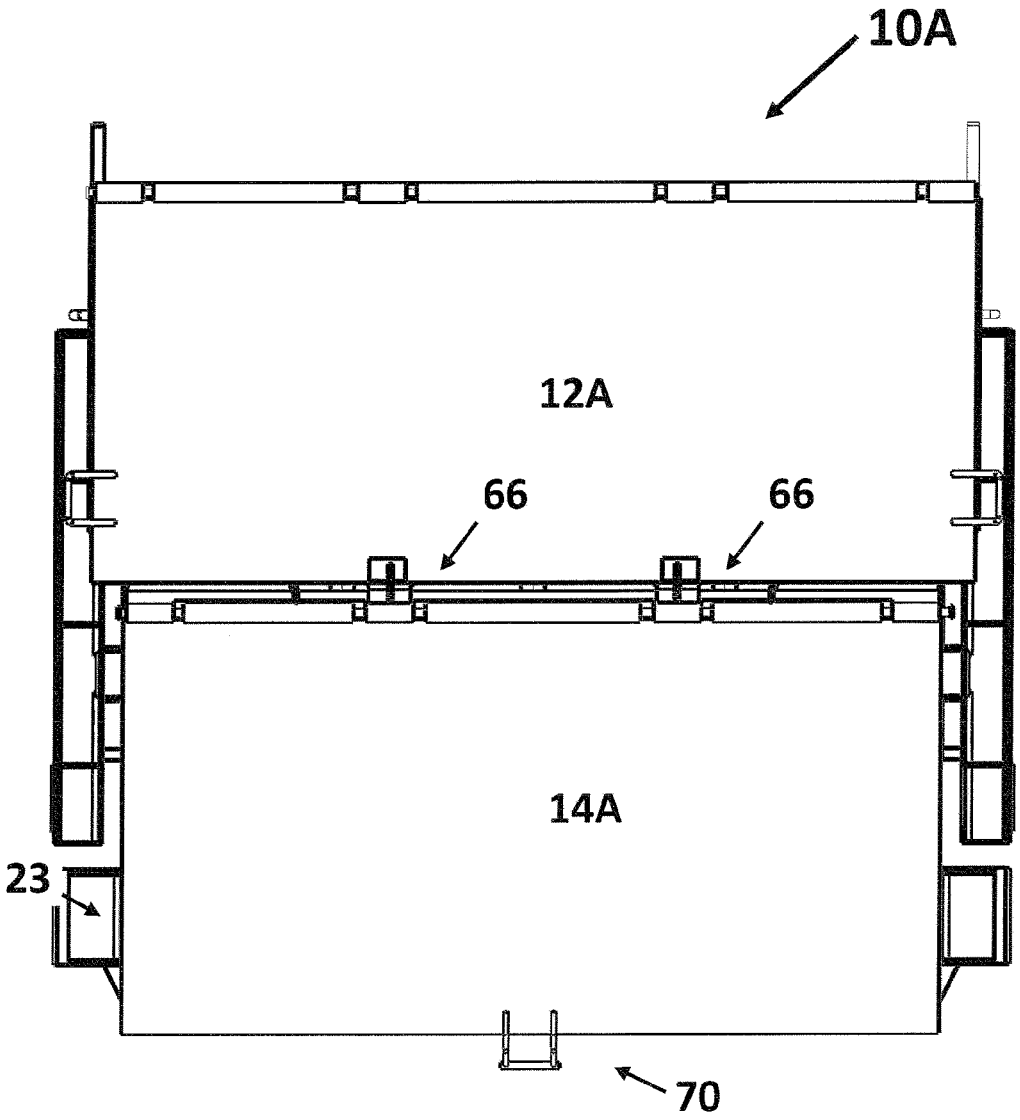
Figure 2A:
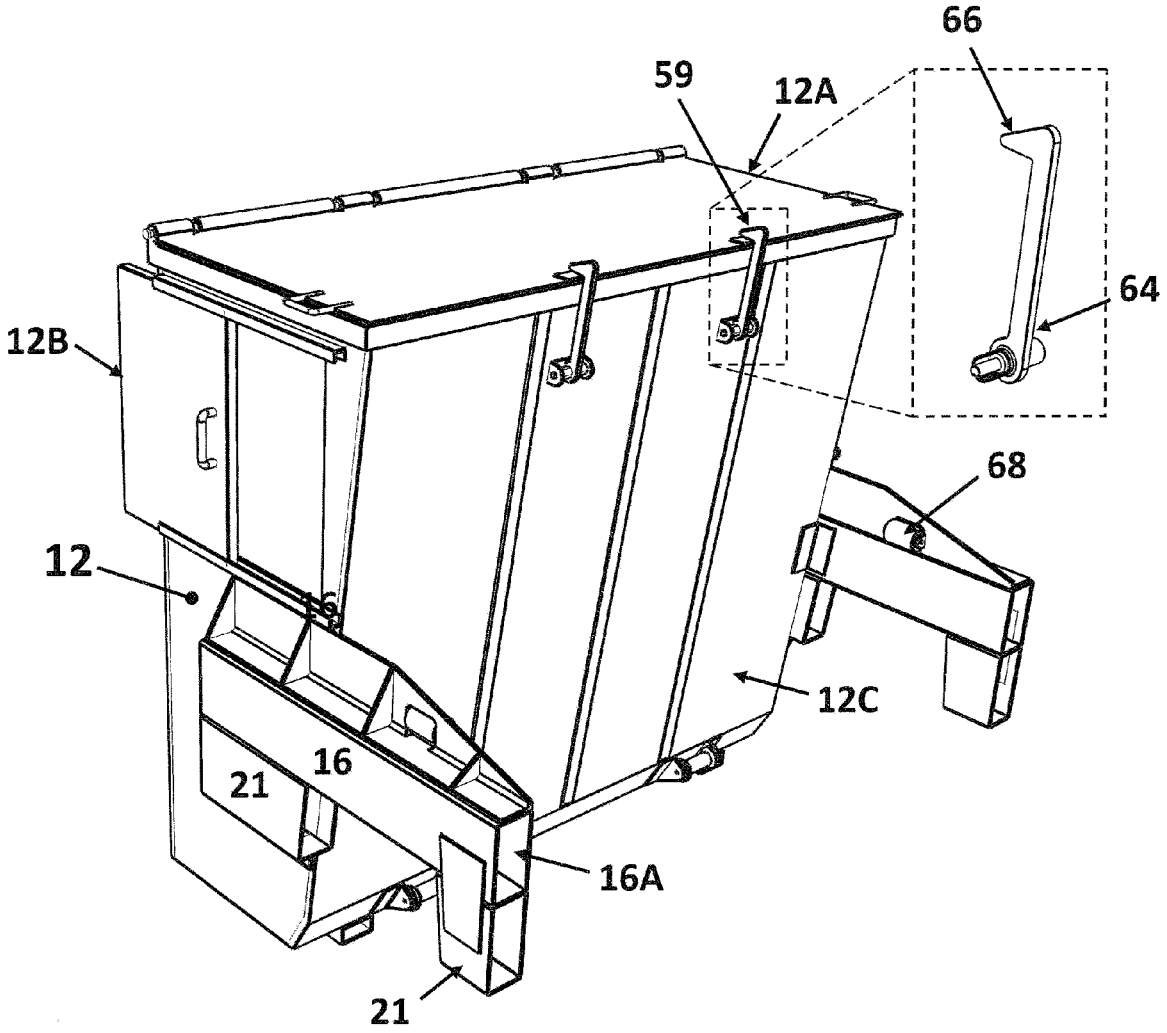
FIGS. 2A and 2B show additional views of a first container of the dual waste collection device of FIGS. 1A-1C.
Figure 2B:
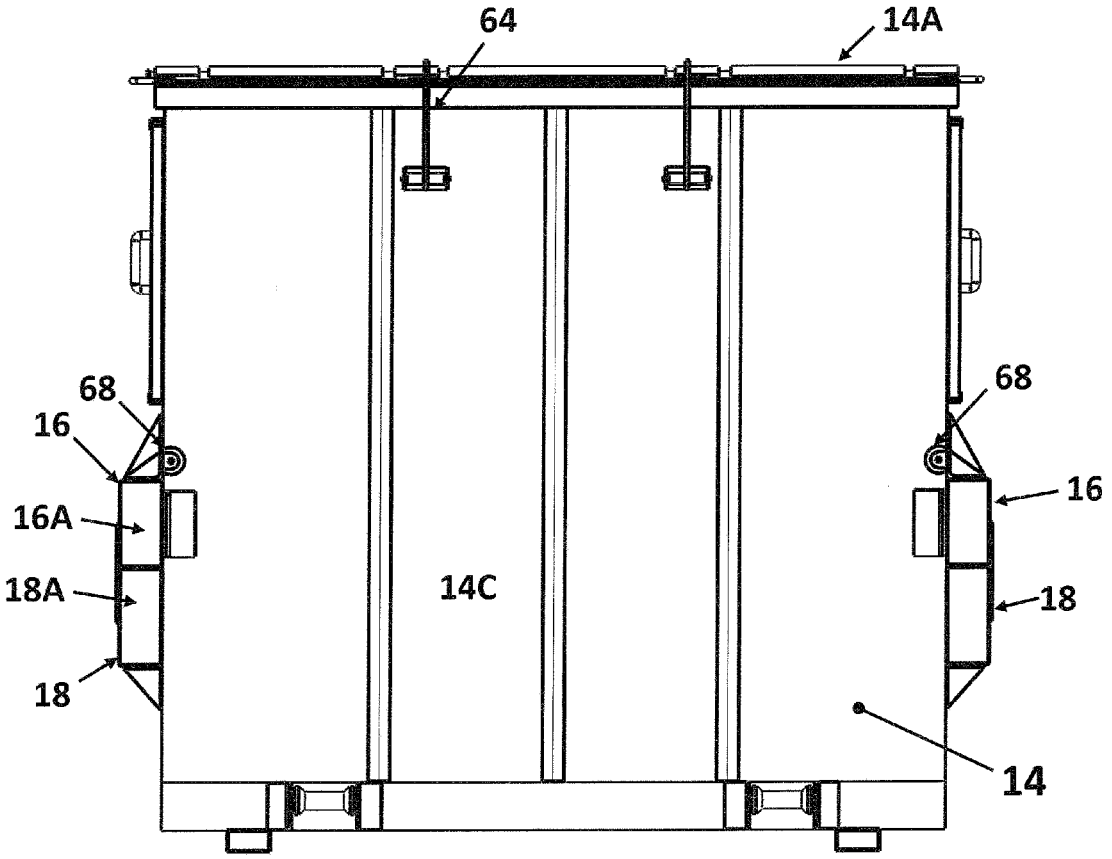

This disclosure, its aspects and implementations, are not limited to the specific components, structures, material types, system component examples, or methods disclosed herein. Many additional components, structures, material types, system component examples, and methods are contemplated for use with particular implementations from this disclosure. Accordingly, for example, although particular implementations are disclosed, such implementations and implementing components may comprise any components, models, types, materials, versions, quantities, and/or the like as is known in the art, consistent with the intended operation.

The word "exemplary," "example" or various forms thereof are used herein to mean serving as an example, instance, or illustration. Any aspect or design described herein as "exemplary" or as an "example" is not necessarily to be construed as preferred or advantageous over other aspects or designs. Furthermore, examples are provided solely for purposes of clarity and understanding and are not meant to limit or restrict the disclosed subject matter or relevant portions of this disclosure in any manner. It is to be appreciated that a myriad of additional or alternate examples of varying scope could have been presented, but have been omitted for purposes of brevity.

While this disclosure includes a number of embodiments in different forms, there is presented in the drawings and written descriptions in the following pages detail of particular embodiments with the understanding that the present disclosure is to be considered as an exemplification of the principles of the disclosed structures, devices, methods, and systems, and is not intended to limit the broad aspect of the disclosed concepts to the embodiments illustrated. Additionally, it should be understood by those of ordinary skill in the art that other manufacturing devices and examples could be intermixed or substituted with those provided. In places where the description refers to particular embodiments, it should be readily apparent that a number of modifications can be made without departing from the spirit thereof and that these embodiments and implementations may be applied to other technologies as well. Accordingly, the disclosed subject matter is intended to embrace all such alterations, modifications and variations that fall within the spirit and scope of the disclosure and the knowledge of one of ordinary skill in the art.

As indicated above, notwithstanding the benefits of recycling, large quantities of recyclable materials are estimated to be deposited in landfills every year. Therefore, a need exists to decrease an amount of recyclable materials that are not recycled, and to increase an amount of material that is recycled. Less than optimal levels of recycling can be attributed to a number of factors. In some instances, current infrastructure for commercial bulk waste collection, such as space constraints, can force a choice between collection of recyclable and collection of non-recyclable materials. For example, many waste collection vehicles, such as standard fork lift-operated waste collection vehicles, whether front loading or rear loading vehicles, or side loading waste collection vehicles are not equipped to handle containers for both recyclable and non-recyclable waste. Recyclable waste containers and non-recyclable waste containers often require different mechanisms for waste collection vehicles to lift, hold, and empty the different containers. Accordingly, entities, such as municipalities, can be forced to choose between recyclable and non-recyclable waste collection, especially for designated bulk commercial waste locations. A forced choice between collection of recyclable and non-recyclable materials can be made more expensive, less convenient, and can lead to reduced collection of recyclable materials.

Therefore, a need exists for making the collection, storage, and transfer of waste, including recyclable waste in particular, less expensive and more convenient, for all types of waste collection vehicles. A solution to the above-mentioned needs can include providing a device that integrates a first container for non-recyclable waste, a second container for recyclables, and a method, structure, or both that facilitates the collection of waste from the first container and second container that can be compatible with existing infrastructure, such as a standard fork lift-operated waste collection vehicles or other vehicles. As discussed in greater detail below in relation to the FIGs., the device comprising first and second containers can allow a truck operator to selectively collect either waste or recycling based solely on the position of the forks.

Referring to the figures, a dual waste collection device for recyclable waste and non-recyclable waste is disclosed, which is also referred to as a dual recyclables and non-recyclable waste collection device. The dual recyclables and non-recyclable waste collection device can provide a bulk waste collection bin comprising two or more separate containers or compartments. The two or more separate containers can comprise a first container for recyclables and a second container for non-recyclable waste. A size, shape, weight, and various dimensions of the dual waste collection device can be standardized or conventional, so as to be seamlessly integrated with existing waste management or trash collecting infrastructure, such as, e.g., garbage trucks and recycling trucks.

Figure 3A:
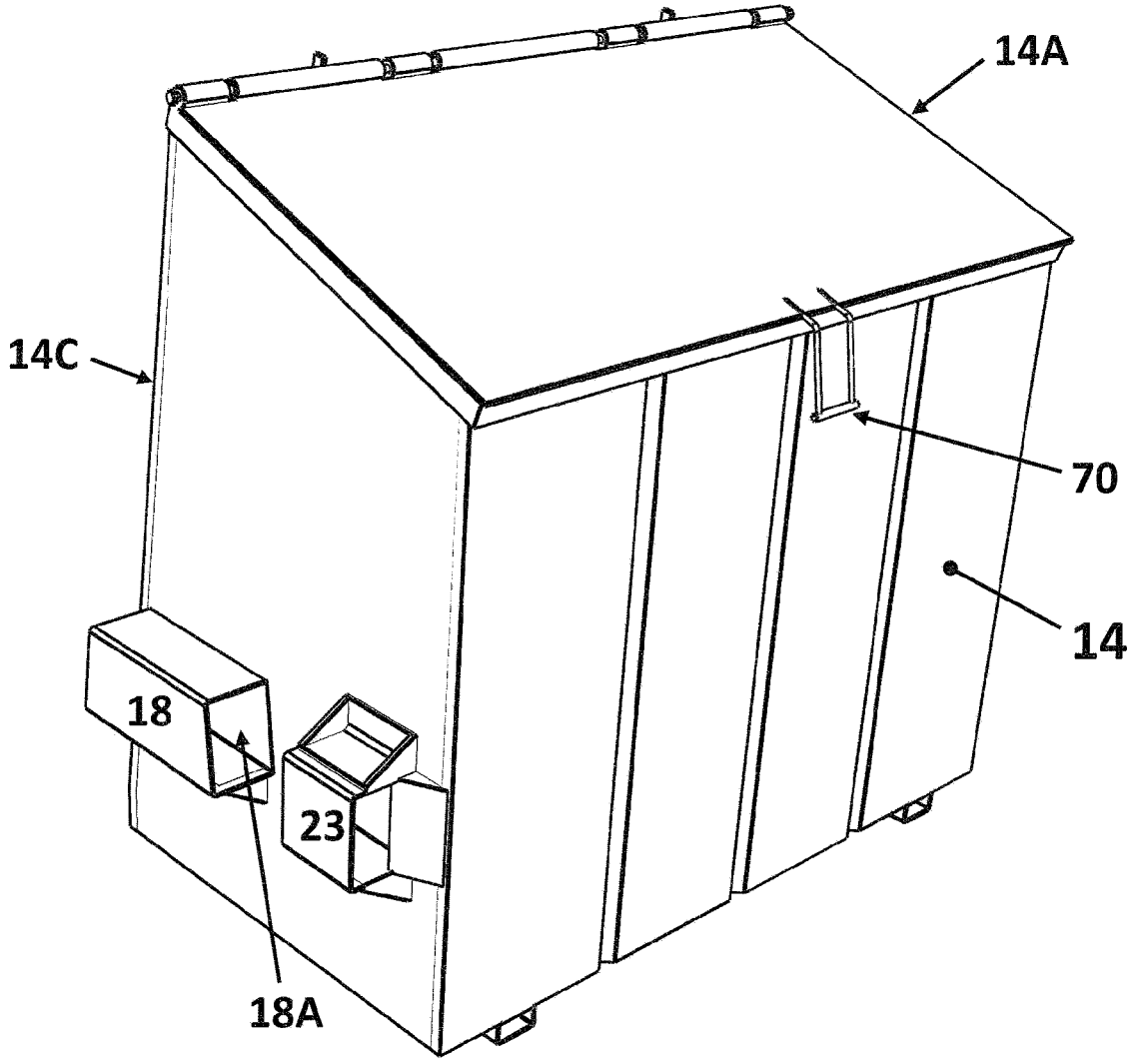
FIGS. 3A and 3B show various views of a second container of the dual waste collection device of FIGS. 1A-1C.
Figure 3B:
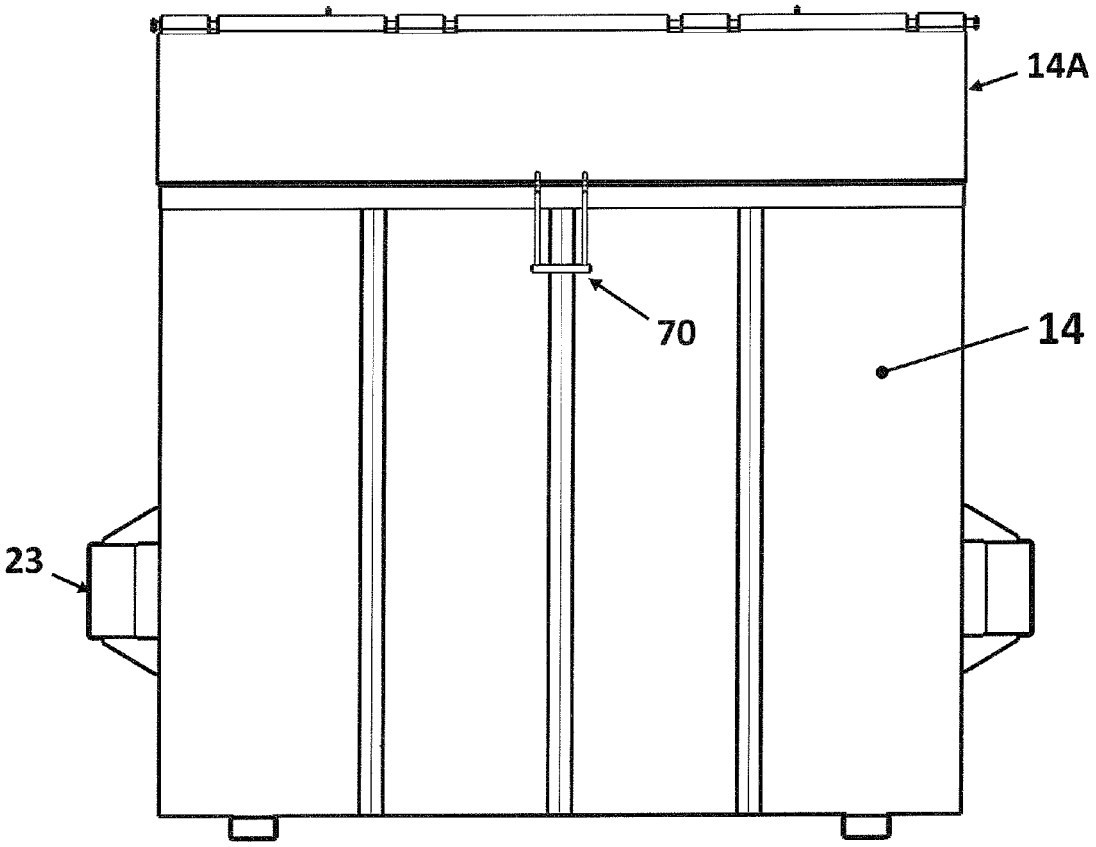

Referring to FIGS. 1A-3B, the dual recyclables and non-recyclable waste collection device 10A (hereinafter device 10A) has a first container 12 and a second container 14. More specifically, the waste collection device 10A is described below with reference to the various views presented in FIGS. 1A-3B. FIG. 1A shows an elevated perspective view, FIG. 1B shows a side view, and FIG. 1C shows a top view of the device of FIG. 1A. FIG. 2A shows an elevated perspective view of the first container of the device of FIG. 1A, while FIG. 2B shows a front view of the first container of the device of FIG. 1A. FIG. 3A shows an elevated perspective view of the second container of the device of FIG. 1A, while FIG. 3B is a front view of the second container of the device of FIG. 1A.

As shown in FIGS. 1A-3B, either container 12 or 14 can house recyclables or non-recyclables. For further discussion, the first container 12 is used for recyclable waste collection and the second container 14 is used for non-recyclable waste collection. The first container 12 and second container 14 are generally made out of a sturdy metallic material such as steel or the like. However, other materials can be used without departing from the spirit and scope of the present disclosure.

The first container 12 and second container 14 can comprise lids 12A and 14A. One or more side doors 12B can also be formed on the first container 12 and second container 14. In the present embodiment, side doors 12B are only formed in the first container 12. However, side doors 12B can be formed on first container 12, the second container 14, or both.

In the embodiment shown in FIGS. 1A-3B, the first container 12 has an angled front surface 12C and the second container 14 has an angled rear surface 14C. The front surface 12C and the rear surface 14C are approximately parallel to one another. The angle of the front surface 12C and the rear surface 14C allow the first container 12 to more easily be raised and lifted away from the second container 14. The angle of the front surface 12C and the rear surface 14C further makes it easier to better align the first and second containers 12 and 14 so that there is a minimal gap between the front surface 12C and the rear surface 14C of the first and second containers 12 and 14.

The first container 12 can comprise a pair of sleeves 16. The pair of sleeves 16 is generally made out of the same material as the first and second containers 12 and 14. An individual sleeve of the pair of sleeve members 16 is attached to each side section of the first container 12. The pair of sleeves 16 can extend away from the first container 12. By extending the pair of sleeves 16 away from the first container 12, the pair of sleeves 16 forms a guide for the placement of the second container 14 and allow for the forks of a standard garbage truck to fully engage the sleeves for lifting of the first container. The pair of sleeves 16 can comprise a hollow channeling 16A. The hollow channeling 16A allows for a standard fork lift-operated waste collection vehicle to insert the fork through the pair of sleeves 16 to raise and empty the first container 12.

The second container 14 can comprise a pair of sleeves 18. The pair of sleeves 18 is generally made out of the same material as the first and second containers 12 and 14. An individual sleeve of the pair of sleeve members 18 is attached to each side section of the second container 14 and below the pair of sleeves 16 on the first container 12. The pair of sleeves 18 can comprise a hollow channeling 18A.

Each sleeve 16 can comprise another sleeve 21 coupled to the underside of the sleeve 16. Sleeve 21 is formed to comprise an open central section. Thus, below each end of the sleeve 16 can be the sleeve 21 with the central area below sleeve 16 open. The pair of sleeves 21 is in alignment with the second pair of sleeves 18 on the second container 14. The central area of sleeve 21 is opened and spaced to enable the pair of sleeves 18 of the second container 14 in between the opening. The sleeve 21 serves two purposes. First, sleeve 21 is used in combination with sleeves 18 to simultaneous lift the two containers 12 and 14 without movement of the two containers 12 and 14 with respect to one another. Second, the opening in sleeves 21 are used as an alignment device when placing the first container 12 back in position so that there is a minimal gap between the front surface 12C and the rear surface 14C of the first and second containers 12 and 14.

The second pair of sleeves 18 is formed to comprise angled side edges. Sleeves 21 also comprise angled side edges so that the side edges of sleeves 18 run approximately parallel with the side edges of sleeves 21. The angled sides edges of the sleeves 18 and 21 further serve as alignment mechanisms when placing the first container 12 back in position so that there is a minimal gap between the front surface 12C and the rear surface 14C of the first and second containers 12 and 14.

The second container 14 can comprise an additional pair of sleeves 23. The sleeves 23 are spaced from the pair of sleeves 18 to enable placement of the pair of sleeves 21 of the first container 12 between the pairs of sleeves 18 and 23. Accordingly, the four pairs of sleeves 16, 18, 21, and 23 can be in alignment when the device 10A is in its resting position, and can prevent movement of the containers 12 and 14 with respect to one another upon simultaneous lifting of the containers 12 and 14.

Since in this embodiment the device 10A enables simultaneous lifting of the two containers 12 and 14, device 10A can also include a locking device 59 to secure the lid 12A of the first container 12. This can allow the emptying of only second container 14 when simultaneous lifting of the two containers 12 and 14 for emptying. The first container 12 can still be lifted and emptied individually like in the previous embodiment.

In the present embodiment, the locking mechanism 59 for lid 12A is a latch 64. The latch 64 is hingedly coupled to the front surface 12C of the first container 12. The latch 64 has a hook 66 which can engage the lid 12A to lock the lid 12A when the first container 12 and second container 14 are positioned together. When the first container 12 and second container 14 are lifted together, the second container 14 can press the latch 64, rotating it upwards and towards the front surface 12C and lid 12A, so that the hook 66 can engage and lock the lid 12A. Thus, the lid 12A can remain closed when both the first container 12 and second container 14 are lifted together. When the forks of a standard dump truck pass through the pair of sleeves 16 to lift just the first container 12 slightly above the second container 14, the angle of the front surface of the first container causes the latch 64 to fall forward and away from front surface 12C and lid 12A so that the hook disengages the lid 12A. This unlocks the lid 12A thereby allowing the lid 12A to open when the first container 12 is emptied.

In the present embodiment, rollers 68 are placed on the interior side of the sleeves 16. The rollers 68 are positioned on the section of the sleeves 16 that extend away from the first container 12. The rollers 68 are used to allow the first container 12 to more easily be lifted away from and realigned with the second container 14.

A handle 70 can be attached to the lid 14A of the second container 14. The handle 70 is used to raise the lid 14A to insert any refuse into the second container 14.

Figure 4A:
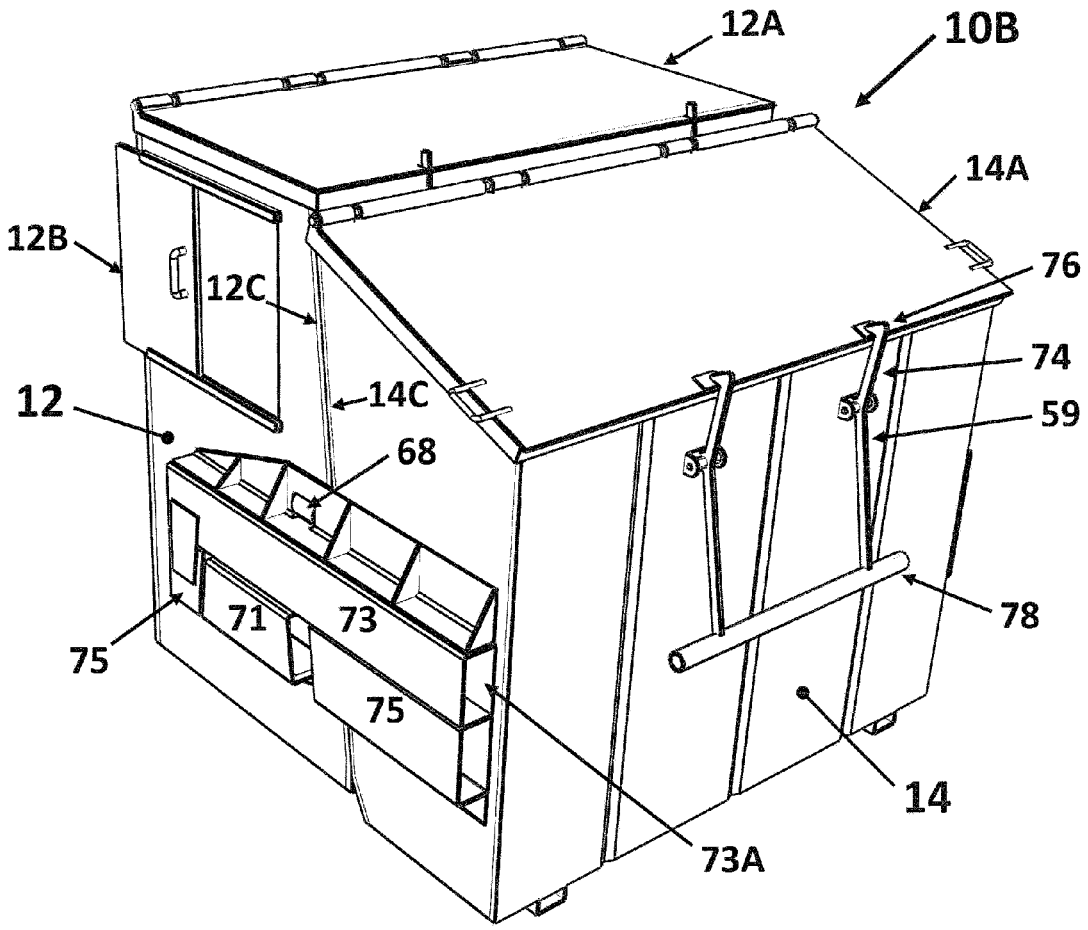
FIGS. 4A-4C show various views of another embodiment of a dual waste collection device.
Figure 4B:
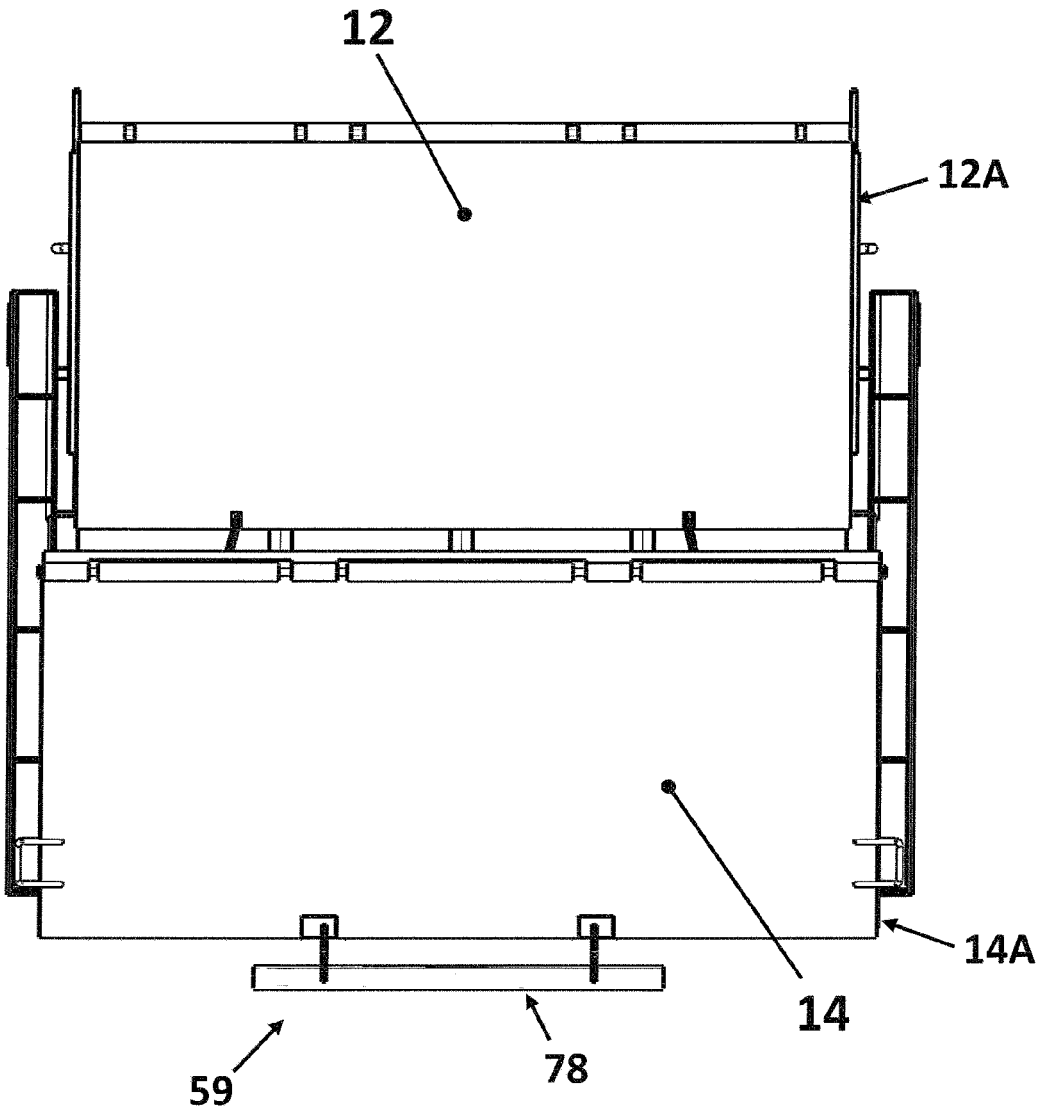
Figure 4C:
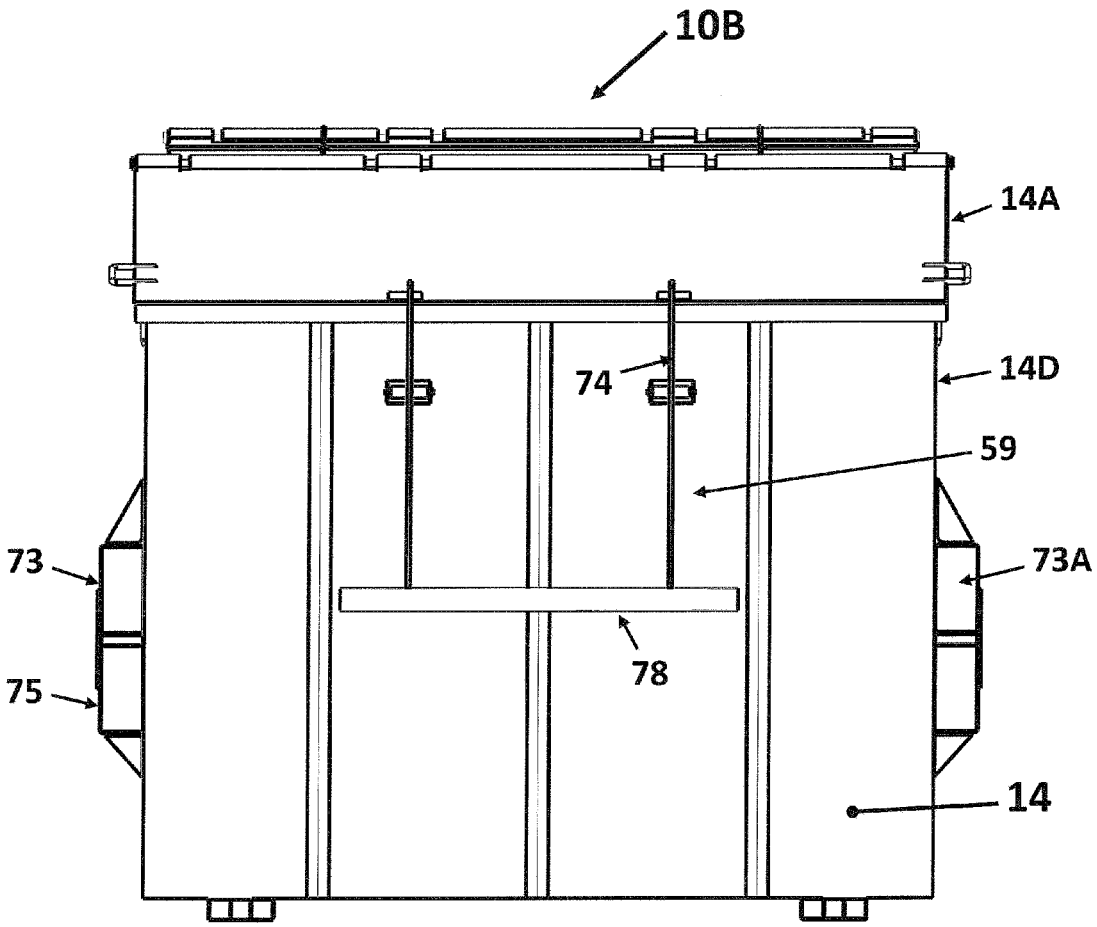
Figure 5A:
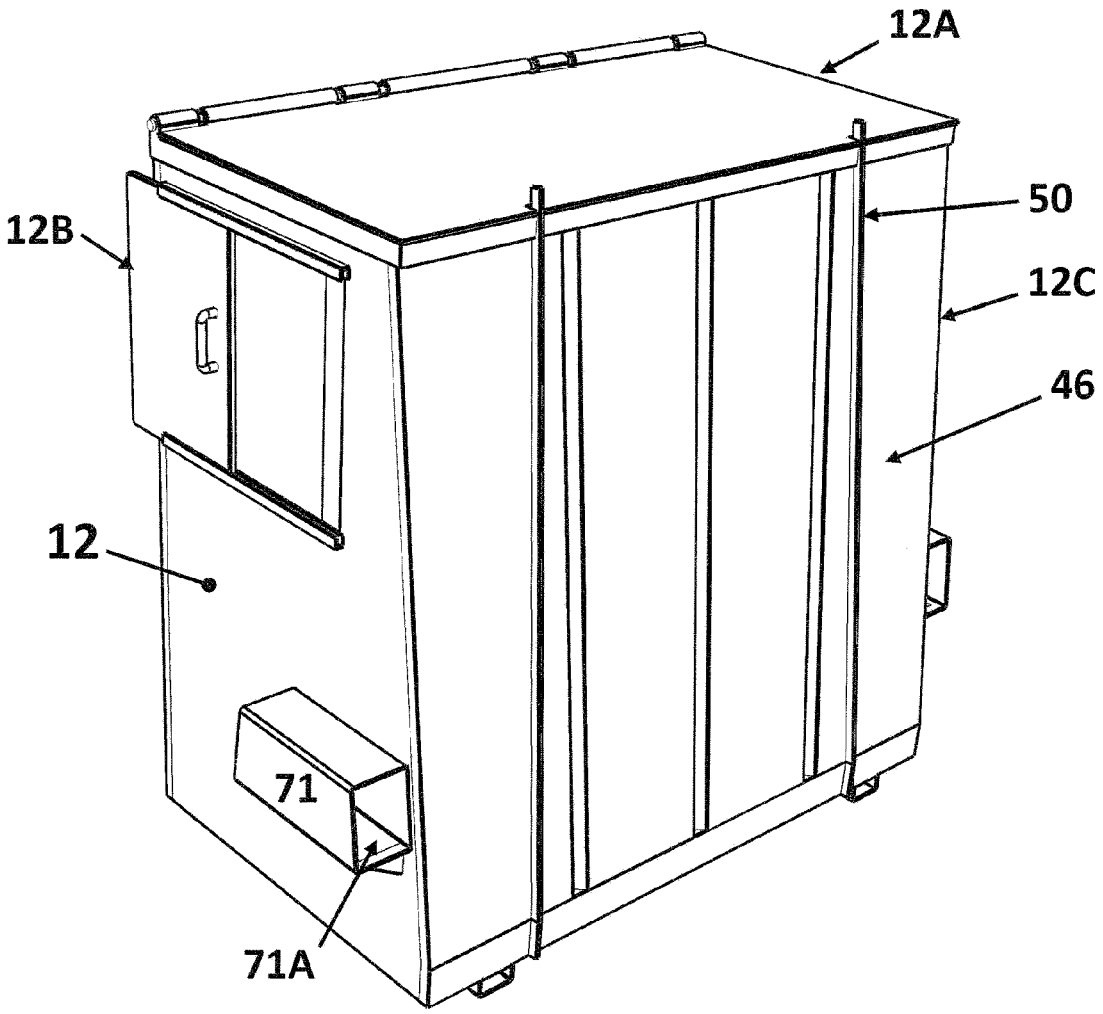
FIGS. 5A-5C show various views of a first container of the dual waste collection device of FIGS. 4A-4C.
Figure 5B:
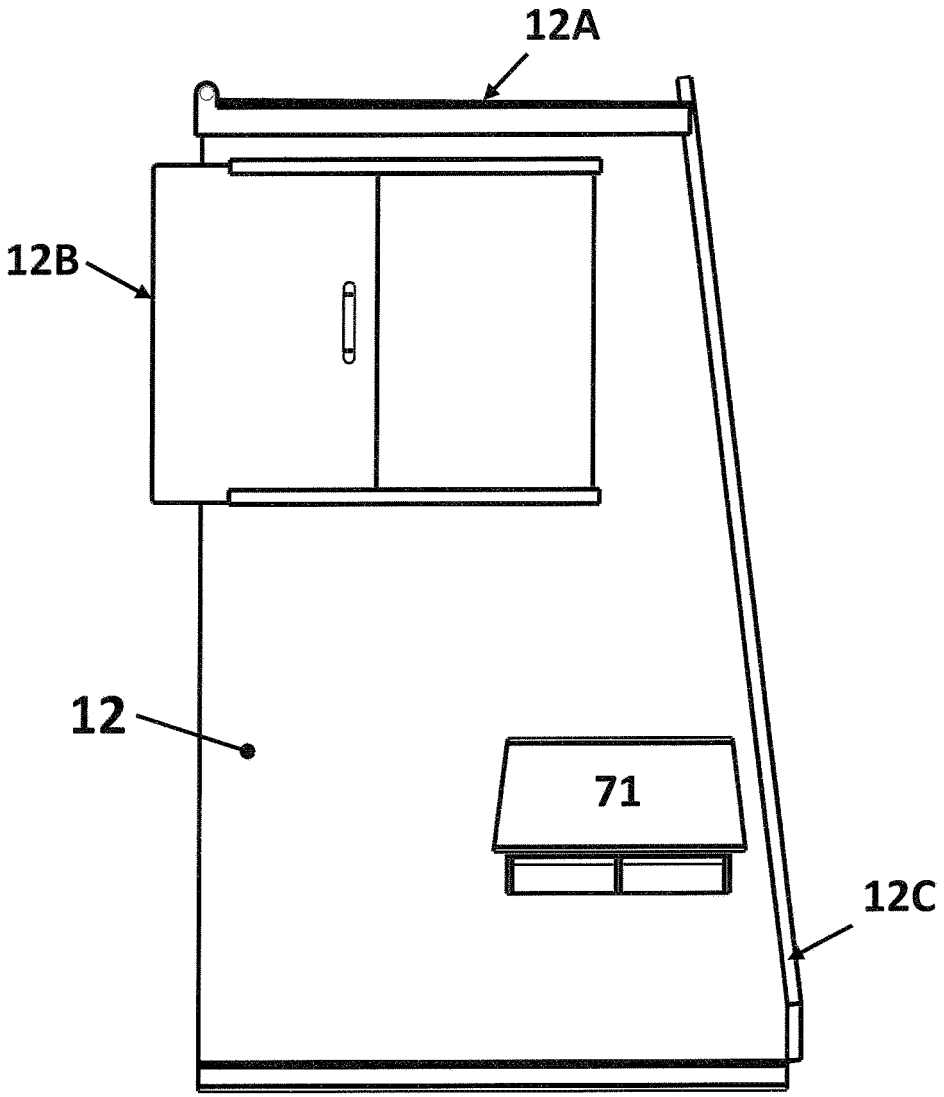
Figure 5C:
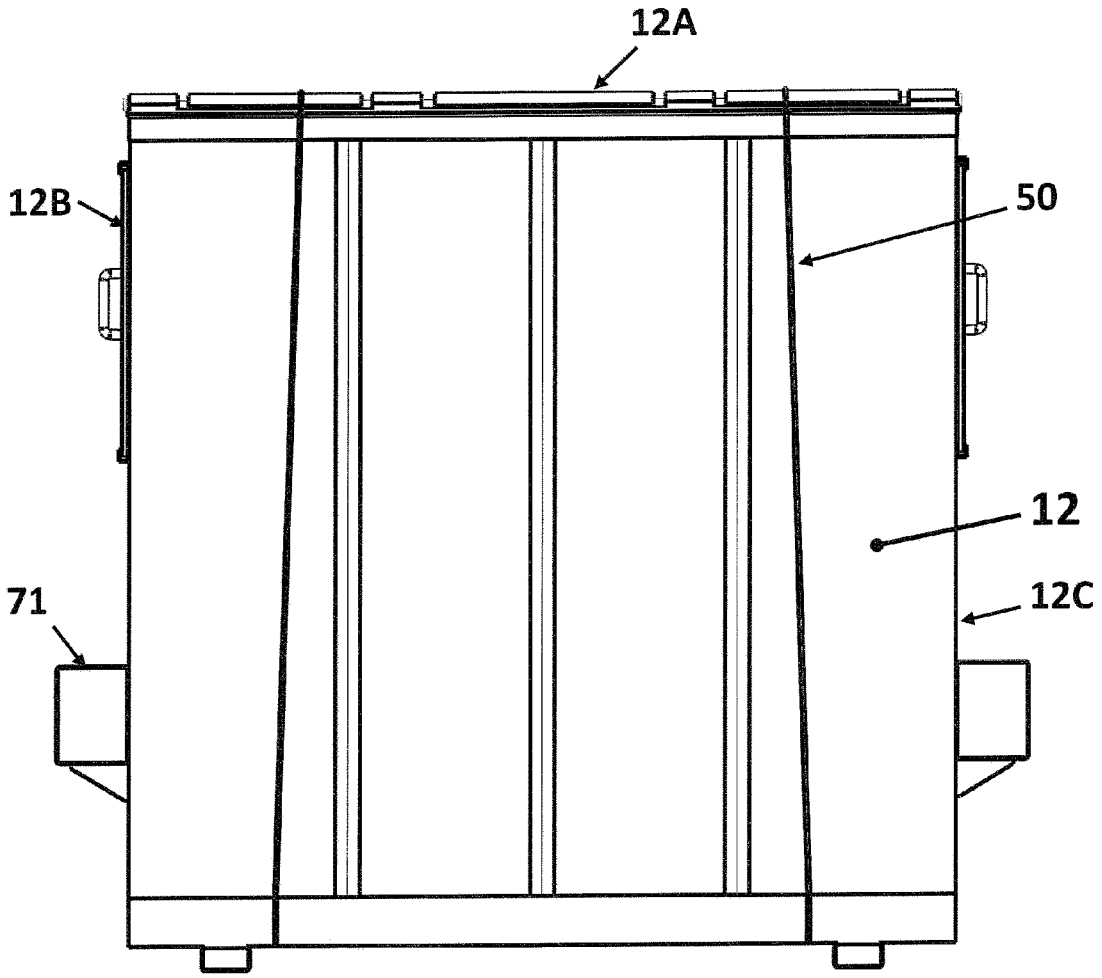
Figure 6A:
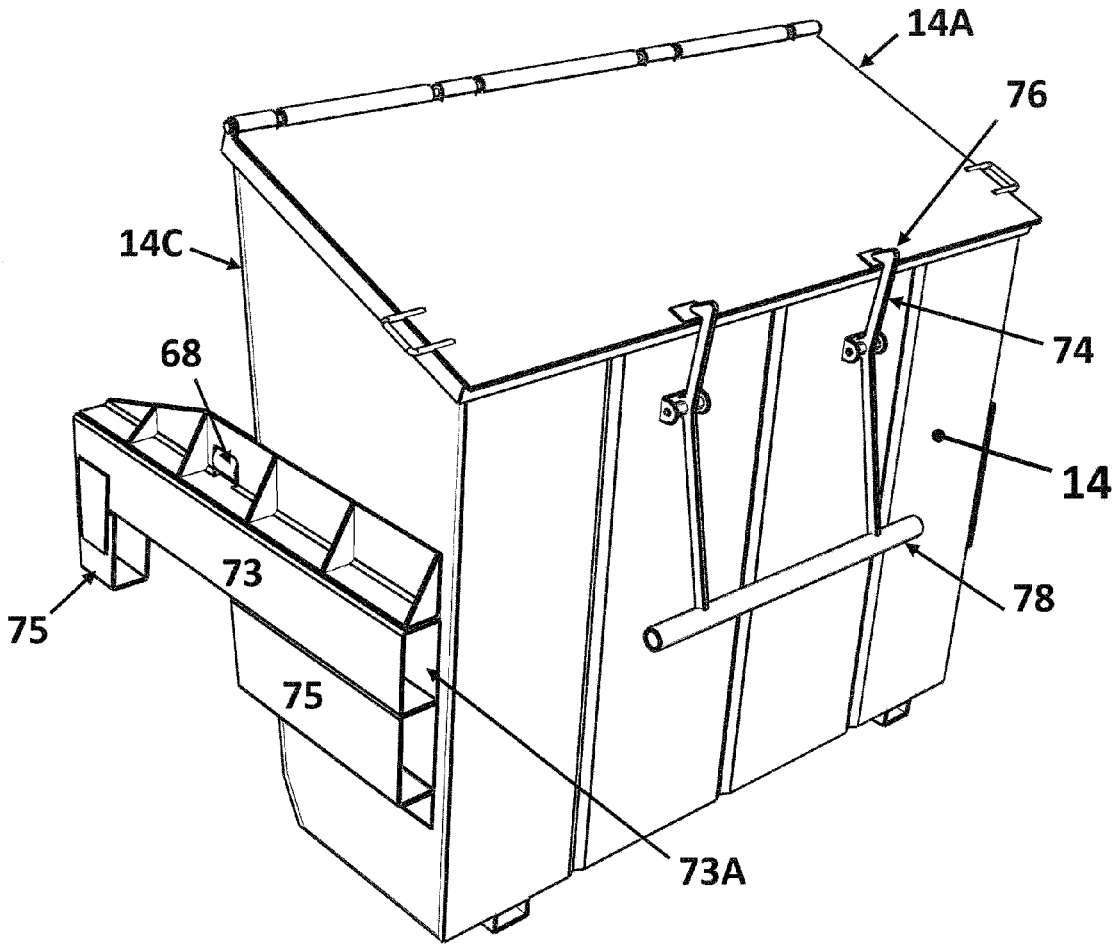
FIGS. 6A-6C show various views of a second container of the dual waste collection device of FIGS. 4A-4C.
Figure 6B:
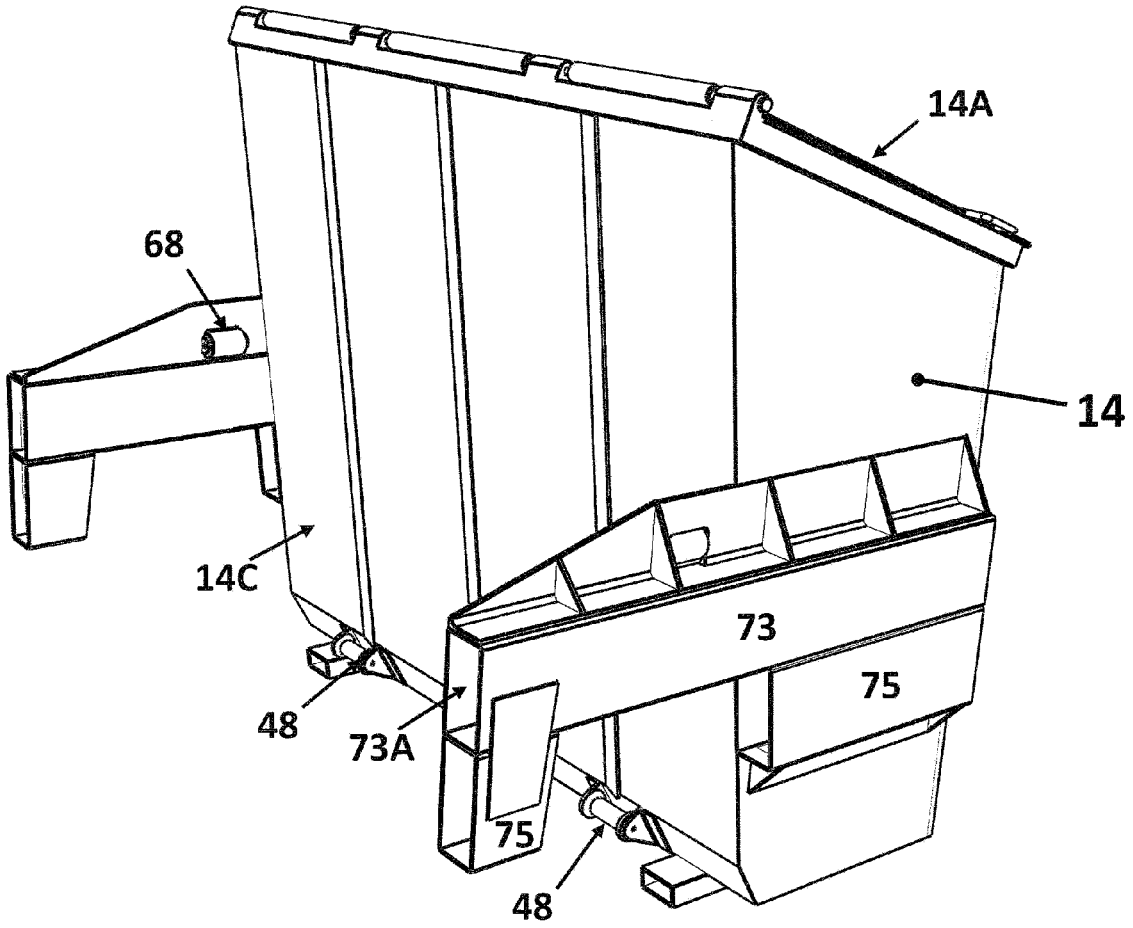
Figure 6C:
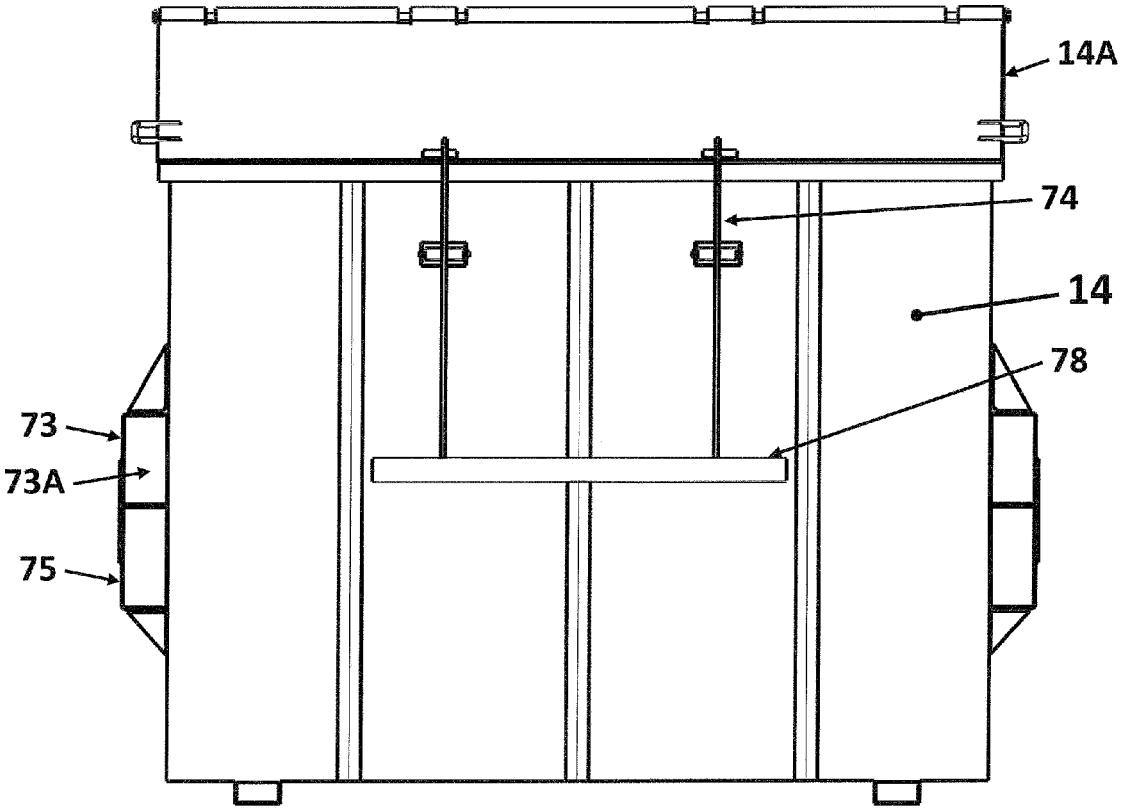

Referring to FIGS. 4A-6C, another embodiment of the device 10B is shown. More specifically, the waste collection device 10B is described below with reference to the various views presented in FIGS. 4A-6C. FIG. 4A shows an elevated perspective view of another embodiment of the device 10B. FIG. 4B shows a top view of the device of 10B. FIG. 4C shows a front view of the device 10B. FIG. 5A shows an elevated perspective view of the first container of the device 10B. FIG. 5B shows a side view of the first container of the device 10B. FIG. 5C is a front view of the first container of the device 10B. FIG. 6A is an elevated perspective view of the second container of the embodiment of the device 10B. FIG. 6B is another elevated perspective view of the second container of the embodiment of the device 10B. FIG. 6C is a front view of the second container of the embodiment of the device 10B.

As in the previous embodiment, the device 10B can comprise a first container 12 and a second container 14, where similar element number represent similar or identical features. The first container 12 and second container 14 can comprise lids 12A and 14A. Side doors 12B can also be formed on the first container 12 and second container 14.

The first container 12 can comprise an angled front surface 12C and the second container 14 has an angled rear surface 14C. The front surface 12C and the rear surface 14C are approximately parallel to one another. The angle of the front surface 12C and the rear surface 14C allow the second container 14 to more easily be raised and lifted away from the first container 12. The angle of the front surface 12C and the rear surface 14C further makes it easier to better align the first and second containers 12 and 14 so that there is a minimal gap between the front surface 12C and the rear surface 14C of the first and second containers 12 and 14.

The first container 12 can comprise a pair of sleeves 71. The pair of sleeves 71 is generally made out of the same material as the first and second containers 12 and 14. An individual sleeve of the pair of sleeve members 71 is attached to each side section of the first container 12. The pair of sleeves 71 can comprise a hollow channeling 71A. The hollow channeling 71A allows for a standard fork lift-operated waste collection vehicle to insert the fork through the pair of sleeves 71. Note that the hollow channels need not fully encapsulate the forks or be of exact size and shape as shown in the embodiment to function in the manner shown. Any one skilled in the art would recognize, for instance, that the exterior side surfaces of the sleeves are not needed as the forks keep the container from moving side to side beyond the sleeves.

The second container 14 can comprise a pair of sleeves 73. The pair of sleeves 73 is generally made out of the same material as the first and second containers 12 and 14. An individual sleeve of the pair of sleeve members 73 is attached to each side section of the second container 14 and above the pair of sleeves 71 on the first container 12. The pair of sleeves 73 can extend away from the second container 14 towards the first container 12. By extending the pair of sleeves 73 away from the second container 14, the pair of sleeves 73 forms a guide for the placement of the second container 14. The pair of sleeves 73 can comprise a hollow channeling 73A.

Each sleeve 73 can comprise another sleeve 75 coupled to the underside of the sleeve 73. Sleeve 75 is formed to comprise an open central section. Thus, below each end of the sleeve 73 can be the sleeve 75 with the central area below sleeve 73 open. The pair of sleeves 75 is in alignment with the pair of sleeves 71 on the first container 14. The central area of sleeve 75 is opened and spaced to enable the pair of sleeves 71 of the first container 12 in between the opening. The sleeve 75 serves two purposes. First, sleeve 75 is used in combination with sleeves 71 to simultaneous lift the two containers 12 and 14 without movement of the two containers 12 and 14 with respect to one another. Second, the opening in sleeves 75 are used as an alignment device when placing the second container 14 back in position so that there is a minimal gap between the front surface 12C and the rear surface 14C of the first and second containers 12 and 14.

The pair of sleeves 71 is formed to comprise angled side edges. Sleeves 75 also comprise angled side edges so that the side edges of sleeves 71 run approximately parallel with the side edges of sleeves 75. The angled sides edges of the sleeves 71 and 75 further serve as alignment mechanisms when placing the second container 14 back in position so that there is a minimal gap between the front surface 12C and the rear surface 14C of the first and second containers 12 and 14.

Since in this embodiment the device 10B enables simultaneous lifting of the two containers 12 and 14, device 10B can also include a locking device 59. However, in this embodiment, the locking device 59 is used to secure the lid 14A of the second container 14. This can allow the emptying of only the first container 12 when simultaneous lifting of the two containers 12 and 14 for emptying.

In the present embodiment, the locking mechanism 59 has one or more rod members 74 hingedly coupled to a top area of the front surface 14D of the second container 14. On one end of each rod member 74 is a hook 76. The hook 76 engages the lid 14A when the rod member 74 is in a first position thereby locking the lid 14. When the rod member 74 is placed in a second position, the hook 76 disengages from the lid 14A allowing one to lift the lid 14A. Attached to a second end of the rod member 74 is a lever 78. By pushing or pulling the lever 78, one can lock and unlock the lid 14A. It should be noted that the locking mechanism 59 of the present embodiment can be used with other embodiments of the disclosure.

In operation, when the forks of a standard dump truck pass through the pair of sleeves 73 to lift the second container 14 only, a cross member connecting the forks 25 can press against the lever 78 unlocking the lid 14A so that the contents of the second container 14 can be emptied. When the forks 25 of the dump truck pass through the two sets of sleeves 75 and 71 the dump truck can simultaneous lift the two containers 12 and 14. The locking mechanism 59 ensures that the contents of only the first container 12 can be emptied.

In this embodiment, an aligning mechanism 46 is used to properly align the first container 12 with the second container 14. It should be noted that the alignment mechanism 46 can be used on any of the previous embodiments or any of the following embodiments for ensuring the alignment of the first container 12 with the second container 14.

In the present embodiment, the aligning mechanism 46 can comprise a set of rollers 48 coupled to a rear surface 14C of the second container 14. A corresponding pair of guide rails 50 is coupled to the front surface 12A of the first container 12. When the first container 12 is lowered into position in proximity of the second container 14, the rollers 48 can mate with the guide rails 50 thereby causing the two containers 12 and 14 to align.

In accordance with one embodiment, the pair of guiderails 50 can be slightly tapered so that the pair of guiderails 50 is closer in proximity to each other at the top of the first container 12 than at the bottom of the first container 12. Accordingly, the pair of guiderails 50 can be wedged between opposite ends of the set of rollers 48 as the second container 14 is lowered into position in proximity of the first container 12 and thereby cause the two containers 12 and 14 to align.

In the present embodiment, rollers 68 are placed on the interior side of the sleeves 73. The rollers 68 are positioned on the section of the sleeves 73 that extend away from the second container 14. The rollers 68 are used to allow the second container 14 to more easily be lifted away from and realigned with the first container 12.

Figure 7A:
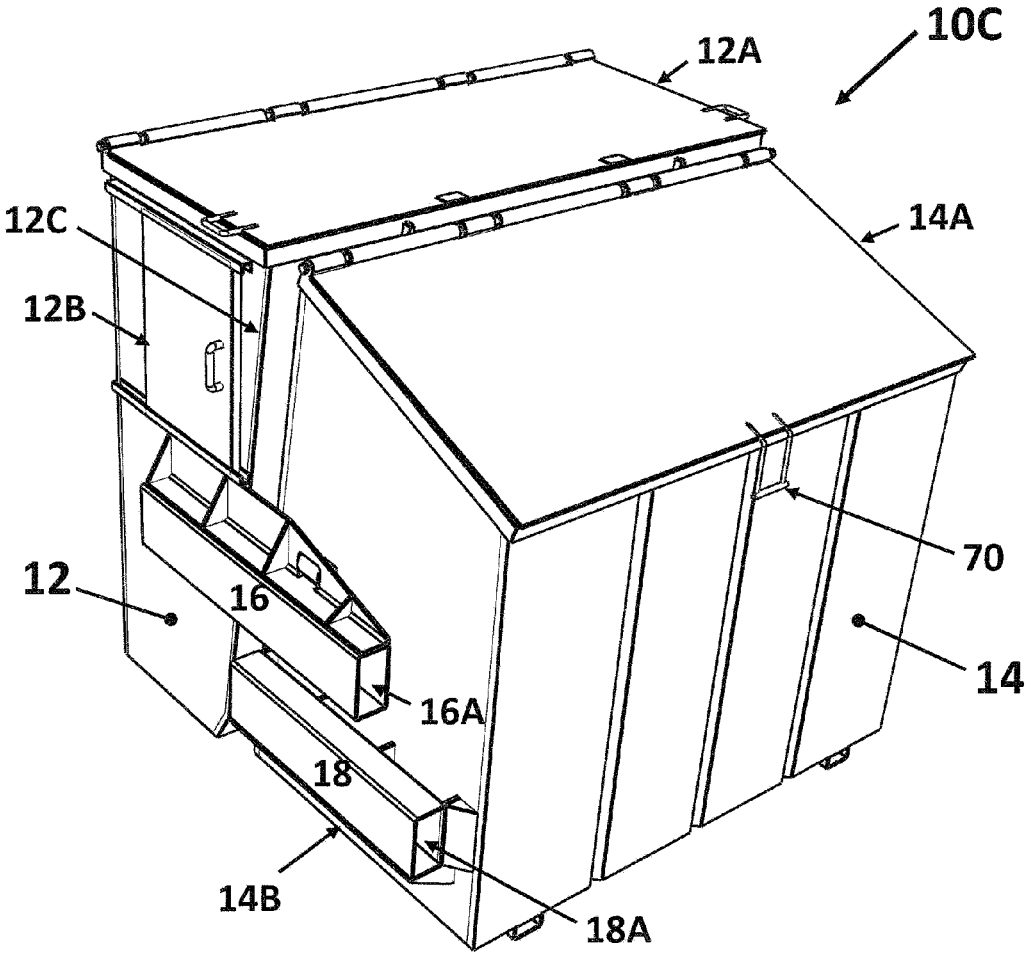
FIGS. 7A-7C show various views of another embodiment of a dual waste collection device without interlocking sleeves.
Figure 7B:
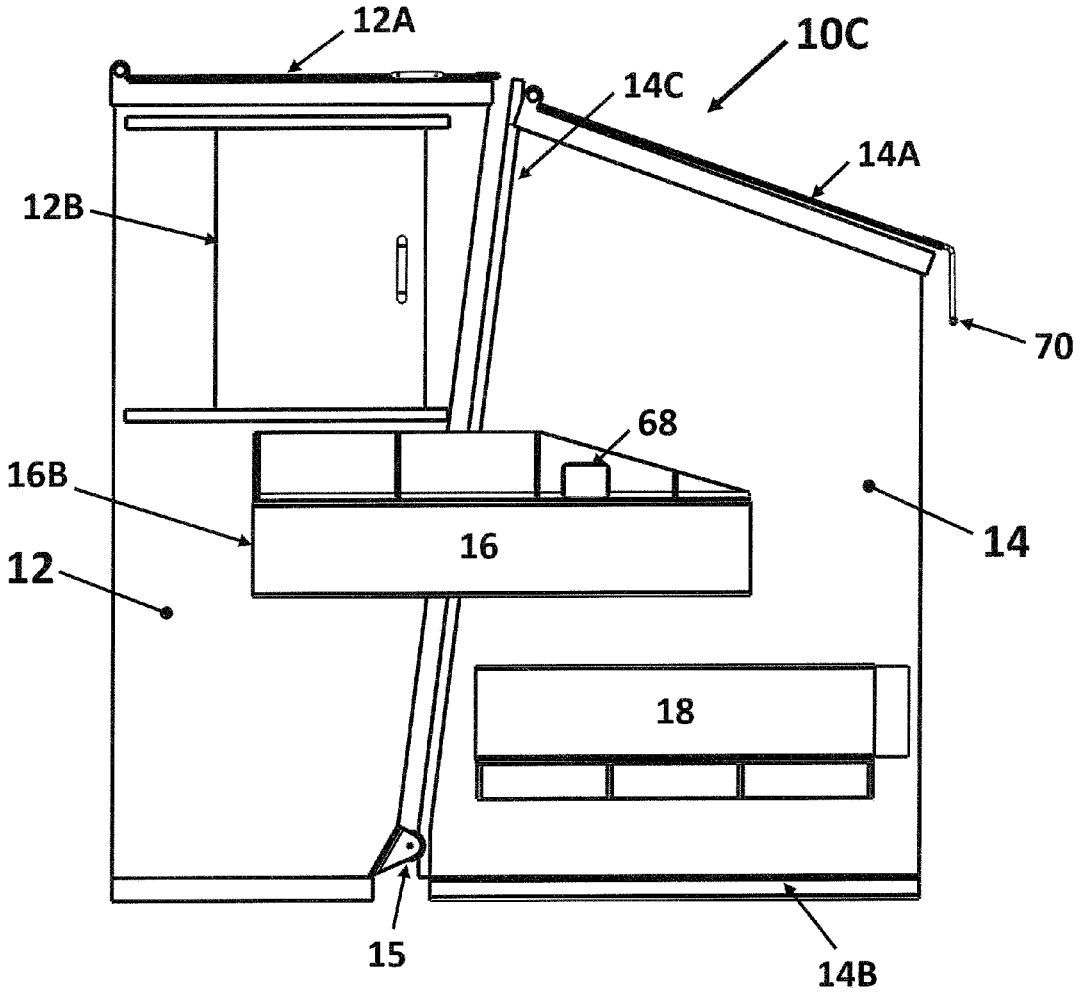
Figure 7C:
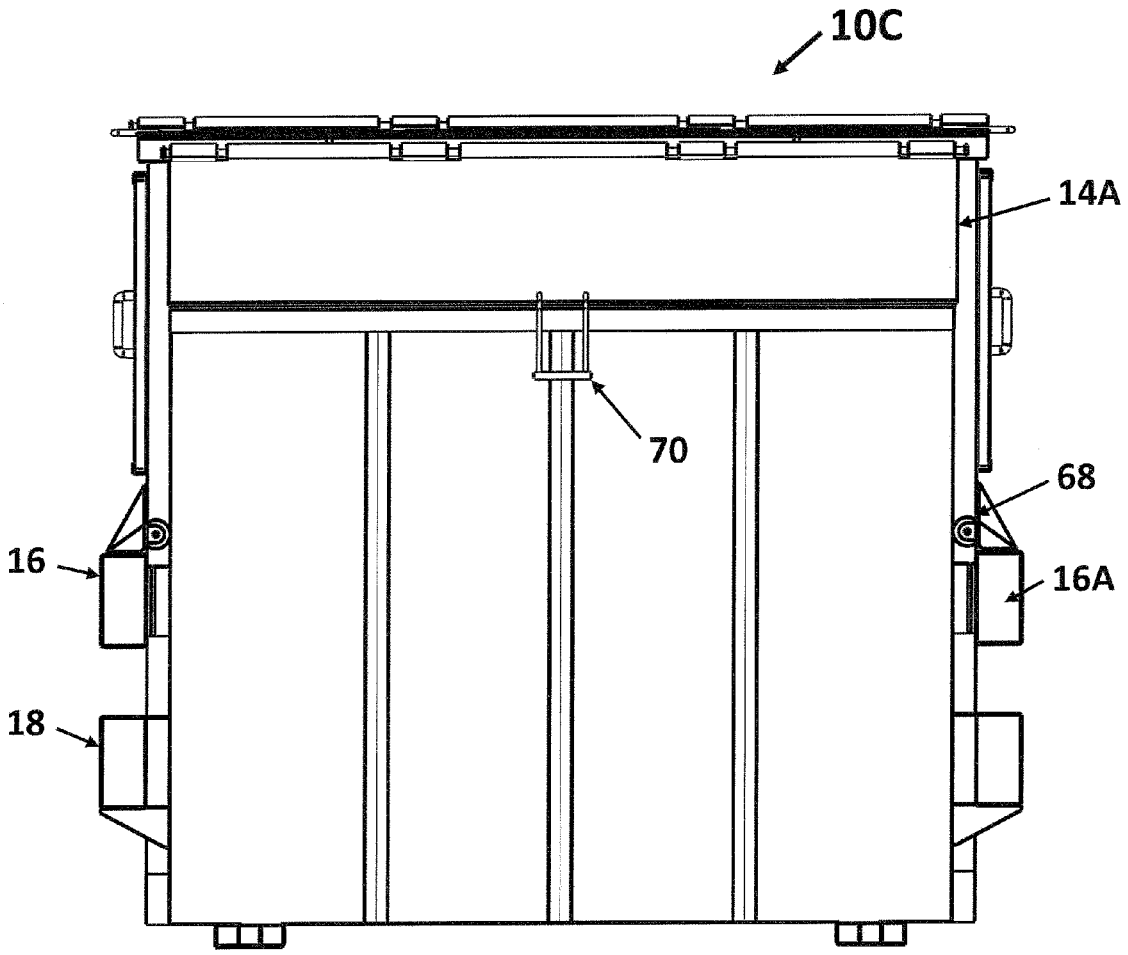
Figure 8A:
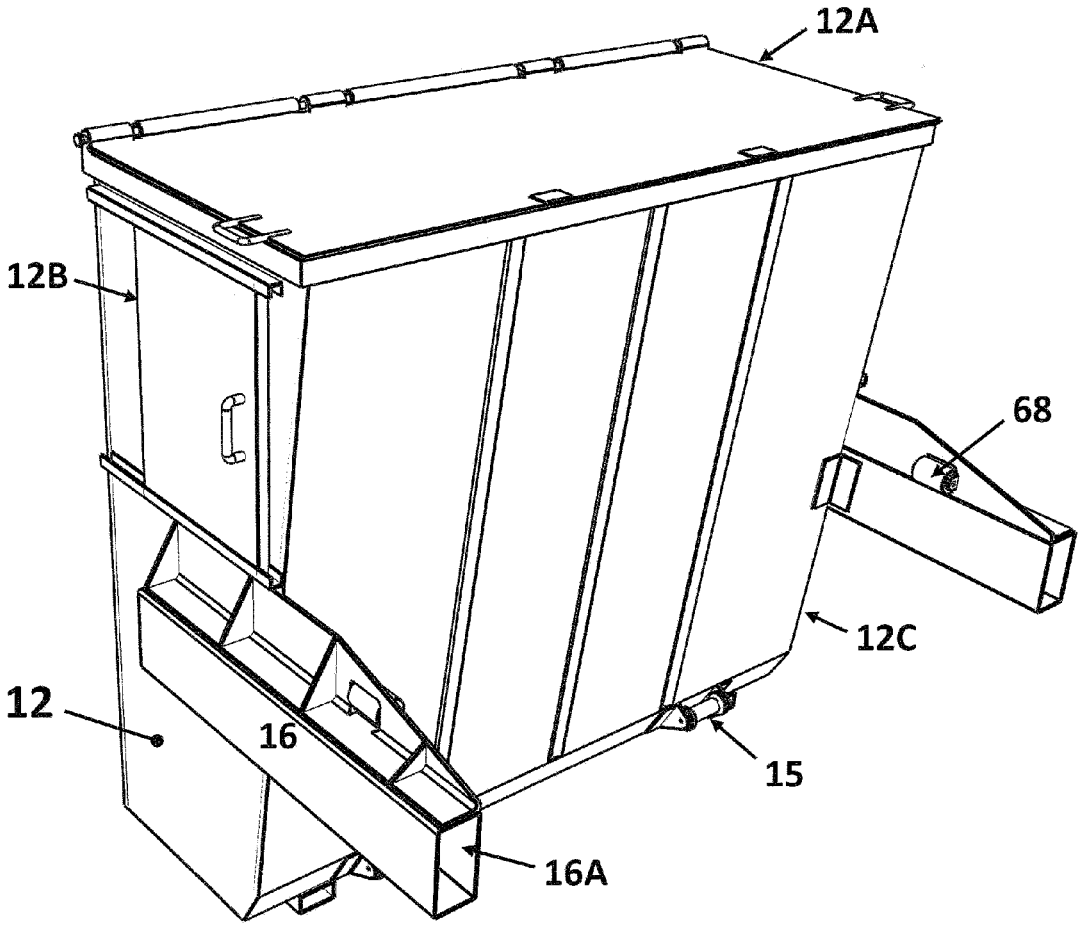
FIGS. 8A and 8B show various views of a first container of the device of FIGS. 7A-7C.
Figure 8B:
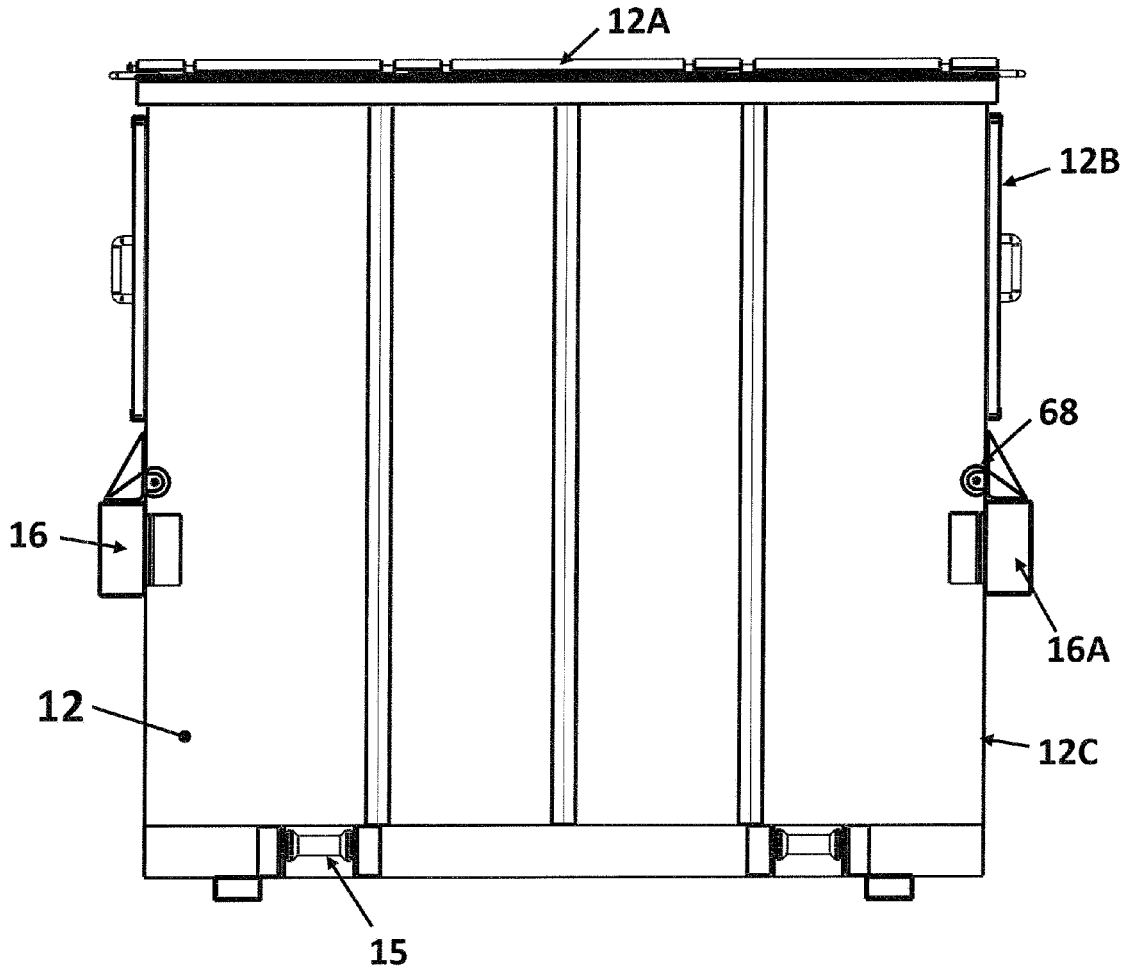
Figure 9A:
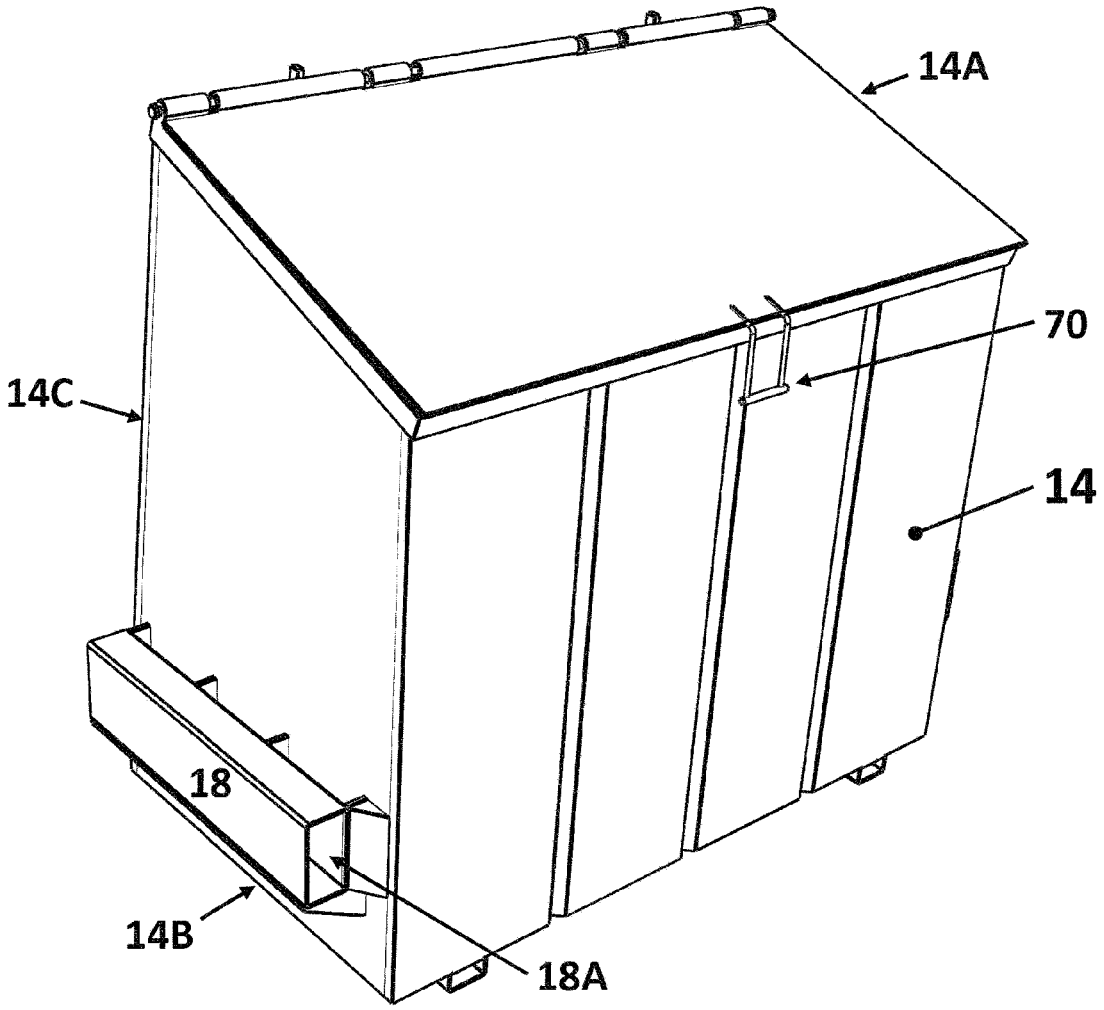
FIGS. 9A-9C show various views of a second container of the device of FIGS. 7A-7C.
Figure 9B:
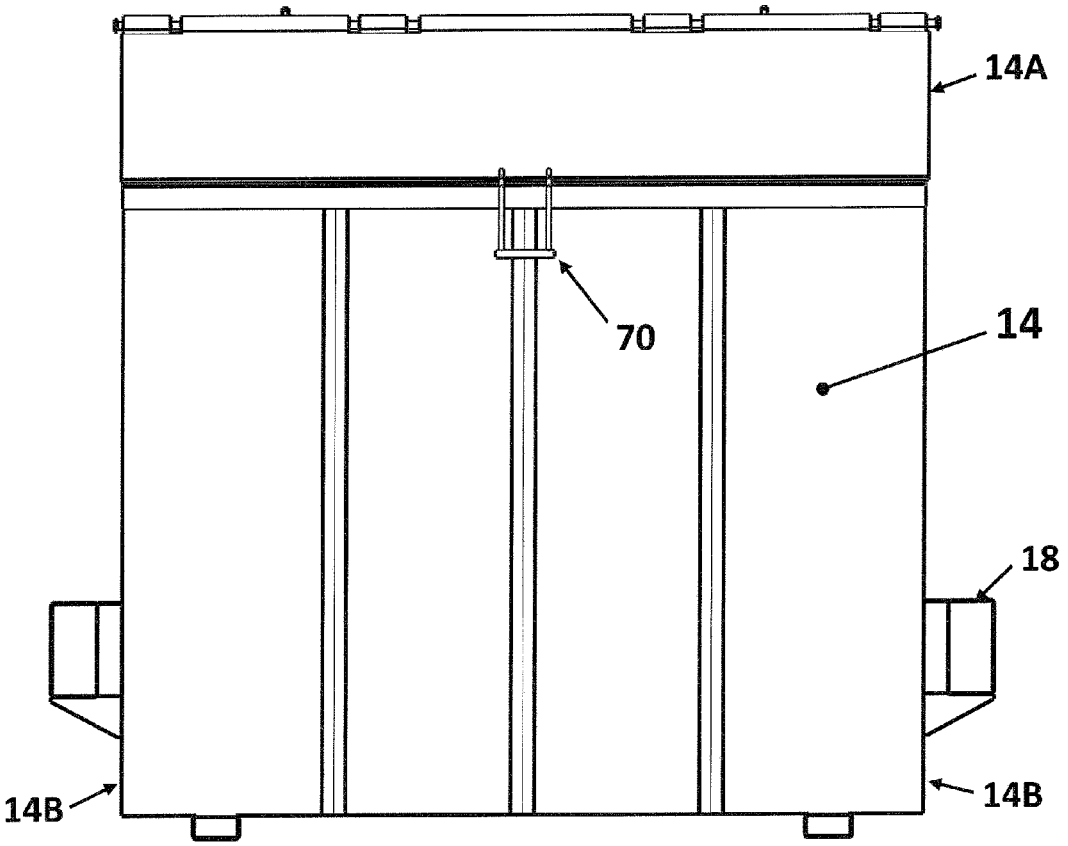
Figure 9C:
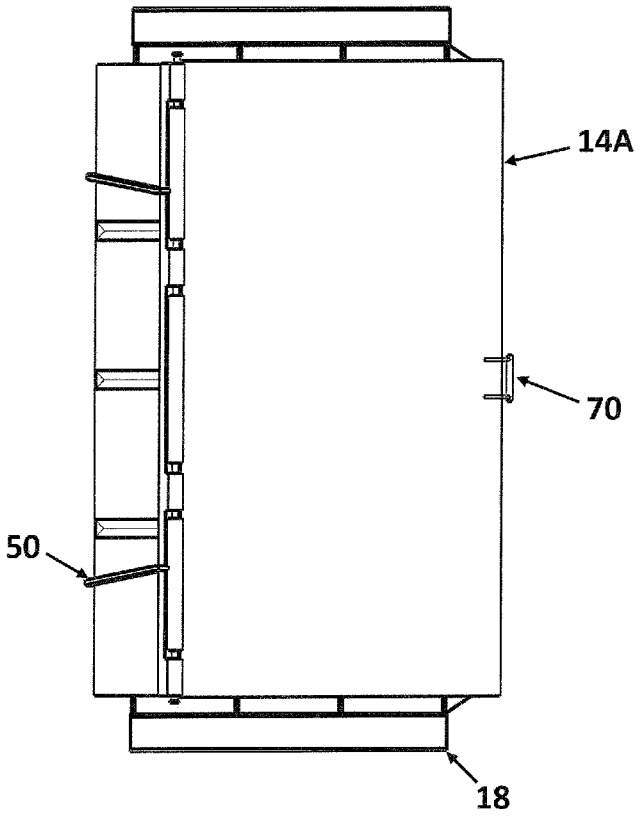

Referring to FIGS. 7A-9C, another embodiment of the device 10C is shown. More specifically, the waste collection device 10C is described below with reference to the various views presented in FIGS. 7A-9C. FIG. 7A shows an elevated perspective view of another embodiment of the device of the present disclosure. FIG. 7B shows a side view of the device 10C. FIG. 7C shows a front view of the device 10C. FIG. 8A shows an elevated perspective view of the first container of the device 10C. FIG. 8B shows a front view of the first container of the device 10C. FIG. 9A shows an elevated perspective view of the second container of the device 10C. FIG. 9B shows a front view of the second container of the device 10C. FIG. 9C shows a top view of the second container of the device 10C.

For device 10C, either container 12 or 14 can house recyclables or non-recyclables. The first container 12 and second container 14 are generally made out of a sturdy metallic material such as steel or the like. However, other materials can be used without departing from the spirit and scope of the present disclosure.

The first container 12 and second container 14 can comprise lids 12A and 14A. Side doors 12B can also be formed on the first container 12 and second container 14. In the some embodiments, side doors 12B can be formed only in tone container, such as the first container 12. However, side doors 12B can be formed on the first container 12, the second container 14, or both.

The first container 12 has an angled front surface 12C and the second container 14 has an angled rear surface 14C. The front surface 12C and the rear surface 14C are approximately parallel to one another. The angle of the front surface 12C and the rear surface 14C allow the first container 12 to more easily be raised and lifted away from the second container 14. The angle of the front surface 12C and the rear surface 14C further makes it easier to better align the first and second containers 12 and 14 so that there is a minimal gap between the front surface 12C and the rear surface 14C of the first and second containers 12 and 14.

The first container 12 can comprise a pair of sleeves 16. The pair of sleeves 16 is generally made out of the same material as the first and second containers 12 and 14. An individual sleeve of the pair of sleeve members 16 is attached to each side section of the first container 12. The pair of sleeves 16 can extend away from the first container 12. By extending the pair of sleeves 16 away from the first container 12, the pair of sleeves 16 forms a guide for the placement of the first container 12 with respect to the second container 14. The pair of sleeves 16 can comprise a hollow channeling 16A. The hollow channeling 16A allows for a standard fork lift-operated waste collection vehicle to insert the fork through the pair of sleeves 16 to raise and empty the first container 12. Note that the hollow channels need not fully encapsulate the forks or be of exact size and shape as shown in the embodiment to function in the manner shown. Any one skilled in the art would recognize, for instance, that the exterior side surfaces of the sleeves are not needed as the forks keep the container from moving side to side beyond the sleeves.

The second container 14 can comprise a pair of sleeves 18. The pair of sleeves 18 is generally made out of the same material as the first and second containers 12 and 14. An individual sleeve of the pair of sleeve members 18 is attached to each side section of the second container 14 and below the pair of sleeves 16 of the first container 12. The pair of sleeves 18 can comprise a hollow channeling 18A. The hollow channeling 18A allows for a standard fork lift-operated waste collection vehicle to insert the fork through the pair of sleeves 16 to raise and empty the second container 14. Note that while pairs of sleeves 16 and 18 are shown comprising hollow channeling 18A, hollow channeling 18A and pairs of sleeves 16 and 18 can also be formed with openings, slats, windows, voids, hoops, or rings, such that they do not fully encapsulate the forks once the forks are inserted within the sleeve. An amount of material used for pairs of sleeves 16 and 18, including sizing and spacing can be determined based on desirable strength requirements for lifting and emptying the first container 12 and the second container 14, as well as for ease of use in inserting forks within the sleeves. As such, pairs of sleeves 16 and 18, or any sleeve, can be formed comprising a generally rectangular shape that further comprises a square or rectangular cross-section, as shown in the figures, but can also comprise any geometric or cross-sectional shape. In some instances, sleeves can be formed of one or more planar two-dimensional surfaces, such as the top or top and bottom surfaces of hollow channeling 18A without comprising an exterior side surface. In such instances, the exterior side surfaces can be omitted in that the forks inserted within the sleeves and used to raise the containers are rigidly set at a fixed distance and will not contact the exterior side surfaces of hollow channeling 18A. Sleeves 18 can comprise any suitable length, and can extend partially or completely along a side of the container to which they are attached. As shown in FIGS. 7A-9C, the sleeves 18 can extend approximately a length of the side section 14B of the container.

In order to further aid the ability to raise, lift away and realign the first container 12 and the second container 14, one or more rollers 15 can be placed on the outer perimeter of the front surface 12C of the first container 12. The rollers 15 can prevent the front surface 12C of the first container 12 from damaging the rear surface 14C by allowing the first container 12 to roll on the second container 14 during emptying of the first container 12. The rollers 15 further act as a bumper when repositioning the second container 14 after emptying the second container 14.

In the present embodiment, rollers 68 are placed on the interior side of the sleeves 16. The rollers 68 are positioned on the section of the sleeves 16 that extend away from the first container 12. The rollers 68 are used to allow the first container 12 to more easily be lifted away from and realigned with the second container 14.

A handle 70 can be attached to the lid 14A of the second container 14. The handle 70 is used to raise the lid 14A to insert any refuse into the second container 14.

Figure 10A:
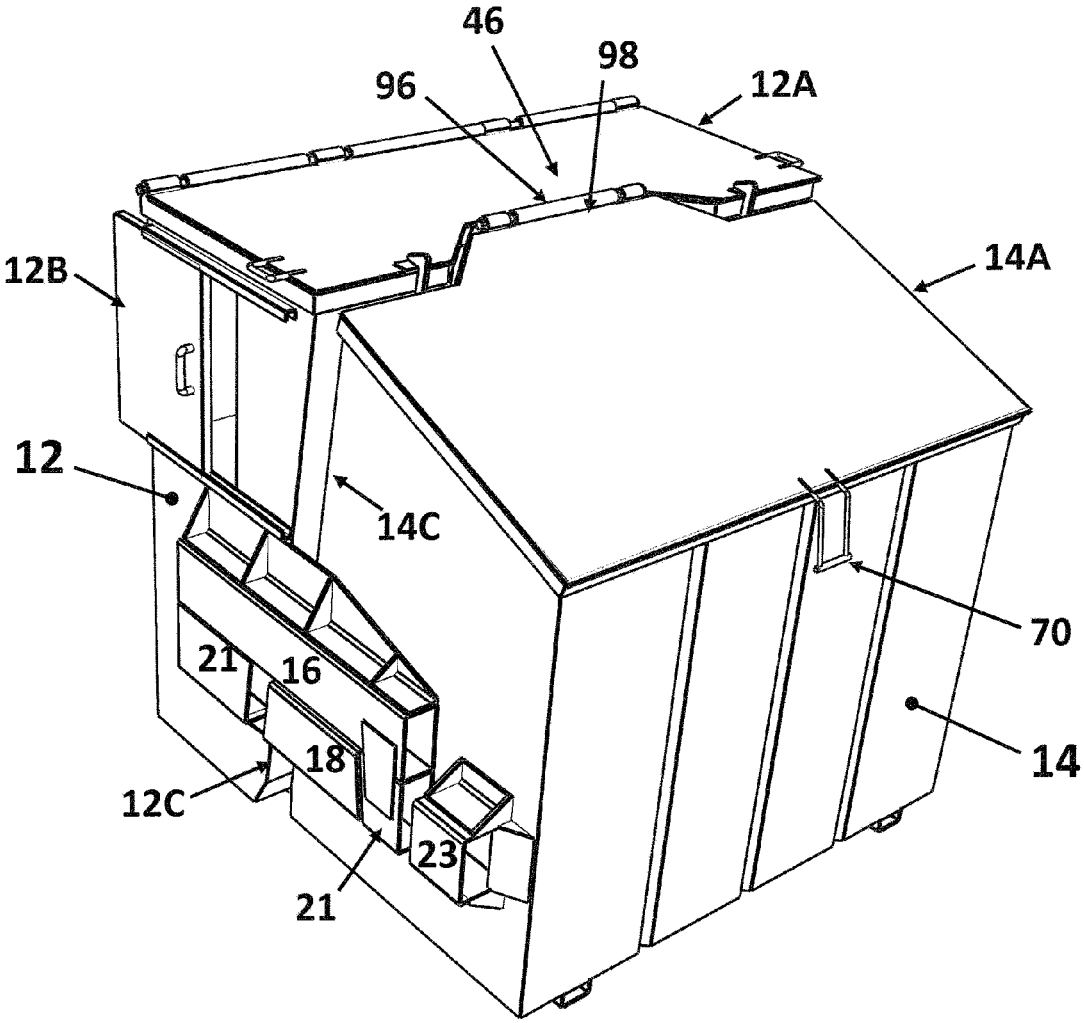
FIGS. 10A and 10B show various views of another embodiment of a dual waste collection device comprising an alignment mechanism.
Figure 10B:
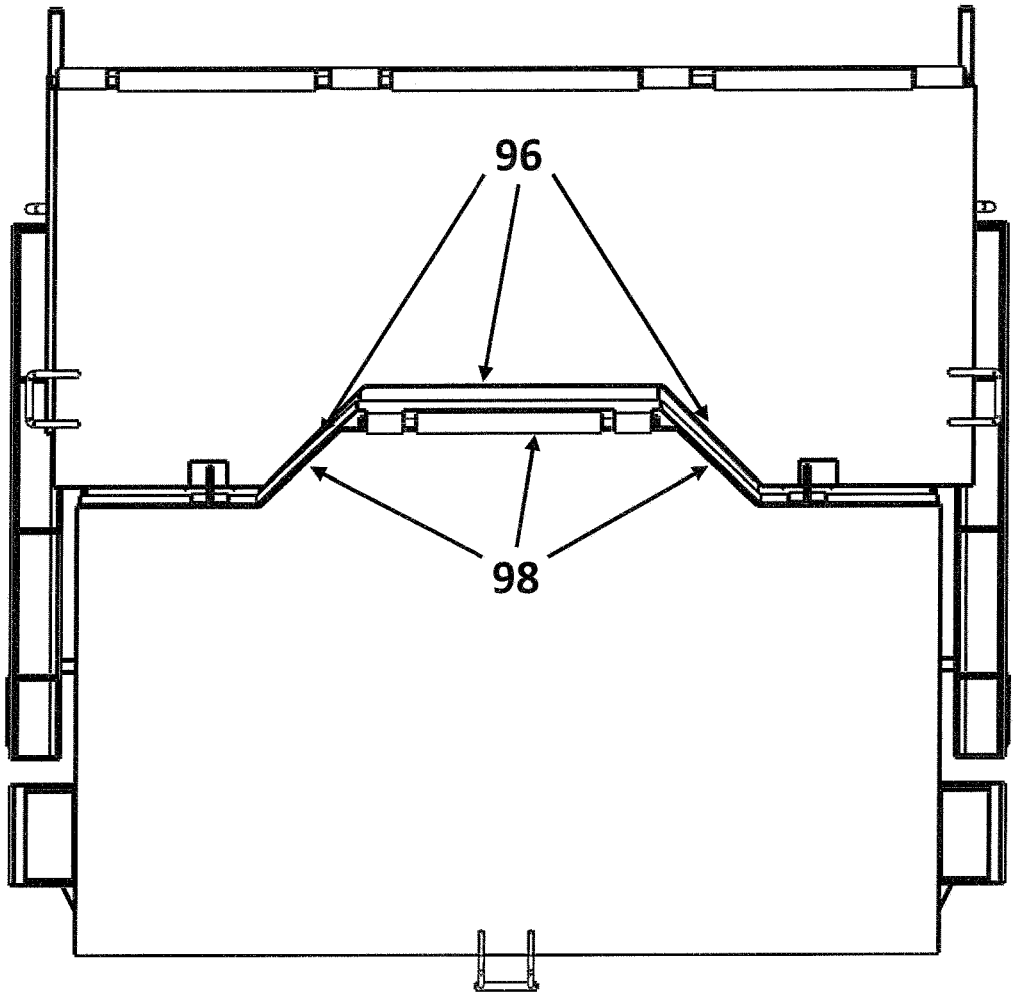

Referring now to FIGS. 10A-10B, another alternative embodiment of device 10A is shown that further comprises aligning mechanism 46. In the present embodiment, the aligning mechanism 46 takes the form of interlocking corrugated front and rear surfaces 12C and 14C respectively. FIG. 10A shows an elevated perspective view of the aligning mechanism 46, and FIG. 10B shows a top view of the aligning mechanism 46. As shown in FIGS. 10A-10B front and rear surfaces 12C and 14C can comprise corresponding notches 96 and tabs 98 which help to align the first and second containers 12 and 14.

Figure 11A:
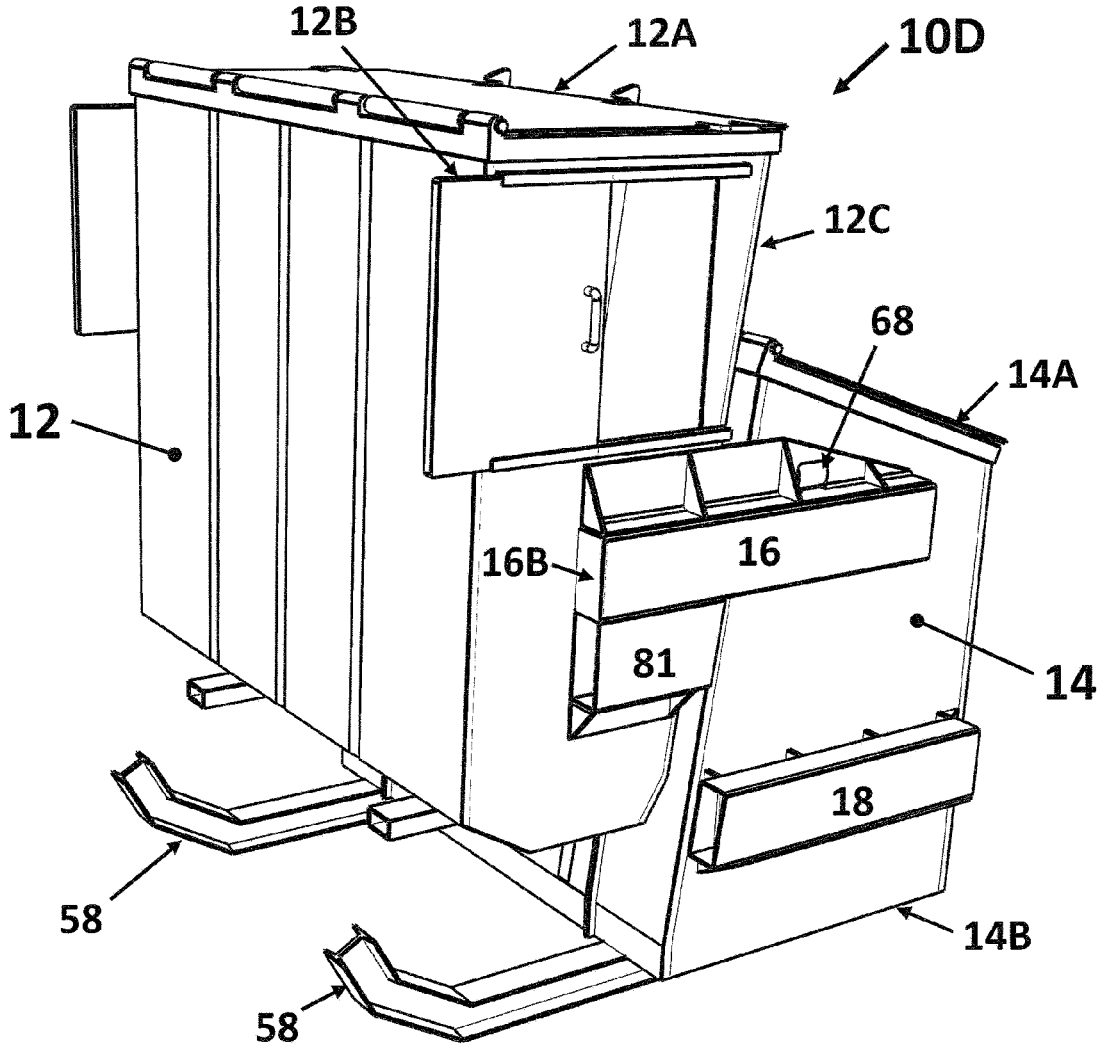
FIGS. 11A-11C show various views of another embodiment of a dual waste collection device comprising bottom rail alignment mechanisms.
Figure 11B:
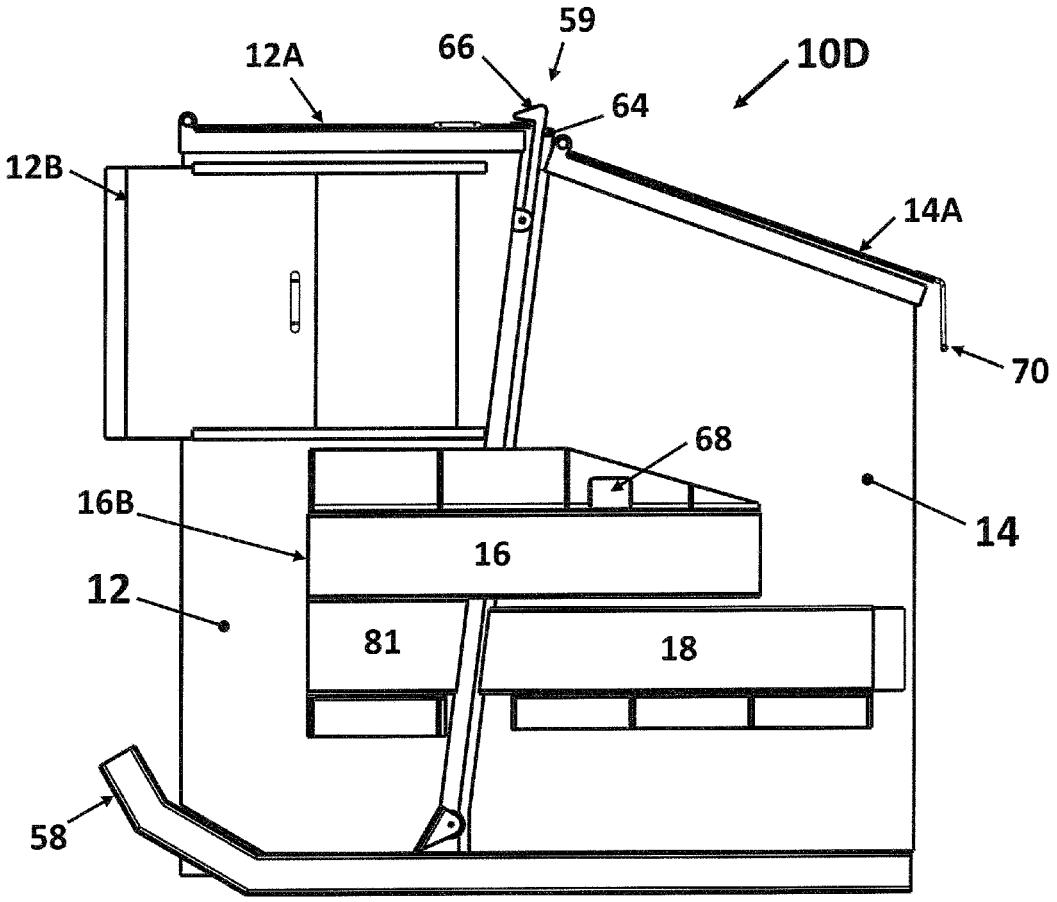
Figure 11C:
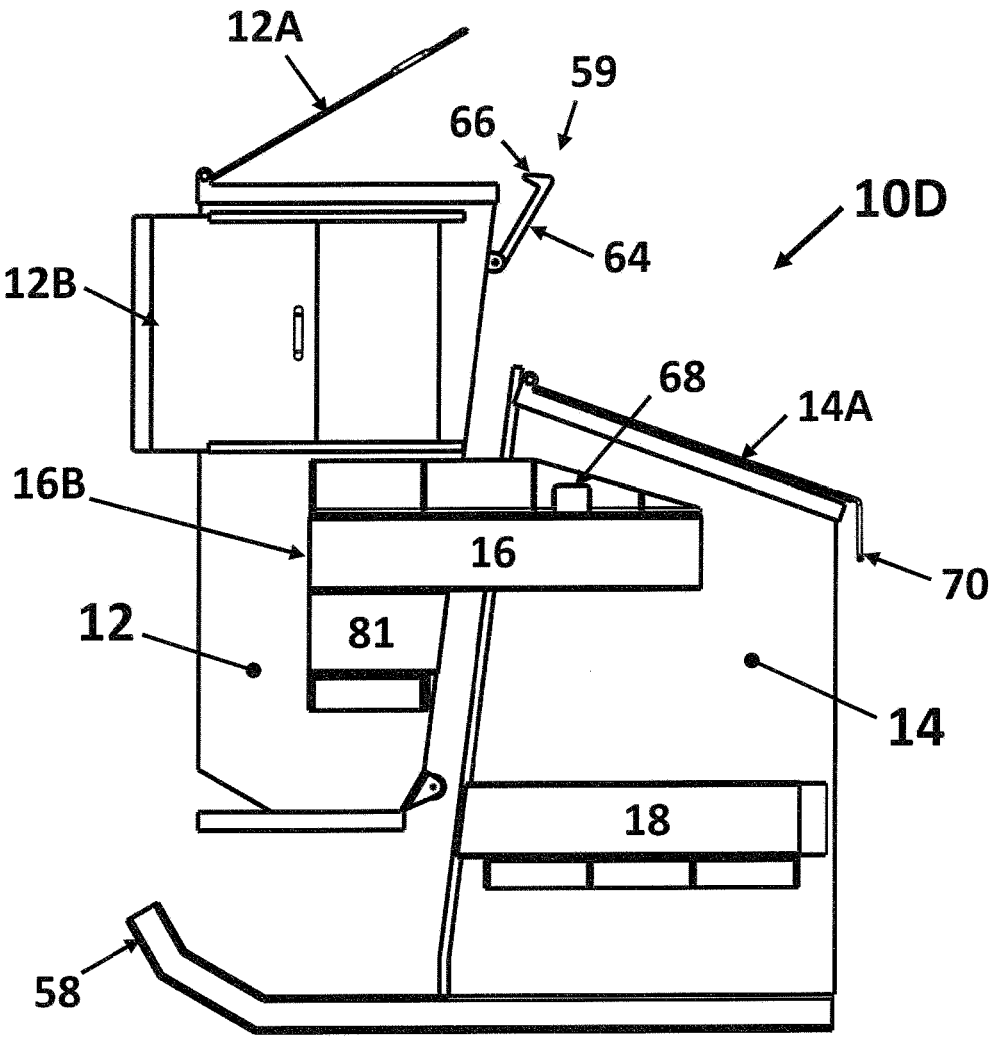

Referring to FIGS. 11A-11C, another embodiment of the device 10D is shown comprising a first container 12 and a second container 14. More specifically, the waste collection device 10C is described below with reference to the various views presented in FIGS. 11A-11C. FIG. 11A shows an elevated perspective view of a device 10D comprising an alignment mechanism of bottom rails. FIG. 11B shows a side view of the device 10D. FIG. 11C shows a side view of the device 10D with the first container raised. The first container 12 and second container 14 are generally made out of a sturdy metallic material such as steel or the like. However, other materials can be used without departing from the spirit and scope of the present disclosure.

The first container 12 and second container 14 can comprise lids 12A and 14A. Side doors 12B can also be formed on the first container 12 and second container 14. As a non-limiting example, FIGS. 11A and 11B show side doors 12B can be formed only in the first container 12. However, the side door 12B can also be formed on the first container 12, the second container 14, or both.

In the present embodiment, the first container 12 has an angled front surface 12C and the second container 14 has an angled rear surface 14C. The front surface 12C and the rear surface 14C are approximately parallel to one another. The angle of the front surface 12C and the rear surface 14C allow the first container 12 to more easily be raised and lifted away from the second container 14. The angle of the front surface 12C and the rear surface 14C further makes it easier to better align the first and second containers 12 and 14 so that there is a minimal gap between the front surface 12C and the rear surface 14C of the first and second containers 12 and 14.

The first container 12 can comprise a pair of sleeves 16. The pair of sleeves 16 is generally made out of the same material as the first and second containers 12 and 14. An individual sleeve of the pair of sleeve members 16 is attached to each side section of the first container 12. The pair of sleeves 16 can extend away from the first container 12. By extending the pair of sleeves 16 away from the first container 12, the pair of sleeves 16 forms a guide for the placement of the first container with respect to the second container 14. The pair of sleeves 16 can comprise a hollow channeling 16A. The hollow channeling 16A allows for a standard fork lift-operated waste collection vehicle to insert the fork through the pair of sleeves 16 to raise and empty the first container 12. Note that the hollow channels need not fully encapsulate the forks, as described above.

The second container 14 can comprise a pair of sleeves 18. The pair of sleeves 18 is generally made out of the same material as the first and second containers 12 and 14. An individual sleeve of the pair of sleeve members 18 is attached to each side section of the second container 14 and below the pair of sleeves 16 on the first container 12. The pair of sleeves 18 can comprise a hollow channeling 18A. The sleeves 18 generally run a length of the side section 14B.

Each sleeve 16 can comprise another sleeve 81 coupled to the underside of the sleeve 16. Below a first end of the sleeve 16 can be the sleeve 81. The sleeves 81 are in alignment with the second pair of sleeves 18 on the second container 14. The sleeve 81 is used in combination with sleeves 18 to simultaneous lift the two containers 12 and 14 without movement of the two containers 12 and 14 with respect to one another.

Since in this embodiment the device 10D enables simultaneous lifting of the two containers 12 and 14, device 10D can also include a locking device 59 to secure the lid 12A of the first container 12. This can allow the emptying of only second container 14 when simultaneous lifting of the two containers 12 and 14 for emptying. The first container 12 can still be lifted and emptied individually like in the previous embodiment.

In the present embodiment, the locking device 59 is a latch 64. The latch 64 is hingedly coupled to the front surface 12C of the first container 12. The latch 64 has a hook 66 which can engage the lid 12A to lock the lid 12A when the first container 12 and second container 14 are positioned together. When the first container 12 and second container 14 are lifted together, the second container 14 can press the latch 64, rotating it upwards and towards the front surface 12C and lid 12A, so that the hook 66 can engage and lock the lid 12A. Thus, the lid 12A can remain closed when both the first container 12 and second container 14 are lifted together. When the forks of a standard dump truck pass through the pair of sleeves 16 to lift just the first container 12 slightly above the second container 14, the angle of the front surface of the first container causes the latch 64 to fall forward so that the hook disengages the lid 12A. This unlocks the lid 12A thereby allowing the lid 12A to open when the first container 12 is emptied.

In the present embodiment, rollers 68 are placed on the interior side of the sleeves 16. The rollers 68 are positioned on the section of the sleeves 16 that extend away from the first container 12. The rollers 68 are used to allow the first container 12 to more easily be lifted away from and realigned with the second container 14.

The second container 14 can also comprise a pair of support members 58 attached to its bottom for placement of the first container 12 upon during its resting position. The support members 58 are angled upwardly away from the second container 14 thereby providing an additional mechanism for aligning the first and second containers 12 and 14 and for preventing movement of the two containers 12 and 14 with respect to one another during simultaneous lifting of the two containers 12 and 14.

Figure 12A:
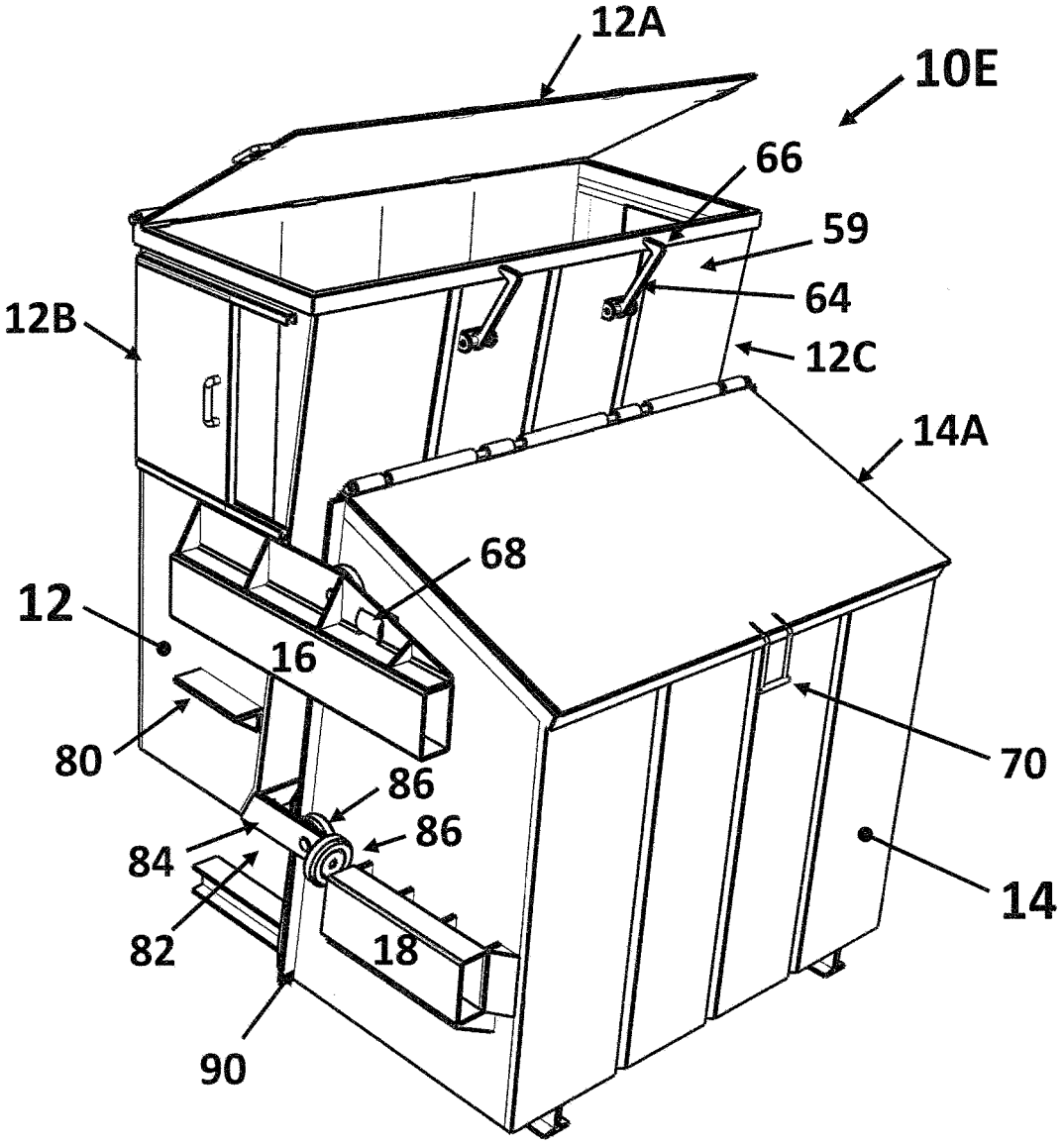
FIGS. 12A and 12B show various views of another embodiment of a dual waste collection device comprising a side rail alignment mechanism.
Figure 12B:
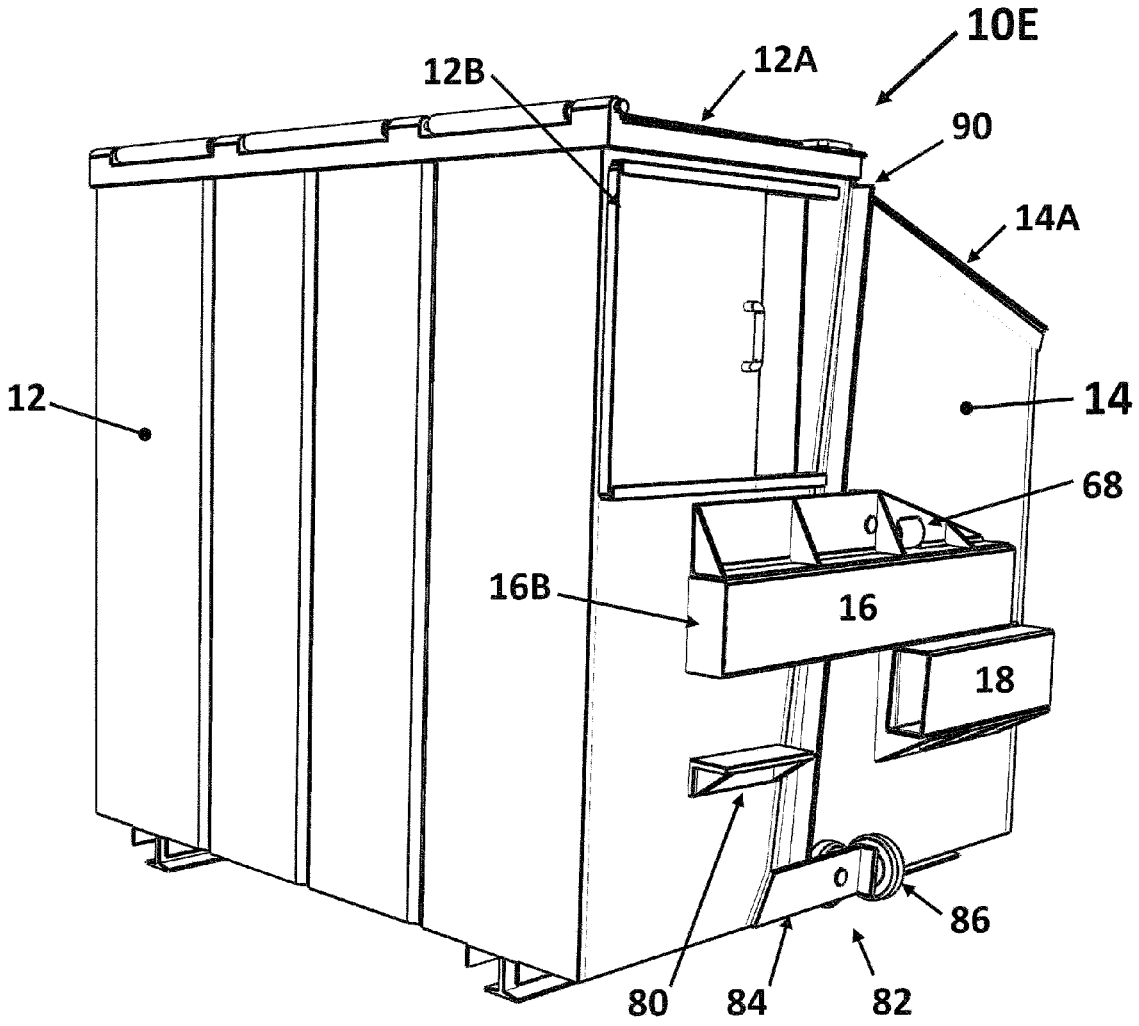
Figure 13:
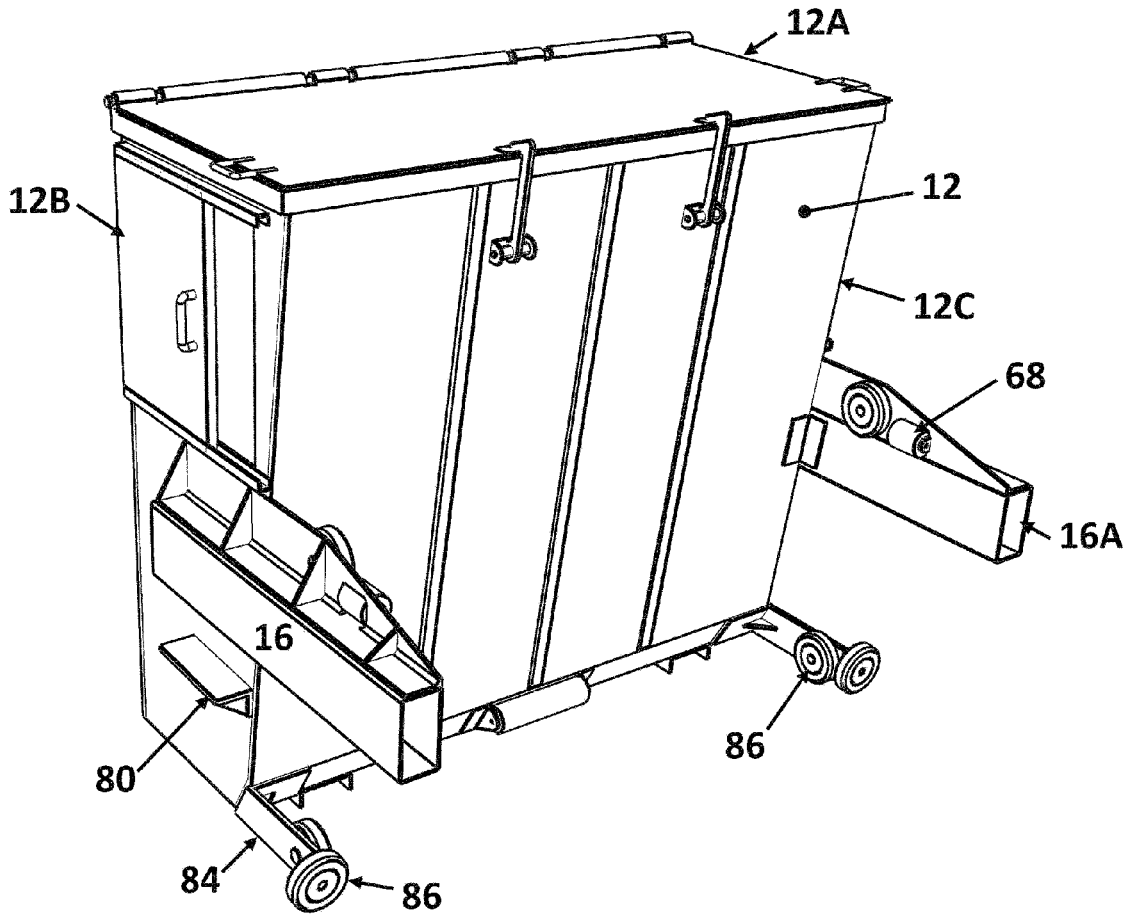
FIG. 13 shows a first container of the device of FIGS. 12A and 12B.
Figure 14:
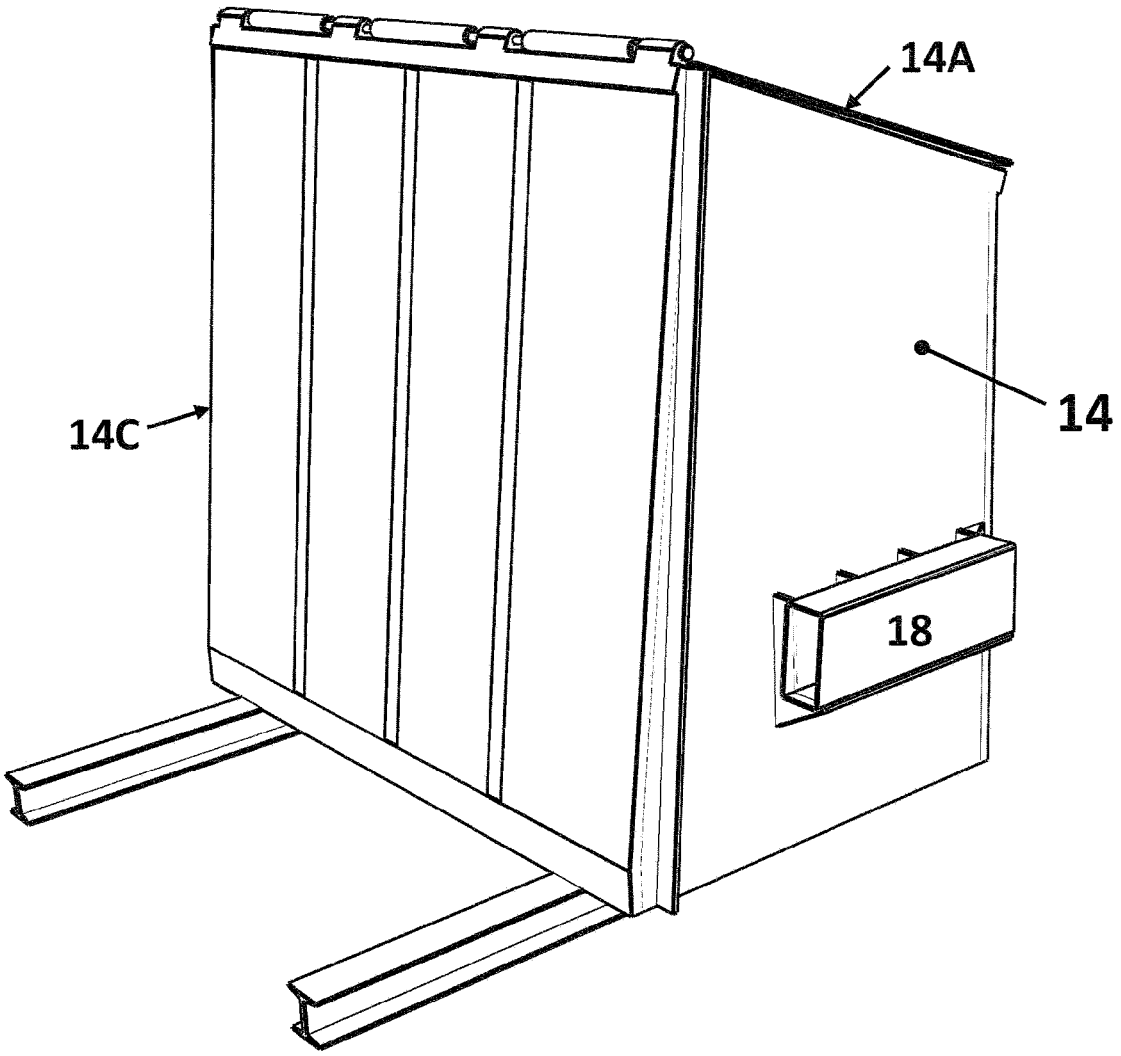
FIG. 14 is shows a second container of the device of FIGS. 12A and 12B.

Referring now to FIGS. 12A-14, another embodiment of the device 10E is disclosed. More specifically, the waste collection device 10E is described below with reference to the various views presented in FIGS. 12A-14. FIG. 12A shows an elevated perspective view of device 10E comprising an alignment mechanism of side rails. FIG. 12B shows another elevated perspective view of device 10E. FIG. 13 shows an elevated perspective view of the first container of the device 10E. FIG. 14 shows an elevated perspective view of the second container of the device 10E.

The device 10E still has a first container 12 and a second container 14. The first container 12 can be capable of being lifted individually from the second container 14 while also being capable of being lifted simultaneously with the second container 14.

The first container 12 can comprise a pair of sleeves 16 positioned in a like manner as in the previous embodiment. The pair of sleeves 16 enables lifting of the first container 12 by itself. The second container can still comprise a pair of sleeves 18 positioned in like manner as in the previous embodiment.

In the present embodiment, the first container 12 can also comprise a pair of locking plates 80. The locking plates 80 are attached to the side surfaces of the first container 12 and aligned with a bottom surface of the sleeves 18. The locking plates 80 keep the first container 12 from sliding up off of the second container 14 when both the first and second containers are lifted. When the forks of a standard dump truck pass through the sleeves 18, the bottom of the forks can engage the locking plates 80 preventing the first container 12 from sliding up off of the second container 14 when both the first and second containers are lifted.

Since in this embodiment the device 10E enables simultaneous lifting of the two containers 12 and 14, device 10E can also include a locking device 59 to secure the lid 12A of the first container 12. This can allow the emptying of only first container 12 when simultaneous lifting of the two containers 12 and 14 for emptying.

In this embodiment, a roller assembly 82 is attached to bottom corners of the front surface 12A of the first container 12. The roller assembly 82 has a pair of plate members 84 attached to the bottom corners of the first surface 12A. A set of rollers 86 is attached to the plate members 84. When the first container 12 is lowered into its resting position in proximity to the second container 14, the rollers 86 engage guide rails 90 and the side surfaces of the second container 14 thereby bringing the first container 12 in alignment with the second container 14.

Rollers 68 are placed on the interior side of the sleeves 16. The rollers 68 are positioned on the section of the sleeves 16 that extend away from the first container 12. The rollers 68 are used to allow the first container 12 to more easily be lifted away from and realigned with the second container 14.

Figure 15A:
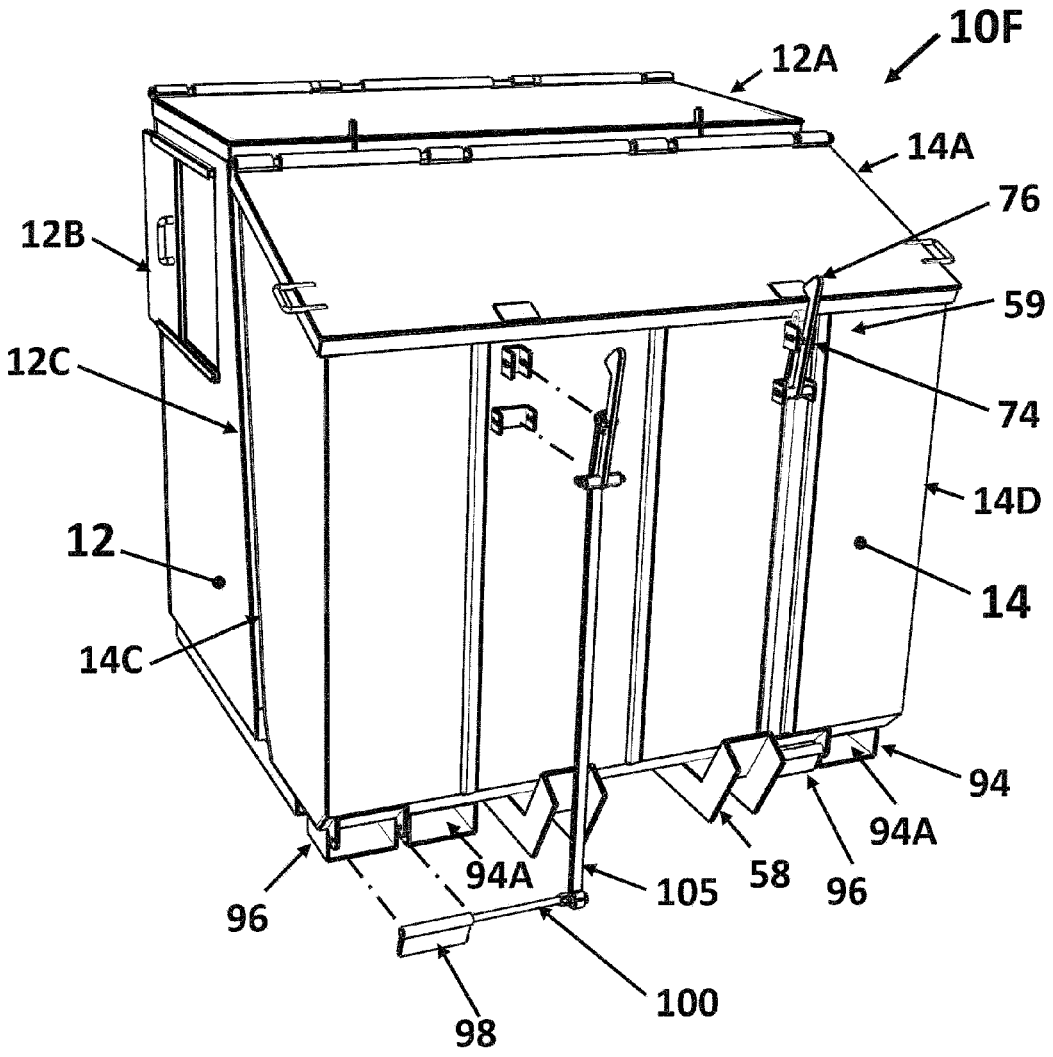
FIGS. 15A-15D show various views of another embodiment of a dual waste collection device comprising bottom sleeves.
Figure 15B:
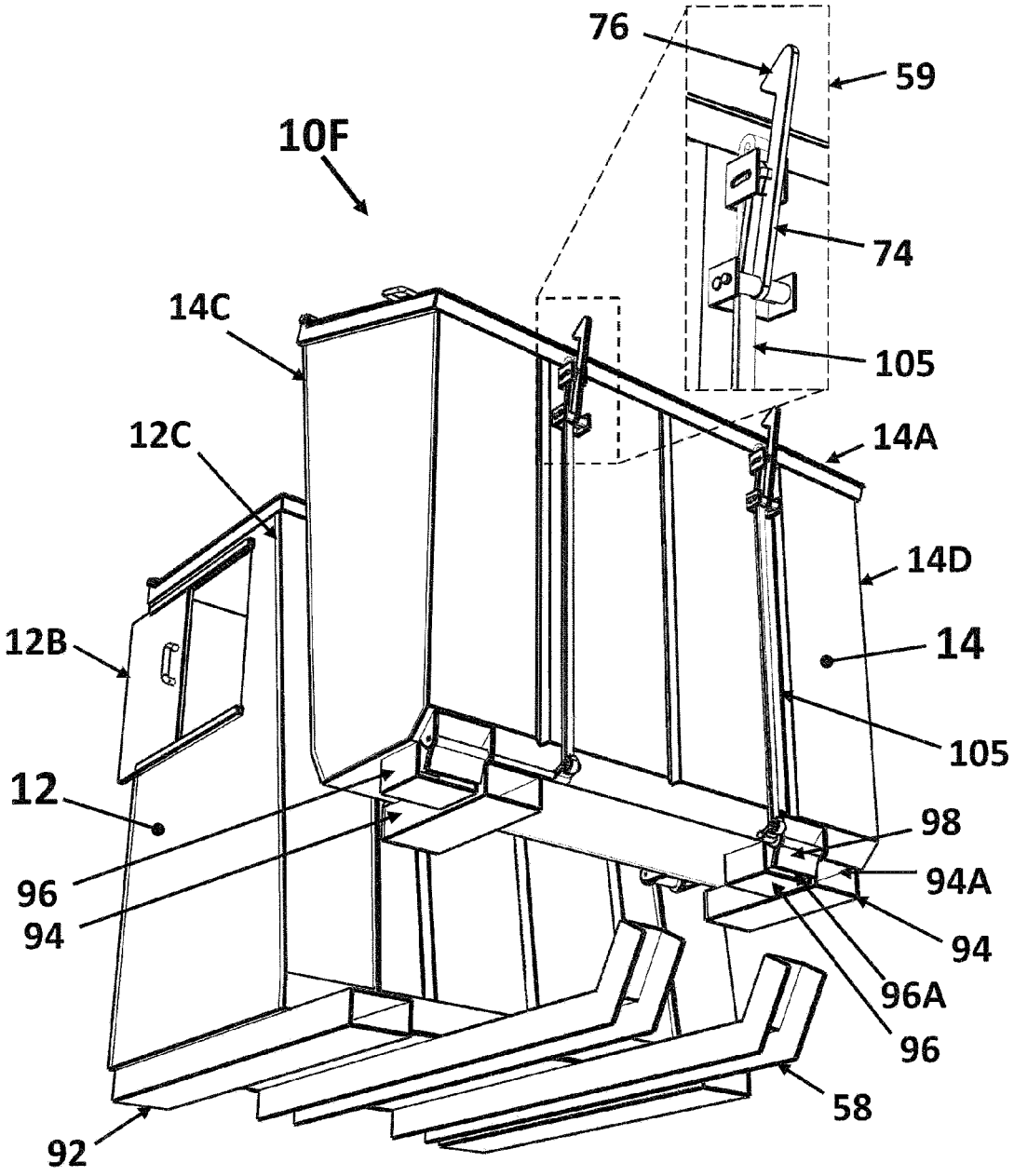
Figure 15C:
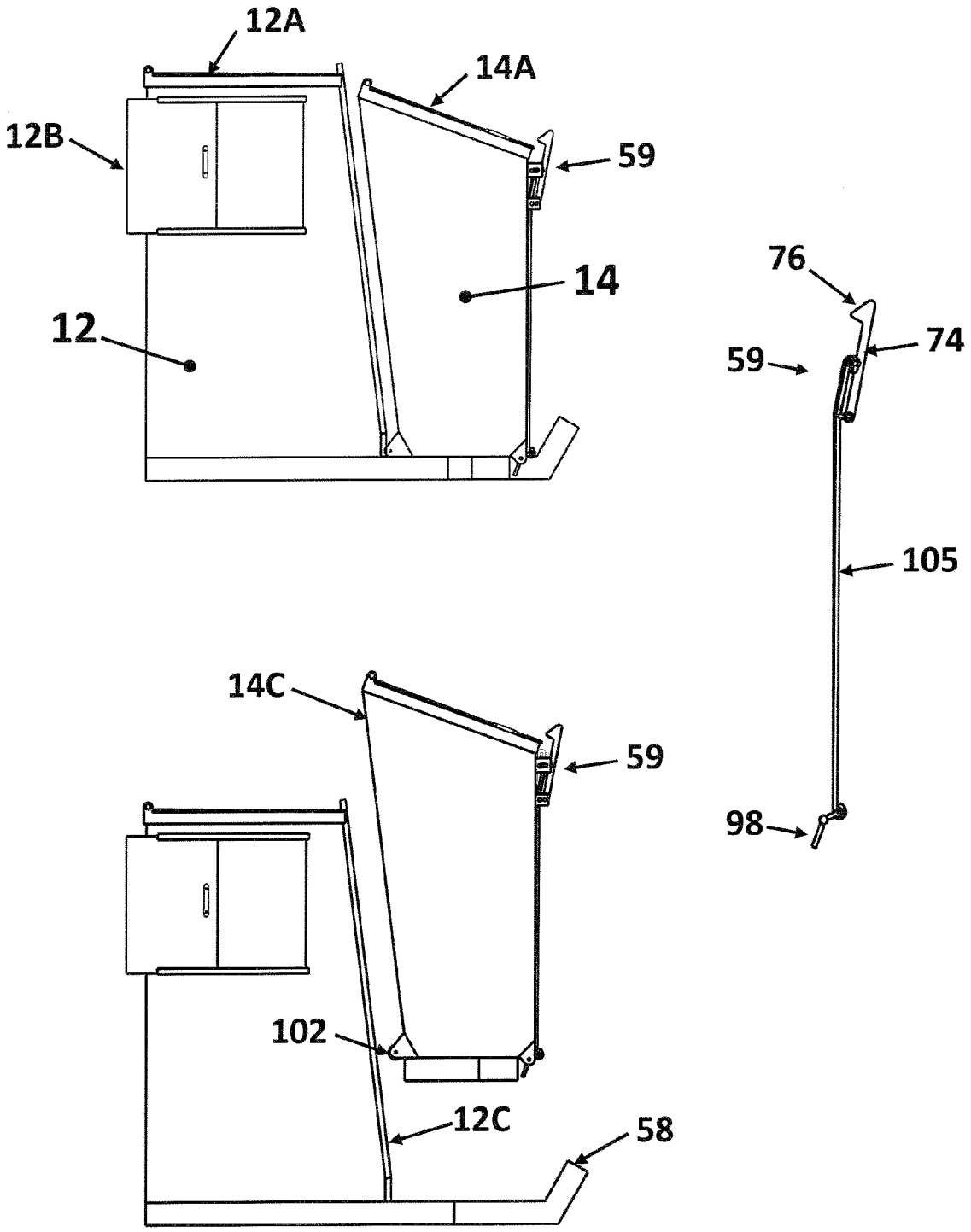
Figure 15D:
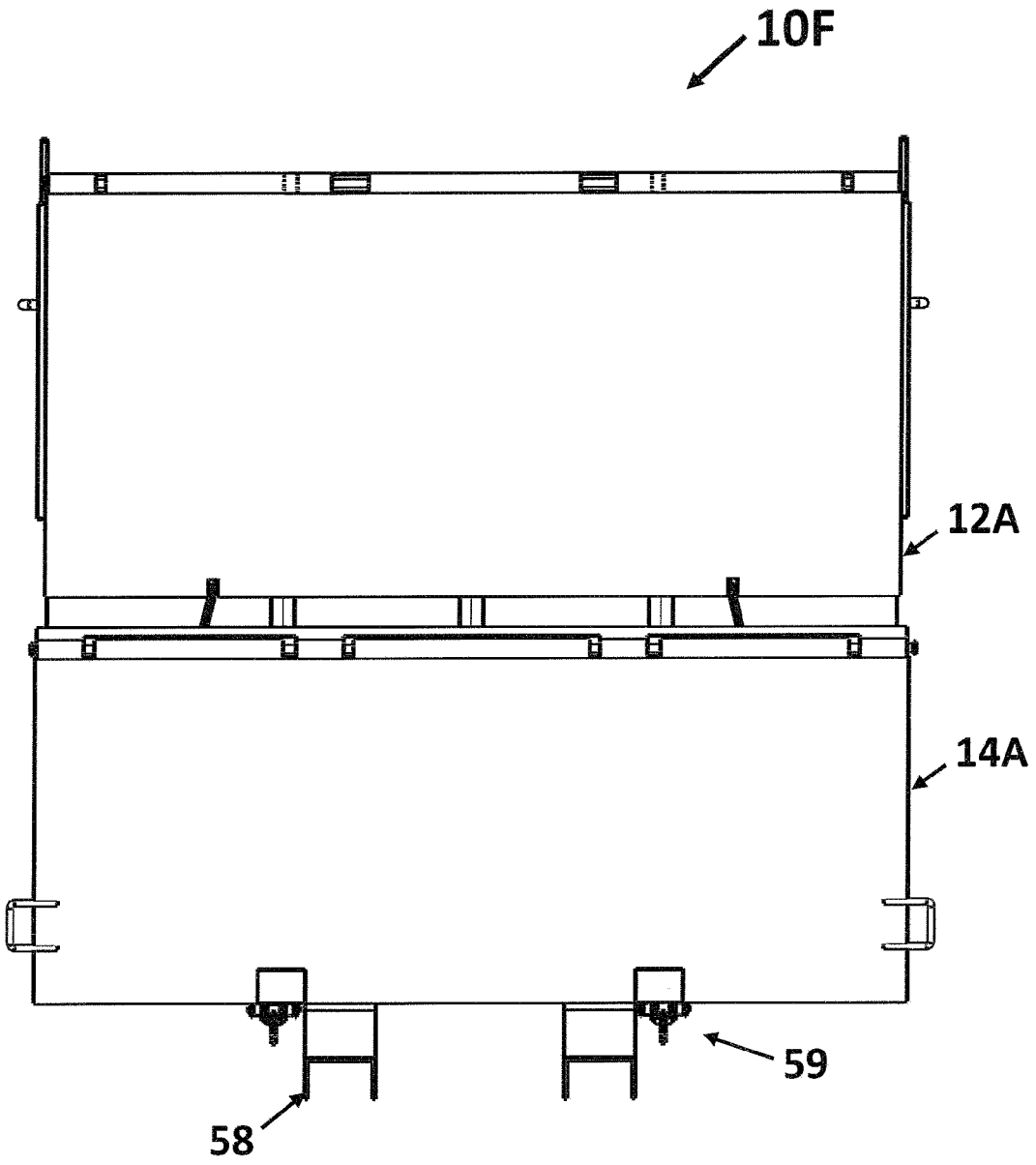
Figure 16A:
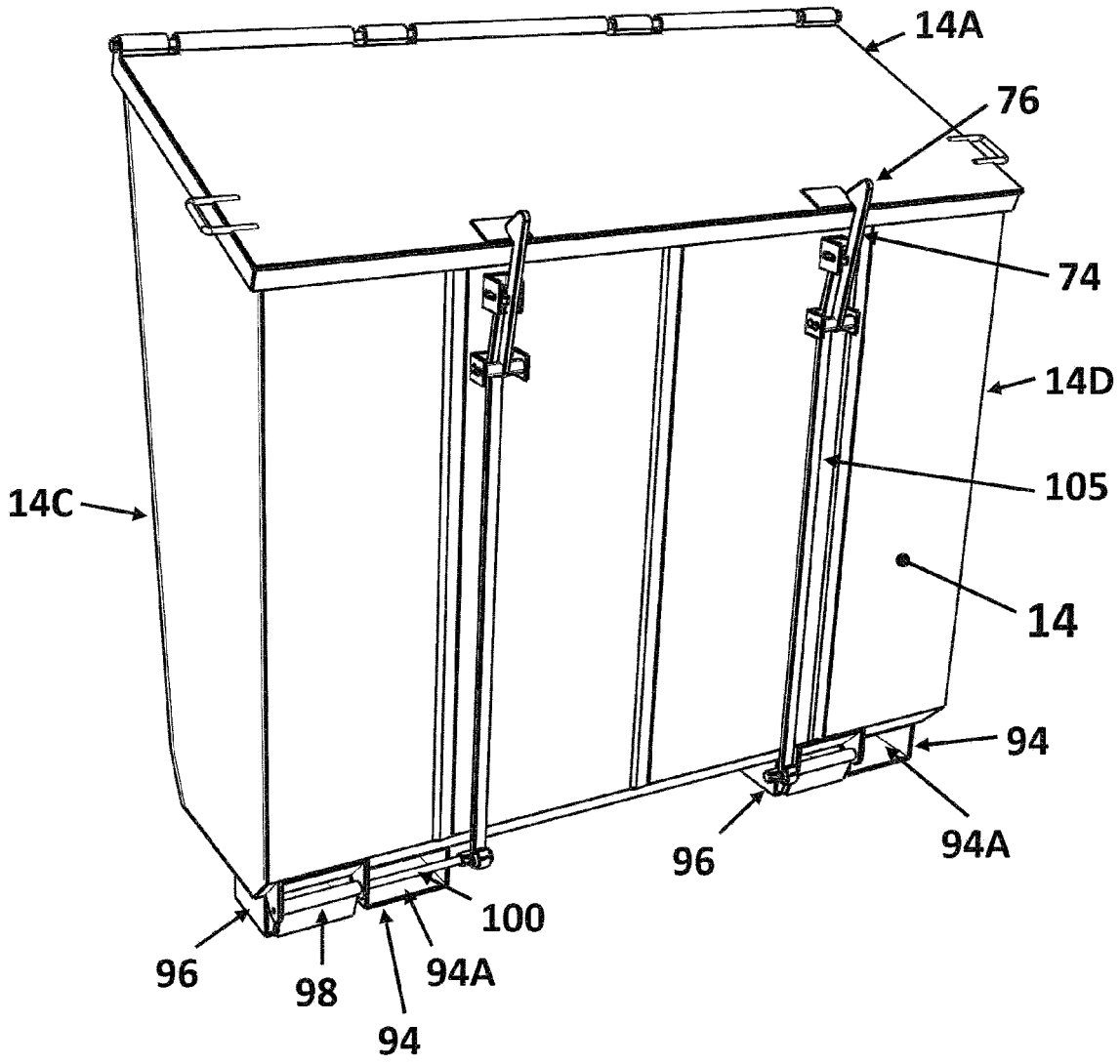
FIGS. 16A and 16B show views of a second container of the device of FIGS. 15A-15D.
Figure 16B:
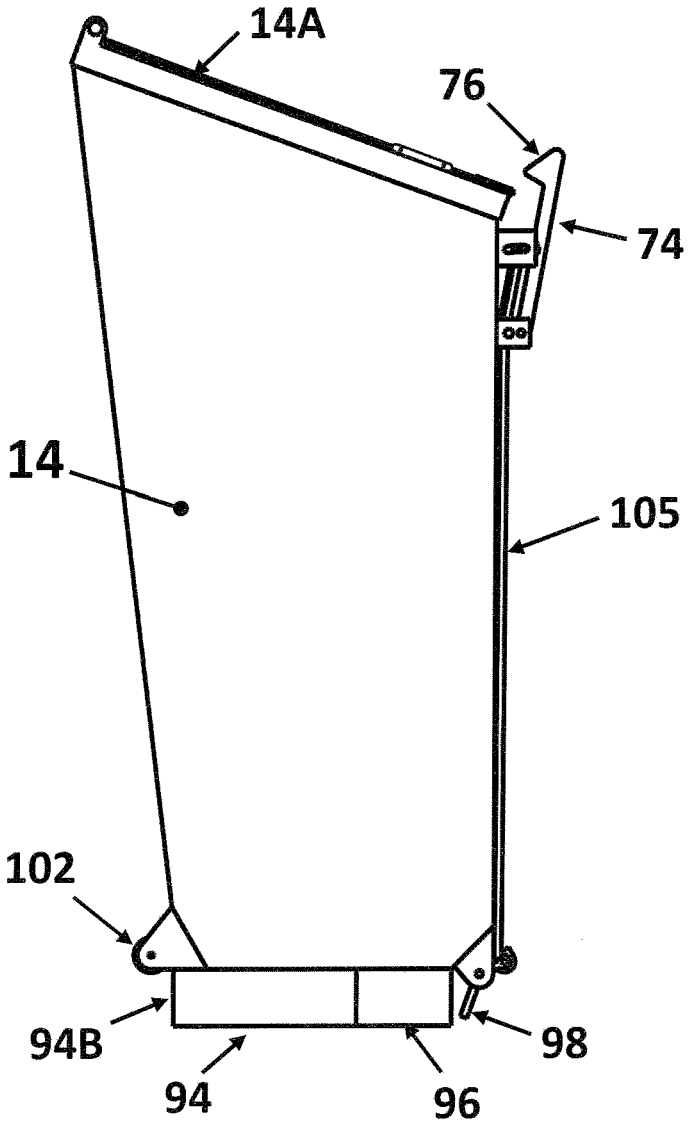
Figure 17A:
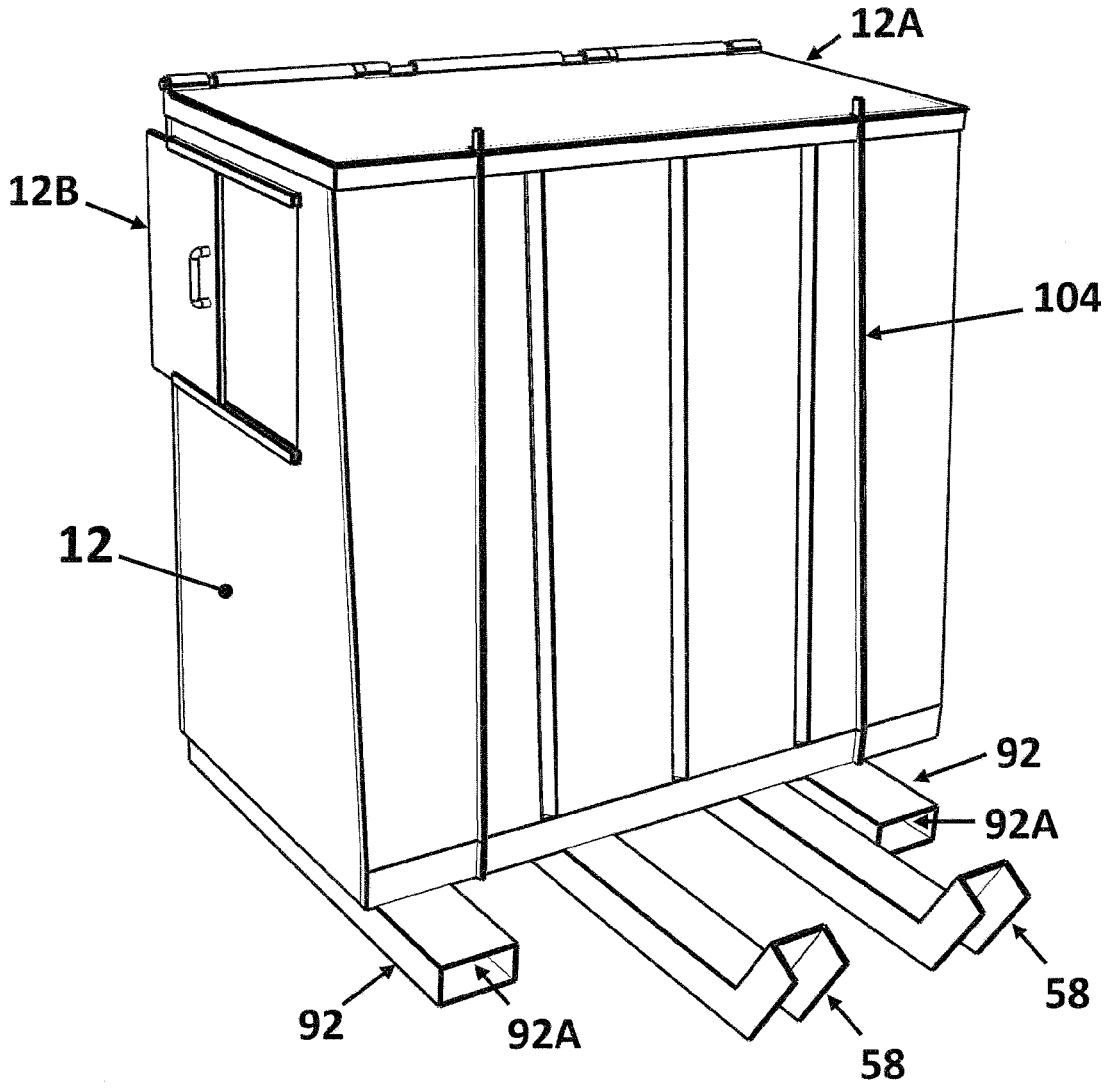
FIGS. 17A and 17B show views of a first container of the device of FIGS. 15A-15D.
Figure 17B:
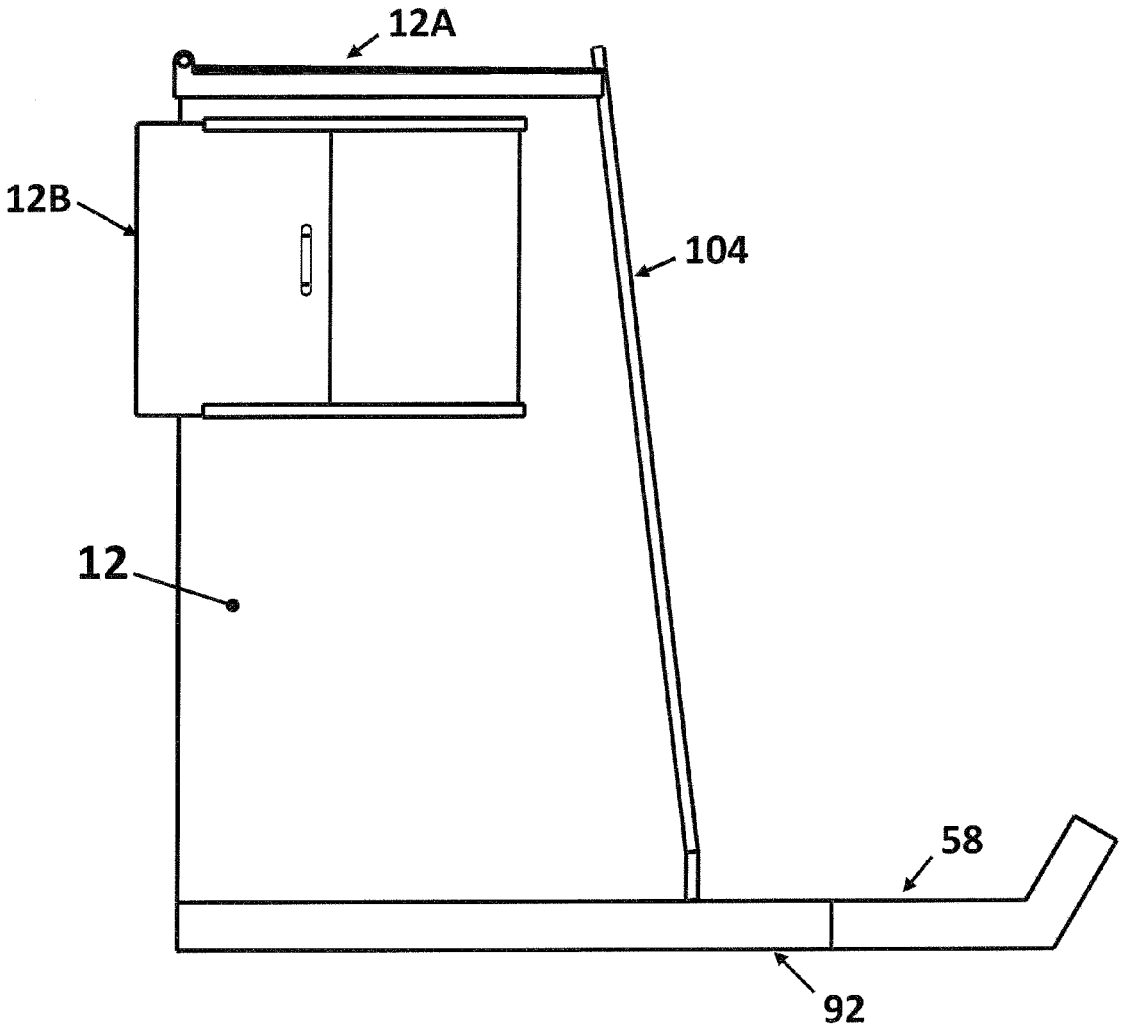

Referring to FIGS. 15A-17B, another embodiment of the device 10F is shown, in which the device 10F is configured to be lifted from the bottom. More specifically, the waste collection device 10F is described below with reference to the various views presented in FIGS. 15A-17B. FIG. 15A shows a perspective view of another embodiment of the device 10F. FIG. 15B shows a bottom perspective view of the device 10F with the second container raised. FIG. 15C shows a side view of the device 10F showing the second container in a lowered position and in a raised position and lid locking mechanism. FIG. 15D shows a top view of the device 10F. FIG. 16A shows a perspective view of the second container of the device 10F. FIG. 16B shows a side view of the second container of the device 10F. FIG. 17A shows a perspective view of the first container of the device 10F. FIG. 17B shows a side view of the first container of the device 10F.

The device 10F has a first container 12 and a second container 14. The first container 12 and second container 14 are generally made out of a sturdy metallic material such as steel or the like. However, other materials can be used without departing from the spirit and scope of the present disclosure.

The first container 12 and second container 14 can comprise lids 12A and 14A. Side doors 12B can also be formed on the first container 12 and second container 14. In the present embodiment, side doors 12B are only formed in the first container 12. However, side doors 12B can be formed on the first container 12, the second container 14, or both.

In the present embodiment, the first container 12 has an angled front surface 12C and the second container 14 has an angled rear surface 14C. The front surface 12C and the rear surface 14C are approximately parallel to one another. The angle of the front surface 12C and the rear surface 14C allow the second container 14 to more easily be raised and lifted away from the first container 12. The angle of the front surface 12C and the rear surface 14C further makes it easier to better align the first and second containers 12 and 14 so that there is a minimal gap between the front surface 12C and the rear surface 14C of the first and second containers 12 and 14.

The first container 12 can comprise a pair of sleeves 92. The pair of sleeves 92 is generally made out of the same material as the first and second containers 12 and 14. An individual sleeve of the pair of sleeve members 92 is attached to an outer edge on a bottom surface of the first container 12. The pair of sleeves 92 can extend away from the first container 12. The pair of sleeves 92 can comprise a hollow channeling 92A. The hollow channeling 92A allows for existing fork lift-operated waste collection vehicle to insert the fork through the pair of sleeves 92.

The second container 14 can comprise a pair of sleeves 96. The pair of sleeves 96 is generally made out of the same material as the first and second containers 12 and 14. An individual sleeve of the pair of sleeve members 96 is attached to an outer edge on a bottom surface of the second container 14. The pair of sleeves 96 can comprise a hollow channeling 96A. The sleeves 92 of the first container 12 are in alignment with the sleeves 96 on the second container 14 when the first container 12 and second container 14 are properly aligned. The sleeve 92 is used in combination with sleeves 96 to simultaneous lift the two containers 12 and 14 without movement of the two containers 12 and 14 with respect to one another.

The second container 14 can comprise a pair of sleeves 94. The pair of sleeves 94 is generally made out of the same material as the first and second containers 12 and 14. An individual sleeve of the pair of sleeve members 94 is attached to the bottom surface of the second container 14 and next to a sleeve 96. In the present embodiment, the pair of sleeve members 94 is positioned on the bottom surface of the second container 14 and adjacent to and inwardly from the sleeves 96. The pair of sleeves 94 can comprise a hollow channeling 94A. The length of each of the pair of sleeves 94 generally does not exceed the length of the second container 14. An end cap 94B is generally placed at the end of each sleeve 94. The sleeves 94 are used to lift the second container 14 up and away from the first container 12 to individually empty the second container 14.

Since in this embodiment the device 10F enables simultaneous lifting of the two containers 12 and 14, device 10F can also include a locking device 59 to secure the lid 14A of the second container 14. This can allow the emptying of only first container 12 when simultaneous lifting of the two containers 12 and 14 for emptying. The second container 14 can still be lifted and emptied individually like in the previous embodiment.

In the present embodiment, the locking mechanism 59 has one or more rod members 74 hingedly coupled to a top area of the front surface 14D of the second container 14. On one end of each rod member 74 is a hook 76. The hook 76 engages the lid 14A when the rod member 74 is in a first position thereby locking the lid 14. When the rod member 74 is placed in a second position, the hook 76 disengages from the lid 14A allowing one to lift the lid 14A.

Attached to a second end of the rod member 74 is a plate 98. The plate 98 is positioned in front of the sleeves 96. When the forks of the dump truck push the plate 98, it rotates upwards. A linkage 105 (rod, chain, belt, etc.) is attached to the shaft of the plate 98. When the plate rotates upwards, it pulls the linkage 105, which in turn, pulls the hook closed, locking the lid 14A of the second container 14.

When emptying just the second container 14, the truck forks slide into the sleeves 94. The locking mechanism 59 can be un-engaged so the lid 14A is free to swing open when emptied. The sleeves 94 comprise end caps 94B on the back side so that the forks cannot protrude out the back of the second container 14 and so that the second container 14 does not slide down the forks as it is being emptied. Without this feature, the second container 14 would slide down the forks and the forks would hit the first container 12 when the second container 14 was lowered back into place.

The first container 12 can also comprise a pair of support members 58 attached to its bottom for placement of the second container 14 upon during its resting position. The support members 58 are angled upwardly away from the second container 14 thereby providing an additional mechanism for aligning the first and second containers 12 and 14 and for preventing movement of the two containers 12 and 14 with respect to one another during simultaneous lifting of the two containers 12 and 14.

In the present embodiment, a set of rollers 102 can be coupled to a rear surface 14C of the second container 14. The rollers 102 are used to help lift the second container 14 up and away from the first container 12. The rollers 102 can be used with guide rails 104 to properly align the first and second containers 12 and 14 respectively.

Figure 18A:
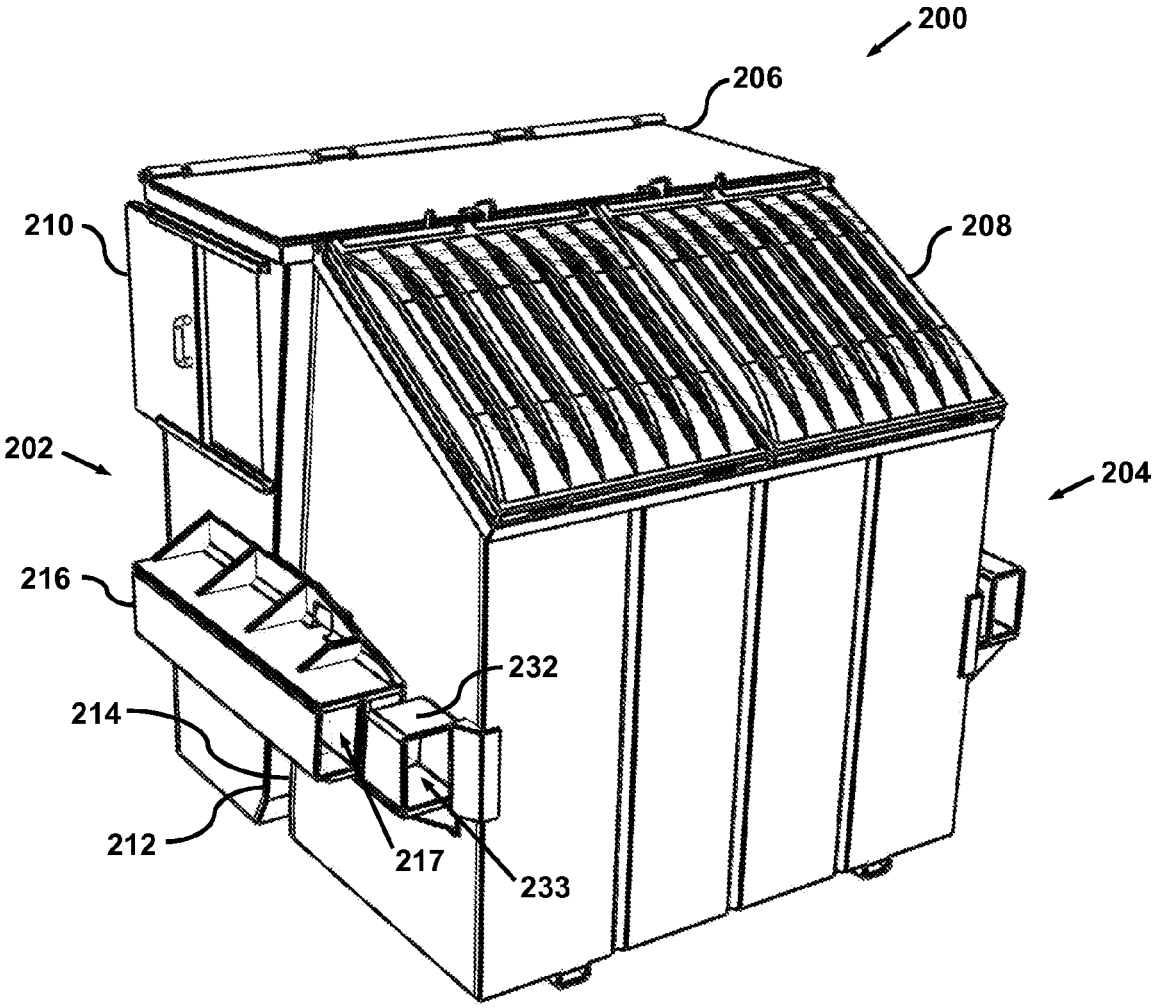
FIG. 18A-18E show various views of another embodiment of a dual waste collection device comprising stacked side-by-side sleeves.
Figure 18B:
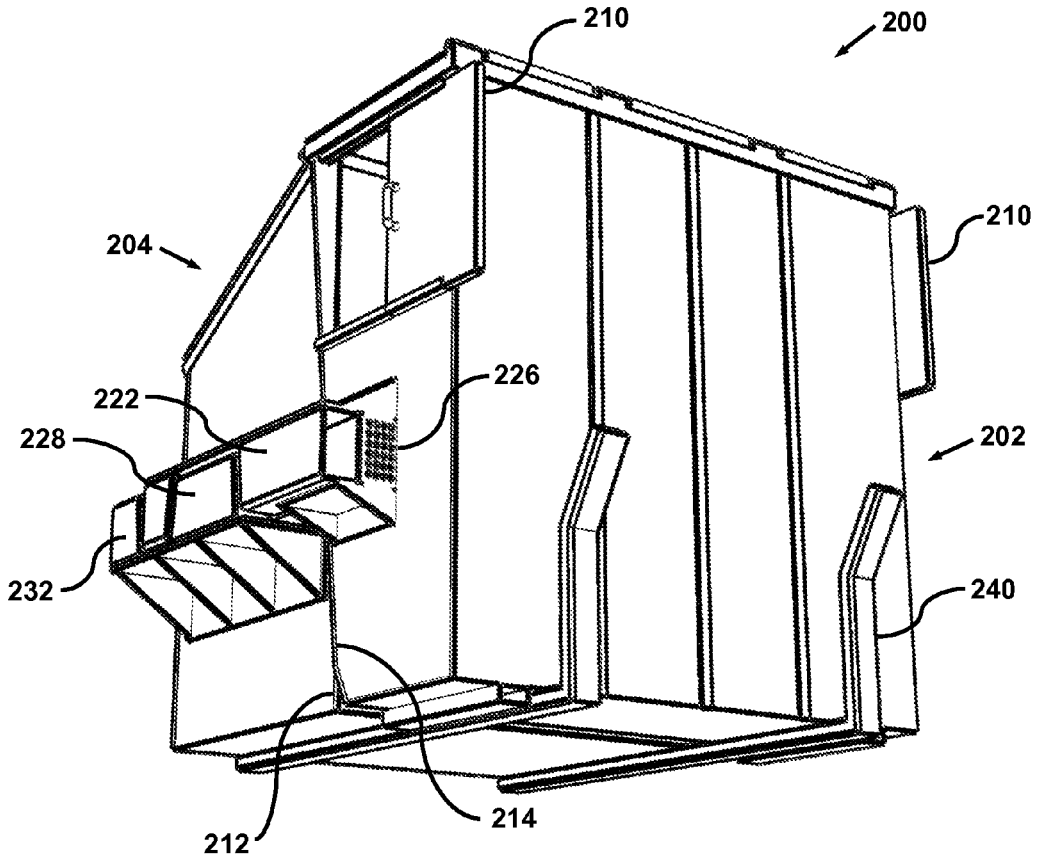
Figure 18C:
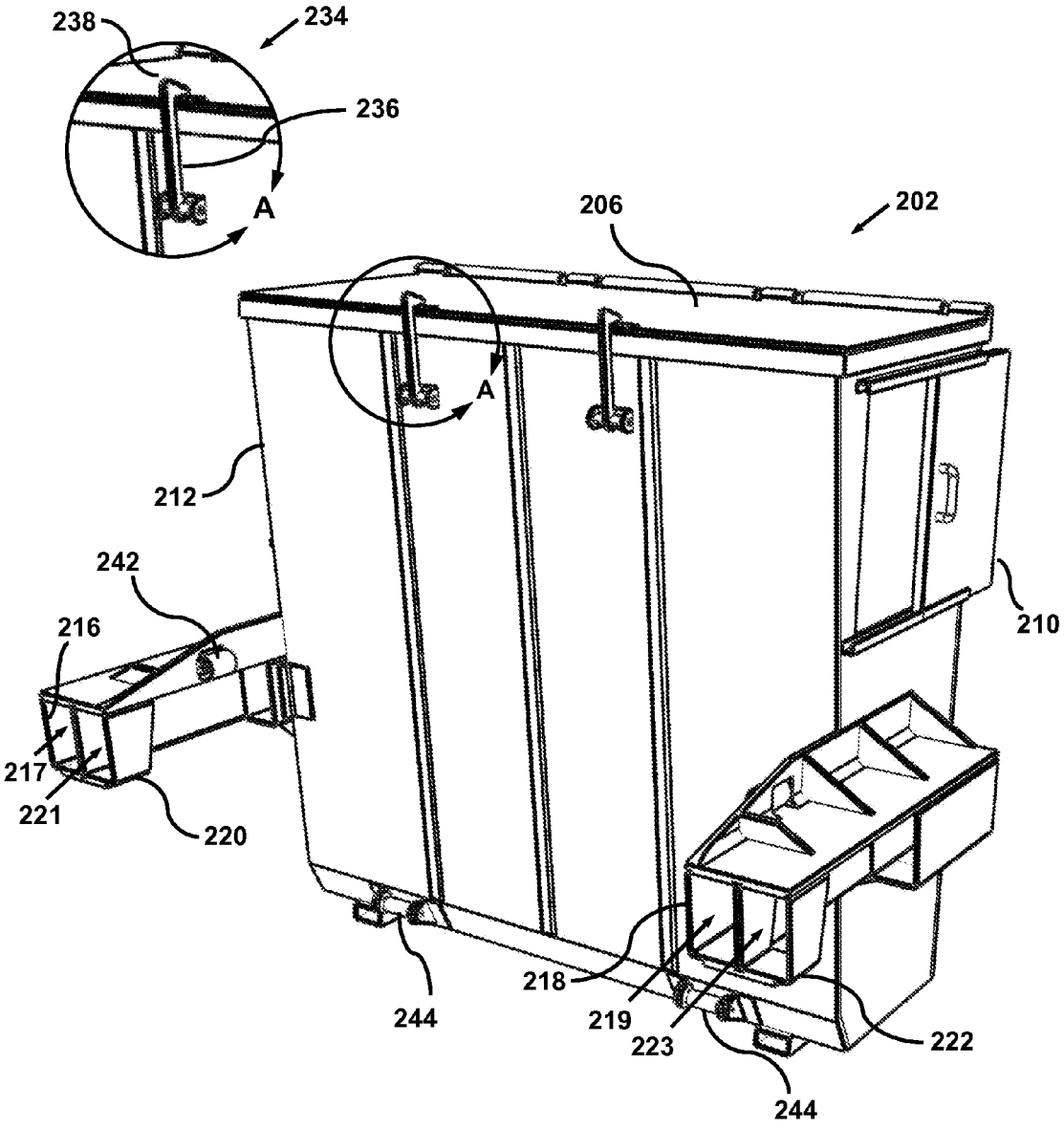
Figure 18D:
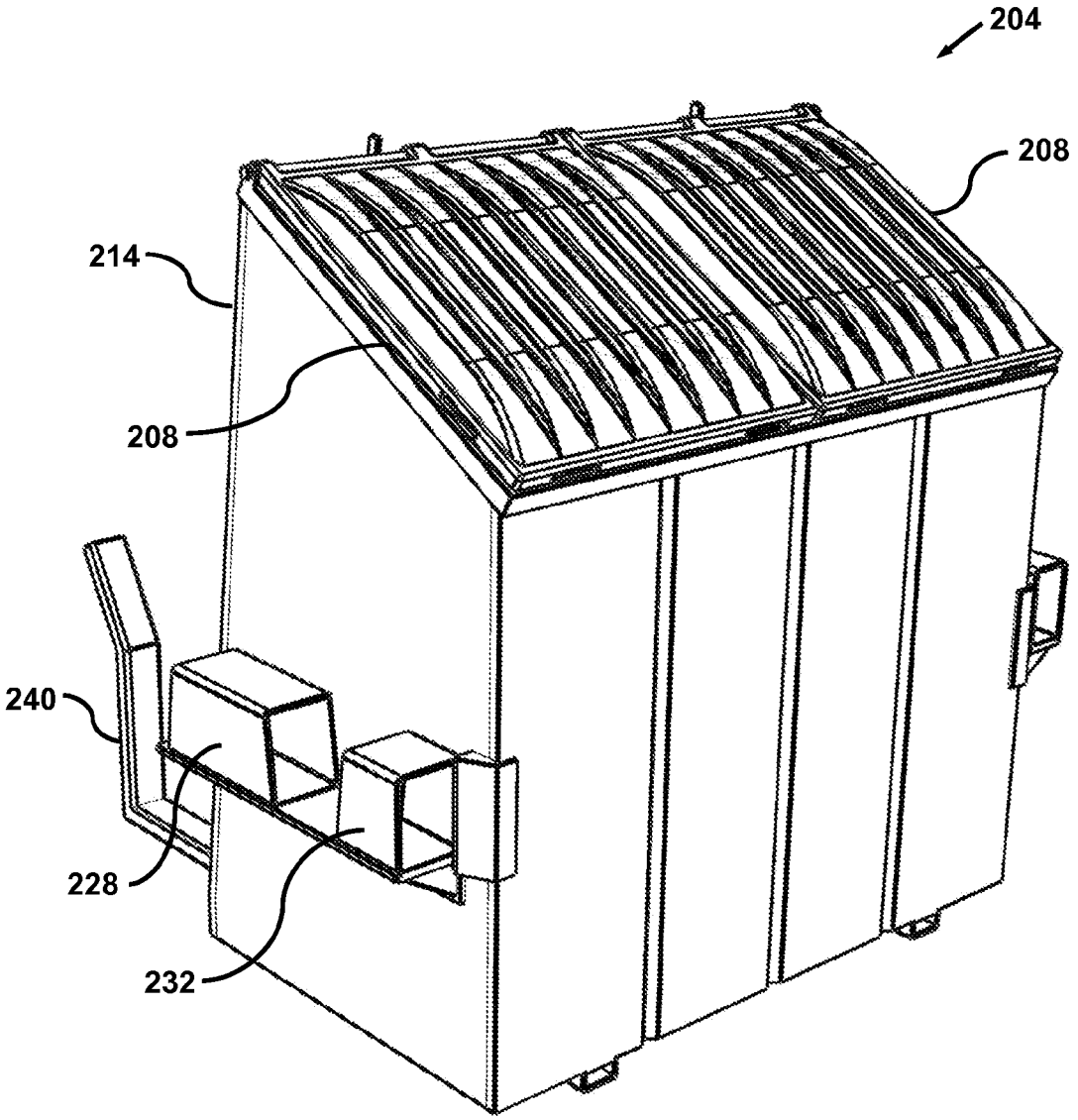
Figure 18E:
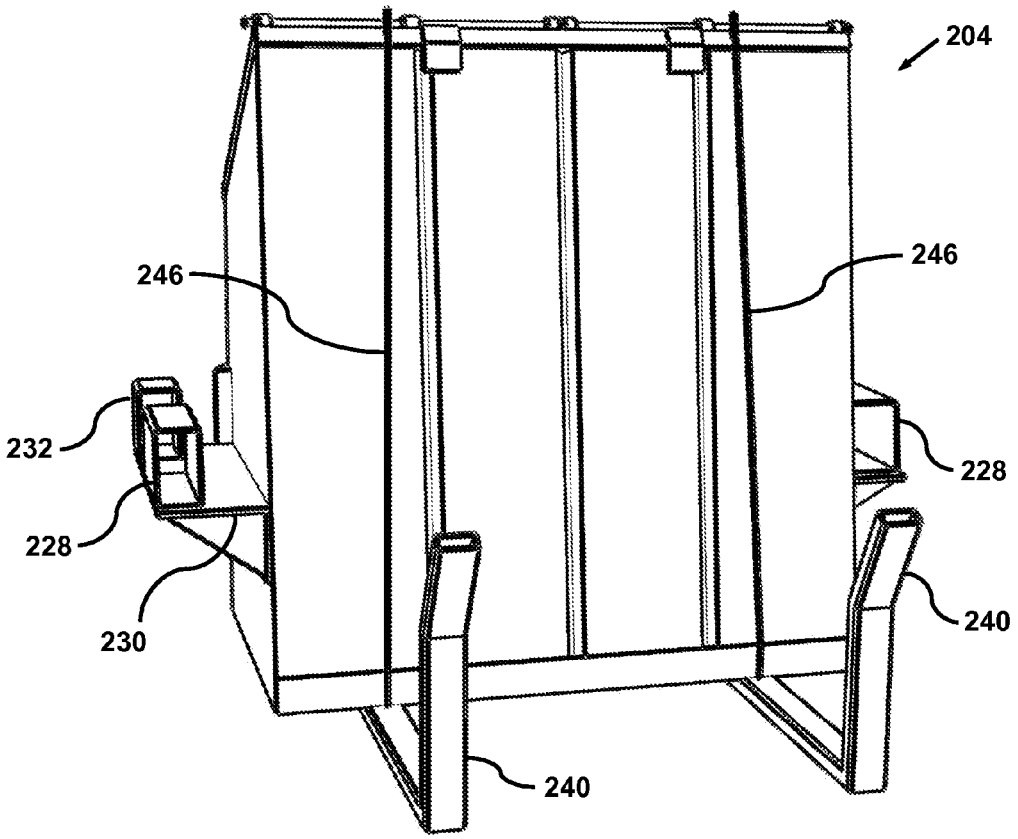

FIGS. 18A-18E show a non-limiting example of a dual waste collection device 200, similar to devices 10A-10F discussed above, which can similarly be used for the collection, storage, and transfer, of both recyclable waste material and non-recyclable waste material. More specifically, the waste collection device 200 is described below with reference to the various views presented in FIGS. 18A-18E. FIG. 18A shows a front perspective view of device 200. FIG. 18B shows a rear perspective view of the device 200. FIG. 18C shows a front perspective view of the first container of the device 200 comprising a detail view A of a lid locking mechanism. FIG. 18D shows a front perspective view of the second container of the device 200. FIG. 18E shows a rear perspective view of the second container of the device 200.

Similar to devices 10A-10F, the dual waste collection device 200 can comprise more than one container, such as two containers including a first container 202 and a second container 204. As shown in FIG. 18A, the first container can be disposed as a rear container and the second container 204 can be disposed as front container when considered with respect to a preferred relative positioning of the first container 202 and the second container 204 with respect to a waste collection vehicle used in to empty the first and second containers. Both first container 202 and second container 204 can contain, or can be designated to contain such as by one or more of color, text, symbols, or other indicators, either recyclable material or non-recyclable material.

For convenience of discussion, the first container 202 will be referred to herein as being for collection of recyclable waste and the second container 204 will be referred to as being for collection of non-recyclable waste. However, the respective designations of first container 202 and second container 204 for recyclable and for non-recyclable waste could also be reversed. The reversal of device designations with respect to recyclable waste and non-recyclable waste is equally applicable to all the other devices and containers described herein. The designation of what materials are considered recyclable waste and what materials are considered non-recyclable waste can be relative, such that a particular material that might be considered recyclable in one jurisdiction could simultaneously be considered non-recyclable in another jurisdiction. In such instances, relative differences in recycling programs can be accommodated by specifying to users where each type of waste should be deposited.

The first container 202 and the second container 204 can be made of and comprise one or more materials that are strong, sturdy, and weather resistant, such as metal, plastic, fiberglass or other suitable material, whether synthetic or natural. The first container 202 and the second container 204 can be made of the same or different materials, such as steel, stainless steel, or other suitable metal, with or without paint. Of course, other materials can also be used without departing from the spirit and scope of the present disclosure. Containers 202, 204, and any of the other containers disclosed herein, can without limitation, comprise bottom surfaces or panels comprising a thickness in a range of 2.9-2.3 millimeters (mm) plus or minus 1-2 mm, such as a thickness of 9-11 gauge or 10 gauge. Similarly, the containers can further comprise side surfaces or panels comprising a thickness in a range of 2.3-1.8 mm plus or minus 1-2 mm, such as a thickness of 11-13 gauge or 12 gauge.

The first container 202 and the second container 204 can comprise lids 206 and 208, respectively, that cover openings in the containers and isolate the containers. Isolation of the first container 202 by lid 206 and of the second container 204 by lid 208 can control or regulate entry of waste materials, and limit an inner area of the container, including waste being stored within the container, from exposure or contact with animals, environmental conditions such as precipitation, or both. Lids 206 and 208 can also provide odor control and prevent material from being removed from the containers, such as by wind. Lids 206 and 208 can be formed in any number, size, or orientation to correspond with and be mateably coupled to the openings in the first and second containers, and can be made in one or more section, portions, or pieces. For example, FIG. 18A shows lid 206 formed of a single planar or element, while lid 208 comprises first and second corrugated elements. Lids 206 and 208 can comprise one or more materials that are the same, similar, or different than the materials comprising first container 202 and second container 204, such as materials that are strong, sturdy, and weather resistant, such as metal, plastic, fiberglass, wood, or other suitable material, whether synthetic or natural, painted or not. Lids can be removably or permanently coupled to their respective containers such as by hinges, pins, rails, slides, pivots, rings, hooks, or any other suitable attachment device. Movement and position of lids 106 and 108 can be positioned or controlled so as to prevent movement of the lids at undesirable locations to cover access points, and from occurring at undesirable times, such as during emptying of the container by a waste management vehicle.

First container 202 and second container 204 can comprise one or more openings, each of which can be accessed by one or more lids. FIGS. 18A-18C provide a non-limiting example in which first container 202 comprises as least one side opening in a side wall of the container in addition to a main opening at a top of the container. As shown in FIGS. 18A-18C, the opening in the side of first container 202 can be covered by a side-door or lid 210, which can be similar or identical to lids 206 and 208. In an embodiment, side-door 210 can removably cover an opening or access point in only the first container 202 and not the second container 204. However, one or more similar openings and side doors 210 can also be formed in second container 204, the first container 202, or both.

As shown in FIGS. 18A-18C, front surface 212 of the first container 202 can comprise a relative angle that is not perpendicular, at a right angle, or 90 degrees. While in some instances the relative angle between a bottom surface and the front surface 212 can be perpendicular, in other instances, the relative angle between the bottom surface and the front surface 212 can be an acute angle or an obtuse angle to help facilitate relative movement between the first container 202 and the second container 204 when one container is lifted by itself to allow for emptying of its content without lifting or emptying content of the other container. In some instances, the relative angle of the front surface 212 can differ from perpendicular by plus or minus a measure that is less than or equal to 5 degrees, 10 degrees, 15 degrees, 20 degrees, 25 degrees, or more. The relative angle can be measured between a bottom surface of the first container 202 and the front surface 212 of the first container 202. Alternatively, the relative angle can be measured between a surface on which the first container 202 is resting and the front surface 212.

Similarly, the second container 204 can comprise a rear surface 214 that is oriented toward, and situated opposite from, front surface 212 of first container 20 when the first container 202 and the second container 204 are releasably coupled together as device 200. As such, rear surface 214 can comprise a relative angle that is not perpendicular, at a right angle, or at 90 degrees. While in some instances the relative angle between a bottom surface and the rear surface 214 can be perpendicular, in other instances, the relative angle between the bottom surface and the rear surface 214 can be an acute angle or an obtuse angle to help facilitate relative movement between the first container 202 and the second container 204 when one container is lifted by itself to allow for emptying of its content without lifting or emptying content of the other container. In some instances the relative angle of the rear surface 214 can differ from perpendicular by plus or minus a measure that is less than or equal to 5 degrees, 10 degrees, 15 degrees, 20 degrees, 25 degrees, or more. The relative angle can be measured between a bottom surface of the second container 204 and the rear surface 214 of the second container 204. Alternatively, the relative angle can be measured between a surface on which the first container 204 is resting and the rear surface 214.

In any event, the relative angle of the front surface 212 can be complimentary with rear surface 214 so that together the sum of the angles is equal to, or substantially equal to, 180 degrees, such as plus or minus 5 degrees. As such, the front surface 212 and the rear surface 214 can be parallel or approximately parallel with respect to each other another when releasably coupled to each other to form device 200, or when device 200 is at rest on a level surface for use, with sleeves of the first container 202 aligned with sleeves of the second container 204. The non-perpendicular angles of the front surface 212 and the rear surface 214 can allow for the first container 202 to more easily be raised and lifted away from the second container 204. The angle of the front surface 212 and the rear surface 214 further makes it easier to better align the first and second containers 202 and 204 so that there is a minimal gap between the front surface 212 and the rear surface 214 of the first and second containers 202 and 204, respectively.

Device 200 can comprise a plurality of sleeves coupled to, or integrally formed with, one or more outer surfaces of the device 200. The plurality of sleeves can comprise or be formed of one or more layers of material. The plurality of sleeves can also be formed as one or more pairs of sleeves configured for receiving forks of a waste collection vehicle such as a garbage truck, thereby facilitating removal or collection of waste material from the device 200. Waste can be transferred from the device 200 to the waste collection vehicle by inserting forks of the waste collection vehicle into sleeves of the device 200, then lifting the device 200 and emptying contents of the device 200 into a storage or transfer container coupled to the waste collection vehicle.

As a non-limiting example, the device 200 can comprise multiple pairs of sleeves coupled to the first container 202 and the second container 204. For convenience relative positions of the sleeves are referred to as left and right sleeves to designate a relative position of sleeves from a point of view of a waste collection vehicle aligned with the device 200 for emptying the device 200. Relative positions of the sleeves are referred to as inner and outer sleeves, with the inner sleeves being those sleeves that are closest to exterior surfaces or sidewalls of the device 200, and the outer sleeves being those that are farthest from the exterior surfaces or sidewalls of the device 200. Stated another way, the inner sleeves can be disposed between or sandwiched between the outer sleeves and the exterior surface or sidewall of the device 200, including the first container 202 and the second container 204.

The first container 202 can comprise a first pair of sleeves comprising an outer left sleeve 216 and an inner right sleeve 218 and a second pair of sleeves comprising an inner left sleeve 220 and an outer right sleeve 222. The pair of sleeves, including sleeves 216 and 218, and pair of sleeves, including sleeves 220 and 222, can be made of materials that are the same or similar as the materials used for the first and second containers 202 and 204. By alternating an inner and outer position for the sleeves positioned on left and right sides of the first container 202 for the first pair of sleeves and the second pair of sleeves, a fixed or constant distance for each of the first and second pairs of sleeves is maintained. Maintaining the fixed or constant distance for both the first and second pairs of sleeves allows the same waste collection vehicle, such as a standard waste collection vehicle comprising forks with a fixed spacing or width, to be used for insertion into the first pair of sleeves, the second pair of sleeves, or both. As shown in FIGS. 18A-18E, the first pair of sleeves comprising sleeves 216 and 218 can be used, e.g. have forks of a trash collection vehicle inserted therein, to lift or empty only the first container 202. The second pair of sleeves comprising sleeves 220 and 222 cam be used to lift the first container 202 and the second container 204 together.

In some embodiments, all sleeves, such as sleeves 216, 218, 220, and 222 can be aligned parallel or substantially parallel to each other, such as within less than or equal to 5 degrees, 10 degrees, 15 degrees, 20 degrees, 25 degrees, or more of each other. Similarly, the side surfaces of the first container 202 and the second container 204, e.g., those surface disposed between and coupled to the front and back surfaces of the first container 202 and second container 204, can be parallel or substantially parallel to each other. Advantageously, sizing and orientation of the sleeves will allow for the forks of the waste collection vehicle to be easily inserted within the sleeves for easy emptying of one or more containers within the device 200. In some instances, the sleeves will comprise an alignment that is equal or substantially equal to an alignment of the sidewalls of the device 200. The alignment or relative angle of the sidewalls of the first container 202 and the second container 204 (as seen in in a plan view) can be parallel. Alternatively, the alignment or relative angle of the sidewalls of the first container 202 and the second container 204 can be angled toward or away from each other, such that a relative angle of the sidewalls can differ from being parallel by plus or minus a measure that is less than or equal to 5 degrees, 10 degrees, 15 degrees, 20 degrees, 25 degrees, or more. In instances in which an angle of the sidewalls of the first container 202 and the second container 204 would prevent the sleeves from being parallel with the sidewalls and still provide for easy or acceptable access of the forks of the waste collection vehicle within the sleeves, the sleeve can be angled, instead of parallel, with respect to the container sidewalls. In such instances, a relative angle of the sidewalls can differ from the sidewalls by plus or minus a measure that is less than or equal to 5 degrees, 10 degrees, 15 degrees, 20 degrees, 25 degrees, or more.

As shown in FIGS. 18A-18E, sleeves 216, 218, 220, and 222 can be attached to, and extend away from, the side surfaces of the first container 202 to which they are attached. In extending away from the first container, the sleeves 216, 218, 220, and 222 can pass through a plane containing front surface 212 of the first container 202. As such, sleeves 216, 218, 220, and 222 can be positioned for each to accept a fork of a waste collection vehicle. As indicated above, sleeves 216 and 220 can be coupled to a left sidewall of the container 202 while sleeves 218 and 222 can be coupled to a right sidewall of the container 202 such that the sleeves 216 and 220 are coupled on a surface of the device 202 opposite the surface to which the sleeves 218 and 222 are coupled. By extending the sleeves 216, 218, 220, and 222 away from the first container 202, such as passing through a plane containing front surface 212 of the first container 202, the sleeves can form and serve as a guide for the placement of the second container 204 between the sleeves, while also allowing for the forks of a standard garbage truck to fully engage the sleeves for lifting of the containers.

As a non-limiting example, FIG. 18C shows an embodiment in which sleeves 216, 218, 220 and 222 can be coupled or directly attached to an outer surface of first container 202 so that one or more of the sleeves is disposed outside the waste collection area of the first container 202. Alternatively, the sleeves of the first container 202, or any part of device 200, can be coupled or directly attached to an inner surface of first container 202 so that one or more of the sleeves is disposed inside the waste collection area of the first container 202. When one or more sleeves are disposed or formed within the device 200, access openings can be formed through at least a portion or surface of the device 200 such that forks of a waste collection vehicle can be disposed through the device 200 and into the sleeves. For example, access openings can be formed through a front surface 212 of the first container 202 to allow forks to be inserted into the interior sleeves. As shown in FIG. 18C, sleeves 218 and 220 can be formed on outer surfaces of the container 202. Sleeves 216 and 222 can be attached to the outward facing surfaces of sleeves 220 and 218, respectively. Stated another way, sleeves 216 and 222 can be attached to surfaces of sleeve 220 and 218, respectively, that are opposite the exterior surface of the first container 202.

Any or all of the sleeves 216, 218, 220, and 222 can comprise hollow channeling, such as hollowing channeling 217, 219, 221, and 223, respectively. The hollow channeling can allow for a standard fork lift-operated waste collection vehicle to insert forks through the pair of sleeves 216 and 218 to raise and empty the first container 202 individually when the forks are in a first position. The pair of sleeves 220 and 222 can comprise hollow channeling 221 and 223 that allows for forks to be inserted through the pair of sleeves 220 and 222 to lift the first container 202 and second container 204 together. Sleeves 216, 218, 220, and 222, as well as any of the other sleeves discussed herein, can comprise any suitable length, which in some instances comprise lengths in a range of 0.6-1.3 meters (m). Sleeves 216, 218, 220, and 222 can extend partially or completely along a side or side surface of the container to which they are attached.

Note that while sleeves 216, 218, 220, and 222 are shown comprising hollow channeling 217, 219, 221, and 223, respectively, the sleeves 216, 218, 220, and 222 can also be formed with openings, slats, windows, voids, hoops, or rings, such that 216, 218, 220, and 222 do not fully encapsulate the forks once the forks are inserted within the sleeve. An amount of material used for sleeves 216, 218, 220, and 222, including sizing and spacing can be determined based on desirable strength requirements for lifting and emptying the first container 202 and the second container 204, as well as for ease of use in inserting forks within the sleeves. As such, sleeves 216, 218, 220, and 222, or any sleeve, can be formed comprising metal with a thickness in a range of 3.66-2.38 mm plus or minus 1-2 mm, or about 7-10 gauge.

Similarly, sleeves 216, 218, 220, and 222, or any sleeve, can be formed comprising a generally rectangular shape that further comprises a square or rectangular cross-section, as shown in the figures, but can also comprise any geometric or cross-sectional shape. In some instances the sleeves comprising a rectangular cross-section can comprise a height in a range of about 20-31 centimeters (cm) and a width in a range of about 10-21 cm, and as such can, without limitation, comprise height of 10.2 cm and a width of 22.9 cm. In some instances, sleeves 216, 218, 220, and 222 can be formed of one or more planar two-dimensional surfaces, such as the top or the top and bottom surfaces of hollow channeling 217, 219, 221, or 223 without comprising an exterior side surface. In such instances, the exterior side surfaces can be omitted in that the forks inserted within the sleeves and used to raise the containers are rigidly set at a fixed distance and will not contact the exterior side surfaces of hollow channeling 217, 219, 221, and 223.

One or more end caps, such as end cap 226, can be coupled to, or integrally formed with, an end of a sleeve, such as sleeve 218. The end cap can prevent a container, such as the first container 202, from sliding down the forks of a waste collection vehicle as it is being emptied. Without an end cap, the first container 202 could slide down the forks of the waste collection vehicle while the first container 202 was being lifted and emptied. In the event that an end cap was not present and the container 202 did slide along the forks of the waste collection vehicle while being emptied the first container 202 could encounter difficulty in being lowered back into position behind the second container 204 after having slid while being emptied.

Moving from particular details of the sleeves coupled to the first container 202, we now turn to a description of some details relating to the second container 204. As shown in FIGS. 18B, 18D, and 18E, the second container 204 can comprise a pair of sleeves 228. The pair of sleeves 228 can be made out of materials that are the same, similar, or different from those forming sleeves 216, 218, 220, and 222, as well as the same, similar, or different from those forming the first and second containers 202 and 204. The sleeves 228 can be coupled to a side surface of the second container 204, and as such can be either directly attached to a side surface or sidewall of the second container 204, to align with an inner sleeve 218 or 220 coupled to the first container 202, or can be offset with respect to the side surfaces or sidewalls of the second container 204, to align with an outer sleeve 216 or 222 coupled to the first container 202.

As a non-limiting example, a first sleeve 228 can be attached to a side surface of the second container 204 and aligned with sleeve 220 attached to the first container 202 and positioned to accept a fork of a standard waste collection vehicle that can be inserted through both sleeve 228 and sleeve 220 at a same time. Another or second sleeve 228 can be coupled to the second container, such as to a sidewall opposite the surface to which the first sleeve 228 is coupled, by means of a stand-off, spacer, or offset device 230 that can be formed as a bracket, arm, flange, channel, or other suitable structure. Offset device 230 can be made of a material that is the same, similar, or different than sleeve 228 or the second container 204. In some instances, each of the first container 204, offset device 230 and sleeve 228 can be made of metal and can be coupled together by welding, or by mechanical or chemical attachment such as with mechanical fasteners like nuts and bolts, rivets, soldering, adhesives, including epoxies. The second sleeve 228 can be coupled to the second container 204 opposite the first sleeve 228, and can be aligned with sleeve 222 to accept the companion fork of the waste collection vehicle that can be inserted into sleeve 222 and the second sleeve 228 at a same time. Thus, while sleeves 228 are shown aligned with sleeves 220 and 222, they could also be aligned with sleeves 216 and 218, depending on the configuration and design of device 200. A stand-off distance or offset between the second container 204 and the second sleeve 228 can be determined completely, or in part, by a distance or dimension of the offset device 230. The stand-off distance can be of any distance, but will advantageously be sufficient to allow for a sleeve, such as sleeve 218 to be disposed between the sleeve 228 and the side surface of the second container 204.

A set of sleeves on the first container 202 and a set of sleeves on the second container 204 can be interlocking or mateably coupled to each other so that the interlocked set of sleeves can facilitate entry of the forks of a waste collection vehicle into the interlocked sleeves at a same time for lifting of the first container 202 and the second container 204 at the same time. FIGS. 18A-18E shows a non-limiting example in which sleeves 220 and 222 are formed comprising an opening or open central section. The second pair of sleeves including sleeves 220 and 222 are positioned to be aligned with the third pair of sleeves 228 on the second container 204. The central area of sleeves 220 and 222 are opened and spaced to enable the third pair of sleeves including sleeves 228 of the second container 204 to be disposed positioned in the openings of sleeves 220 and 222. The second set of sleeves including sleeves 220 and 222 can serve at least two purposes. First, the second set of sleeves including sleeves 220 and 222 can be used in combination with the third set of sleeves including sleeves 228 to simultaneous lift the two aligned and interlocked containers 202 and 204 by holding the containers 202 and 204 in stationary or fixed position with respect to each other by reducing or eliminating relative movement between the two containers 202 and 204 with respect to one another. Second, the opening in sleeves 220 and 222 can comprise sloped, angled, or ramped edges or surfaces that provide alignment and guidance for the device 200 when placing the first container 202 together with the second container 204, such as when the first container 202 is positioned with respect to the second container 204 so that a small or minimal gap between the front surface 212 and the rear surface 214 of the first and second containers 202 and 204 exists. In some instances, the gap between the front surface 212 and the rear surface 214 of interlocked containers 202 and 204 can comprise the minimal gap comprising a distance or offset less than or equal to 2 cm, 5 cm, or 10 cm.

As shown in FIGS. 18B-18E, the third pair of sleeves 228 can also be formed with a surface or edge comprising a mirror image, conjugate surface, interlocking surface, or corresponding surface, to the opening in the first or second set of sleeves, such as the opening shown in sleeves 220 and 222. Accordingly, the surface or edges of the third pair of sleeves including sleeves 228 can also be sloped, angled, or ramped. In some embodiments, the sloped, angled, or ramped surfaces or edges of sleeves 220 and 222 can be formed at complementary angles with sleeves 228 so that sleeves 220 and 222 can be parallel or substantially parallel with sleeves, such as along the openings in the sleeves 220 and 222. As indicated above, the angled sides edges of the sleeves 220, 222, and 228 can further serve as alignment mechanisms for providing relative alignment between first container 202 and second container 204 to form device 200 when positioning the first container 202 with a minimal gap between the front surface 212 and the rear surface 214 of the first and second containers 202 and 204, respectively.

Similar to the open sections formed in the second set of sleeves comprising sleeve 220 and 222, the second container 204 can also comprise a third set of sleeves comprising open sections similar to those formed in sleeves 220 and 222 of the first container 202. The openings in the third set of sleeves, or the sleeves in the second container, can be generally thought of, for ease of conceptualization, in at least two ways. First, the openings in the sleeves of the second container 204 can be thought of as an opening, void, or space within, or along a length of, a single sleeve. Second, and alternatively, the opening can be thought of a space or void that is defined by edges of multiple smaller sleeves that when taken together, form the third set of sleeves. The multiple smaller sleeves could include a first end of one smaller sleeve and a second end of another smaller sleeve. While both conceptual approaches can be helpful, for ease of explanation and for brevity, the following discussion is presented with respect to the later approach, in which two smaller sleeves with two ends defining an opening form each sleeve of a third pair of sleeves.

Accordingly, FIGS. 18D and 18E, for example, disclose a third pair of sleeves comprising smaller sleeves 228 and sleeves 232, which taken together form front and back edges of the openings into which the second pair of sleeves including sleeves 220 and 222 can be disposed for an interlocking fit. As an example, sleeves 232 are shown spaced apart from, or offset with respect to, the pair of sleeves 228. The space between sleeves 228 and 232 can enable an interlocking fit or placement of the second pair of sleeves, including sleeves 220 and 222 of the first container 202, between the third pairs of sleeves, including sleeves 228 and 232. Accordingly, the sleeves 220, 222, 228, and 232 can be aligned in an interlocking position when the dual waste collection device 200 is in its resting position, thereby preventing relative movement between containers 202 and 204 during simultaneous lifting of both the containers 202 and 204. Consistent with the descriptions given herein, sleeves 228 and 232 can be made of materials similar, or identical, to materials forming the first and second containers 202 and 204, or sleeves 216, 218, 220, or 220. Similarly, sleeves 228 and 232 can further comprise hollow channeling 233 similar or identical to the hollow channeling described above with respect to sleeves 216, 218, 220, and 220.

Dual waste collection device 200 can allow for empting of only the first container 202, empting of only the second container 204, and emptying of both the first container 202 and of the second container 204 at a same time. In an instance when both the first container 202 and the second container 204 are lifted at a same time, any waste collected within both containers can be emptied at a same time. Alternatively, if emptying of the contents of only one of the containers is desired, a locking device 234 can be used to secure a lid of one of the containers when both of the containers are being lifted so that the contents of the locked container remain held within the container by the locked lid. As a non-limiting example, the lid 206 of the first container 202 can be locked in place so that when both containers 202 and 204 are lifted together, only the contents of the second container 204 are emptied into the waste collection vehicle. This can allow for emptying of only the second container 204 when placement of the waste collection vehicle forks are disposed within sleeves 218, 222, 228, and 232 for simultaneous lifting of both the first container 202 and the second container 204. Alternatively, the second container 204 can be emptied individually if lifted individually by a fourth set of sleeves fixedly coupled to only the second container 204, without being aligned with another set of sleeves that also receives the lifting forks of a waste collection vehicle at a same time as the fourth set of sleeves. While the fourth set of sleeves referenced herein includes "fourth" in its name, the fourth set of sleeves could be included on device 200 or any other of the devices included herein, such as devices 300 or 400, even if there are only a total of three sets of sleeves, or any other number of sleeves. The first container 202 can of course be emptied on its own by lifting only the first container by placing the forks of the waste collection vehicle within the first set of sleeves, or within sleeves 216 and 218.

In some embodiments, the locking mechanism 234 for lid 206 can be formed as a latch 236. The latch 236 can be hingedly or rotatably coupled to any surface of the first container 202, such as the front surface 212. The latch 236 can comprise a hook 238 that can engage the lid 206 to lock the lid 206 when the first container 202 and second container 204 are positioned or coupled together. When the first container 202 and second container 204 are lifted together, the second container 204 can press the latch 236, rotating it upwards and towards the front surface 212 and lid 206 so that the hook 238 can engage and lock the lid 206. Thus, the lid 206 can remain closed when both the first container 202 and second container 204 are lifted together. When the forks of a waste collection vehicle pass through the first pair of sleeves including sleeves 216 and 218 to lift just the first container 202 slightly above the second container 204, the angle of the front surface of the first container can cause the latch 236 to fall forward and away from front surface 212 and lid 206 so that the hook 238 disengages the lid 206. The movement of the latch 236 away from the front surface 212 can be further enhanced by use of a spring or spring-like member. This unlocks the lid 206, thereby allowing the lid 206 to open when the first container 202 is emptied.

As shown in FIGS. 18B, 18D, and 18E, the second container 204 can also comprise a pair of support members 240 that can be fixedly or releasably coupled to one or more containers of the device 200. Support members 240 can prevent relative movement of portions of the device 200 with respect to each other, such as relative movement between the first container 202 and the second container 204. Reduced relative movement can be advantageous both for when the first and second containers 202 and 204 are being lifted together, or when the containers are at rest together during collection of waste and before emptying of the collected waste.

Support members 240 can be made of a material that is similar or identical to the material of the containers 202 and 204, or any of the sleeves attached thereto. Support members can comprise separate or interconnected pieces of any size and shape, and can comprise a cross-sectional area that is square, rectangular, circular, oval, H-shaped, T-shaped, I-shaped, U-shaped, or any other shape. Support members can be coupled or attached to the containers 202 and 204 by welding, or by mechanical or chemical attachment such as with mechanical fasteners like nuts and bolts, rivets, soldering, adhesives, including epoxies. The first container 202 can be releasably coupled to the support members 240 so that the support members 240 can assist in coupling the first and second containers 202 and 204 together when at rest or when being lifted together. The support members 240 can also be separate from, or not in contact with, the first container 202 when the first container 202 is being lifted and emptied on its own. Depending on the configuration and design of device 200, the relative and fixed nature of attachment between the first container 202 and the second container 204 could also be reversed.

Support members can comprise both straight and angled portions, and can comprise both horizontal and vertical portions or segments. Support members 240 can be fixedly or permanently coupled to a bottom surface of the second container 204, and extend away from the second container 204 in a substantially horizontal direction to create a space or surface for receiving placement of the first container 202. The support members 240 can also include a vertical or substantially vertical portion that is angled upwardly away from the horizontal portion and upwardly from a bottom surface of the first and second containers 202 and 204. In some instances, an angle or radius of curvature between the horizontal and vertical portions of the support members 240 can match or correspond to an angle or radius of curvature of the portion of a container, such as the first container 202, that is adjacent or in contact with the support members 240. The vertical or upwardly extending portion of the support members 240 can also comprise a sloped, angled, or ramped portion, such as an end portion. The sloped, angled, or ramped portion of one or more of the support members 240 can further serve as an alignment mechanism for providing relative alignment between first container 202 and second container 204 when positioning the first container 202 with a minimal gap between the front surface 212 and the rear surface 214 of the first and second containers 202 and 204, respectively. Taken together, the horizontal and vertical components of support members 240 can provide an additional mechanism for aligning the first and second containers 202 and 204 and for preventing relative movement of the two containers 202 and 204 with respect to one another during simultaneous lifting, or rest, of the two containers 202 and 204.

In some embodiments, the dual waste collection device, such as device 200, can comprise rollers, slides, wheels, balls, or bearings 242 to facilitate relative movement between portions of the device, such as first container 202 and second container 204. Rollers 242 can be placed at any location on device 200, including where contact between portions the first container 202 and the second container 204 is possible, or likely, especially when the first and second containers 202 and 204 are moved relative to one another. FIG. 18C shows an embodiment in which rollers 242 can be placed on an interior side or surface of one or more sleeves, such as on or adjacent an inner surface of sleeves 218 and 220 of the first container 202. The rollers 242 can be positioned on the section of the sleeves 218 and 220 that extend away from the first container 202, through the plane containing front surface 212. Stated another way, rollers 242 can be placed on an interior side or surface of one or more sleeves that defines a space or area within which the second container 204 can be positioned or placed. As such, the rollers 242 can allow the first container 202 to be more easily lifted away from and realigned with the second container 204 than without the rollers. The use of rollers 242 can also reduce damage, scratching, or chipping of the first container 202 and the second container 204 by reducing contact and impacts between the first container 202 and the second container 204.

In some embodiments, additional rollers, slides, wheels, balls, or bearings 244 are placed on or near a bottom edge of front surface 212 of the first container 202. The rollers 244 can further allow the first container 202 to be more easily lifted away from, and realigned with, the second container 204. The rollers 244 can be used with guide rails 246 to properly align the first container 202 with the second containers 204, such that the sleeves of device 200 are properly aligned with respect to each other.

Figure 19A:
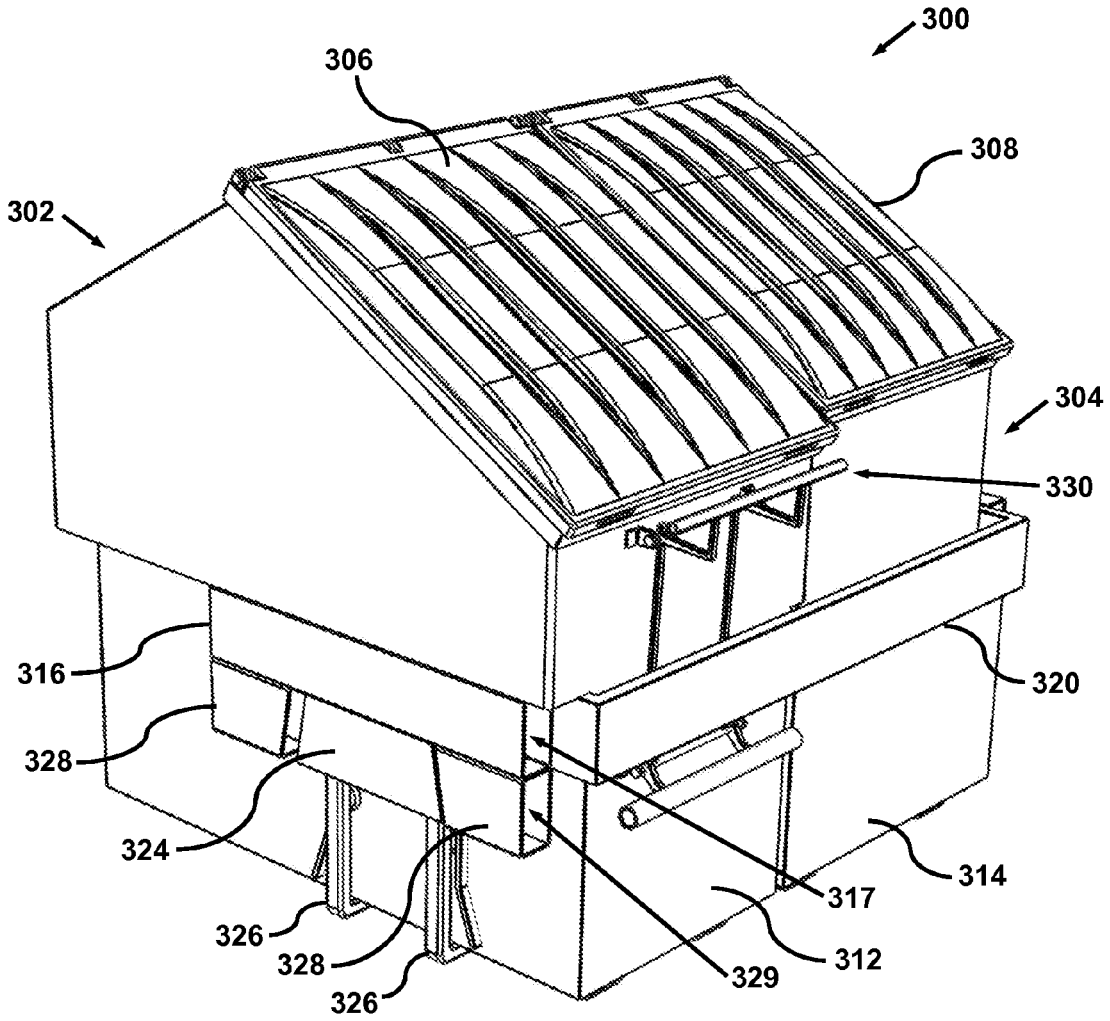
FIGS. 19A-19G show various views of another embodiment of a dual waste collection device comprising side-by-side containers.
Figure 19B:
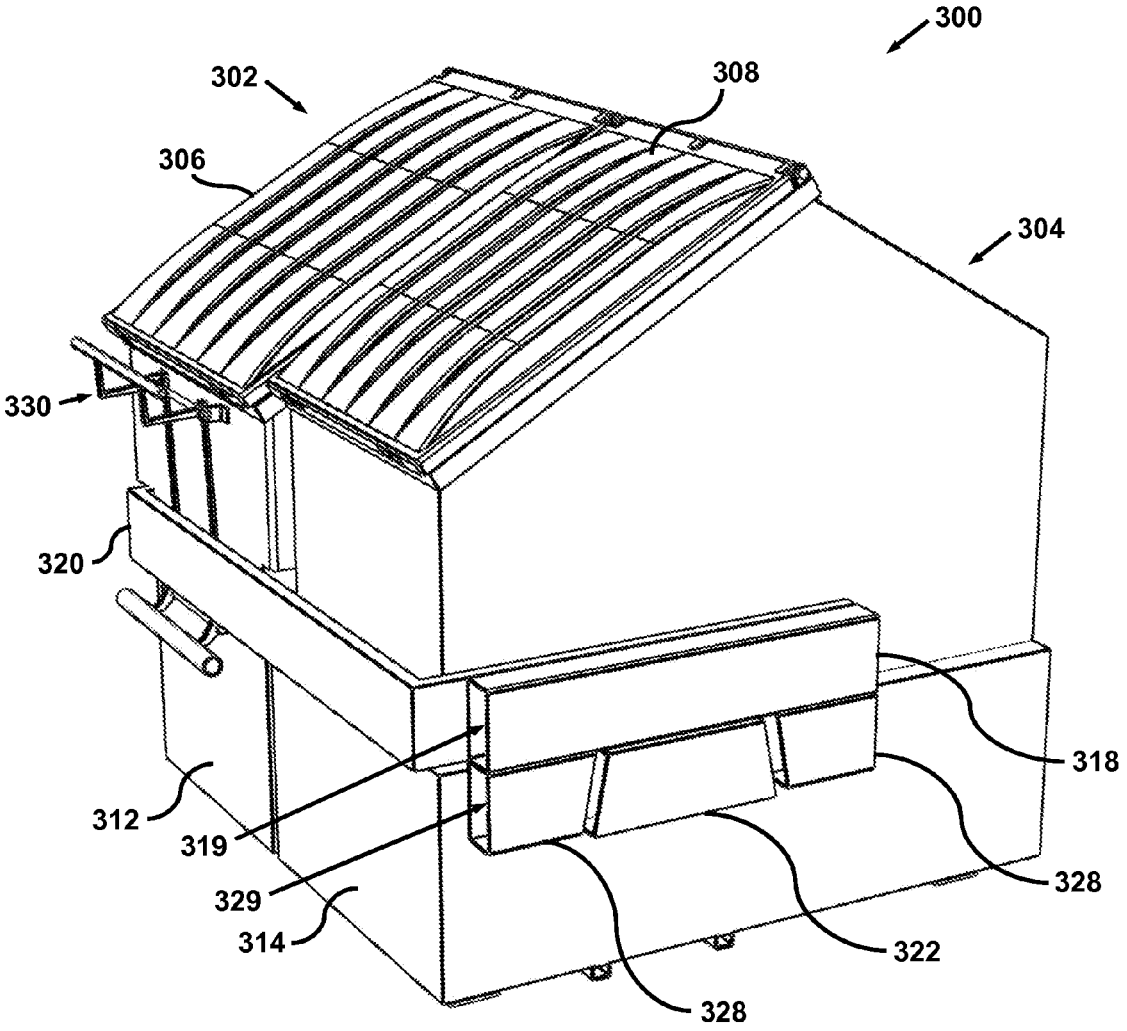
Figure 19C:
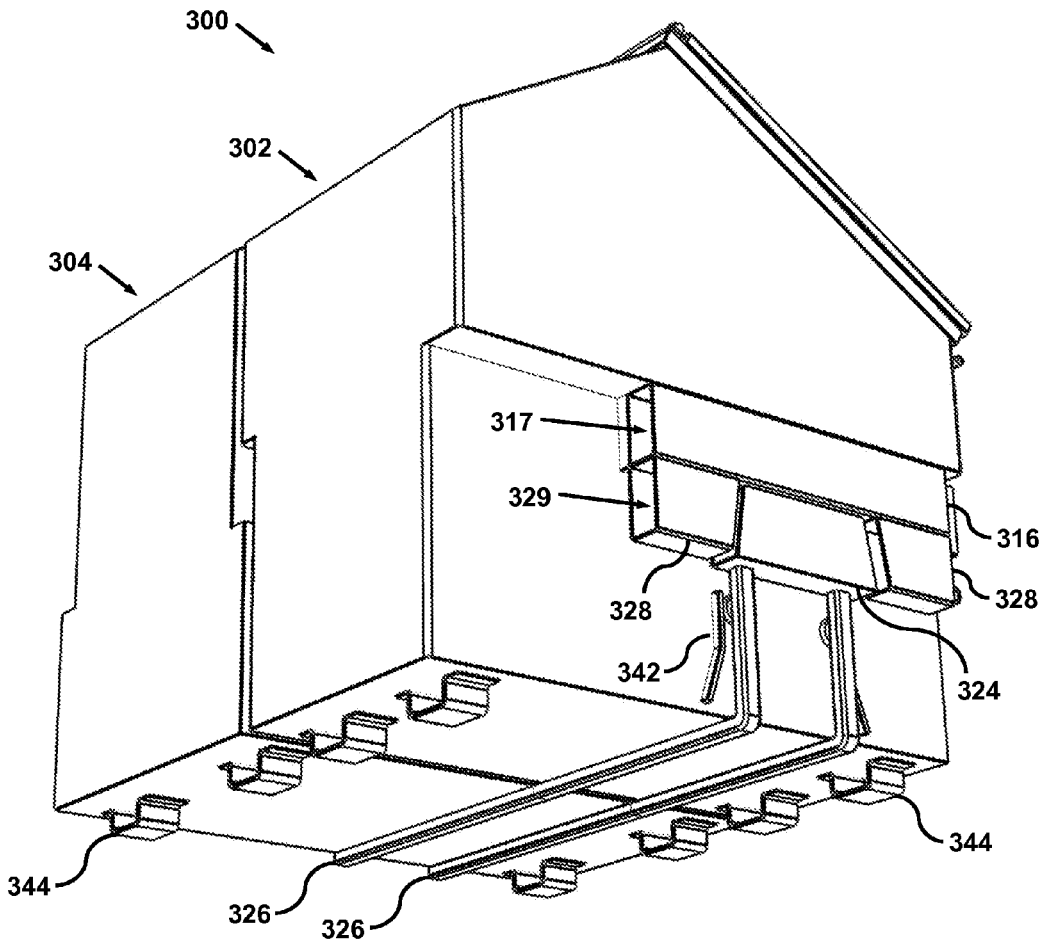
Figure 19D:
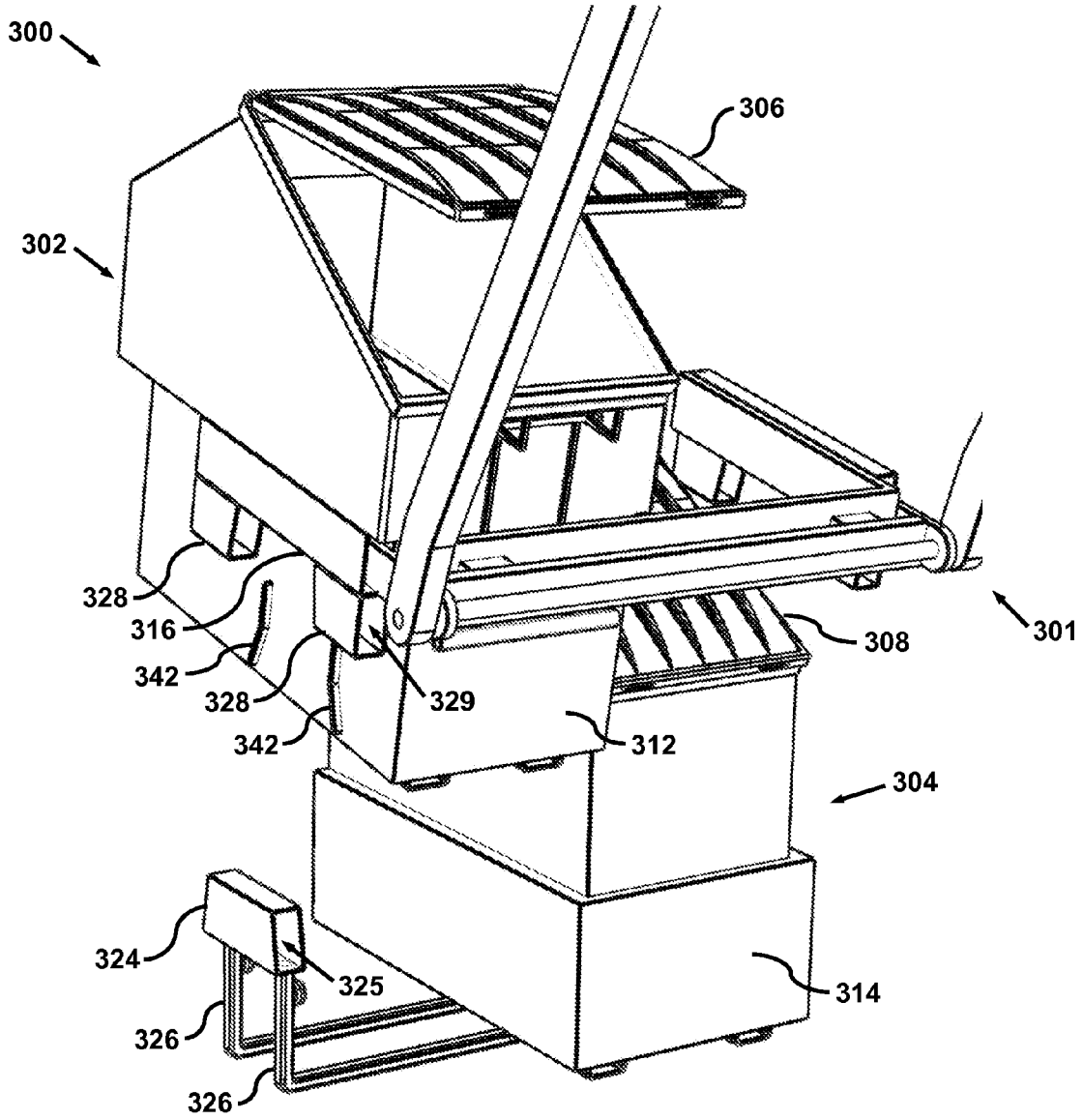
Figure 19E:
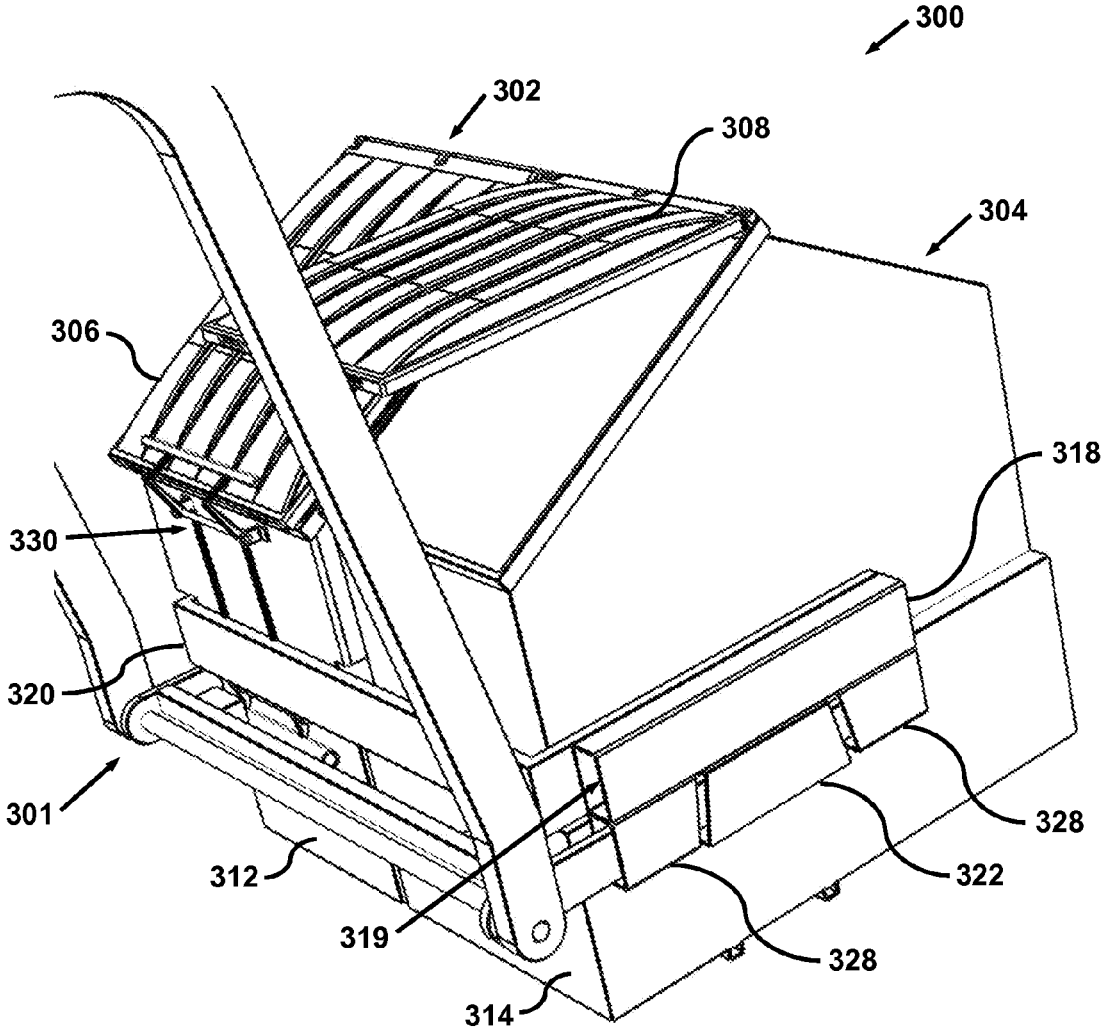
Figure 19F:
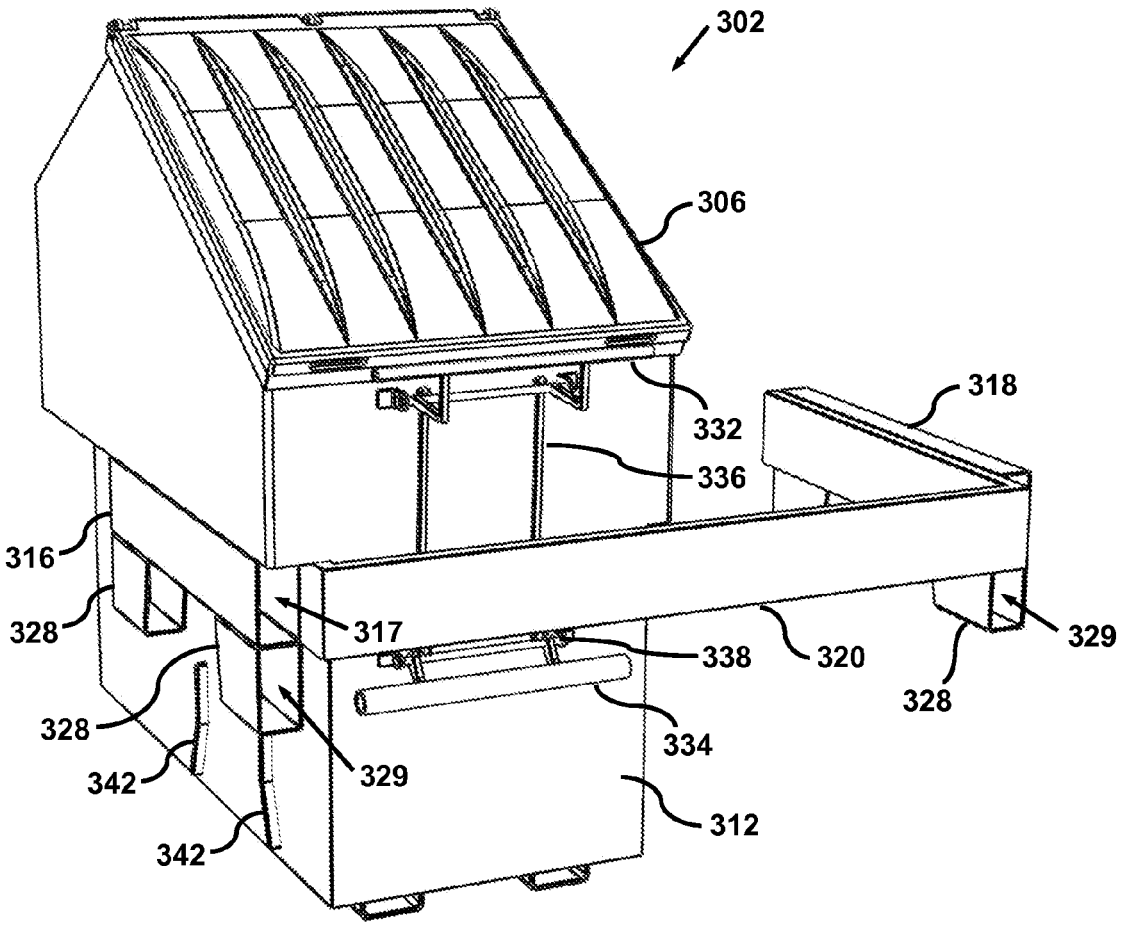
Figure 19G:
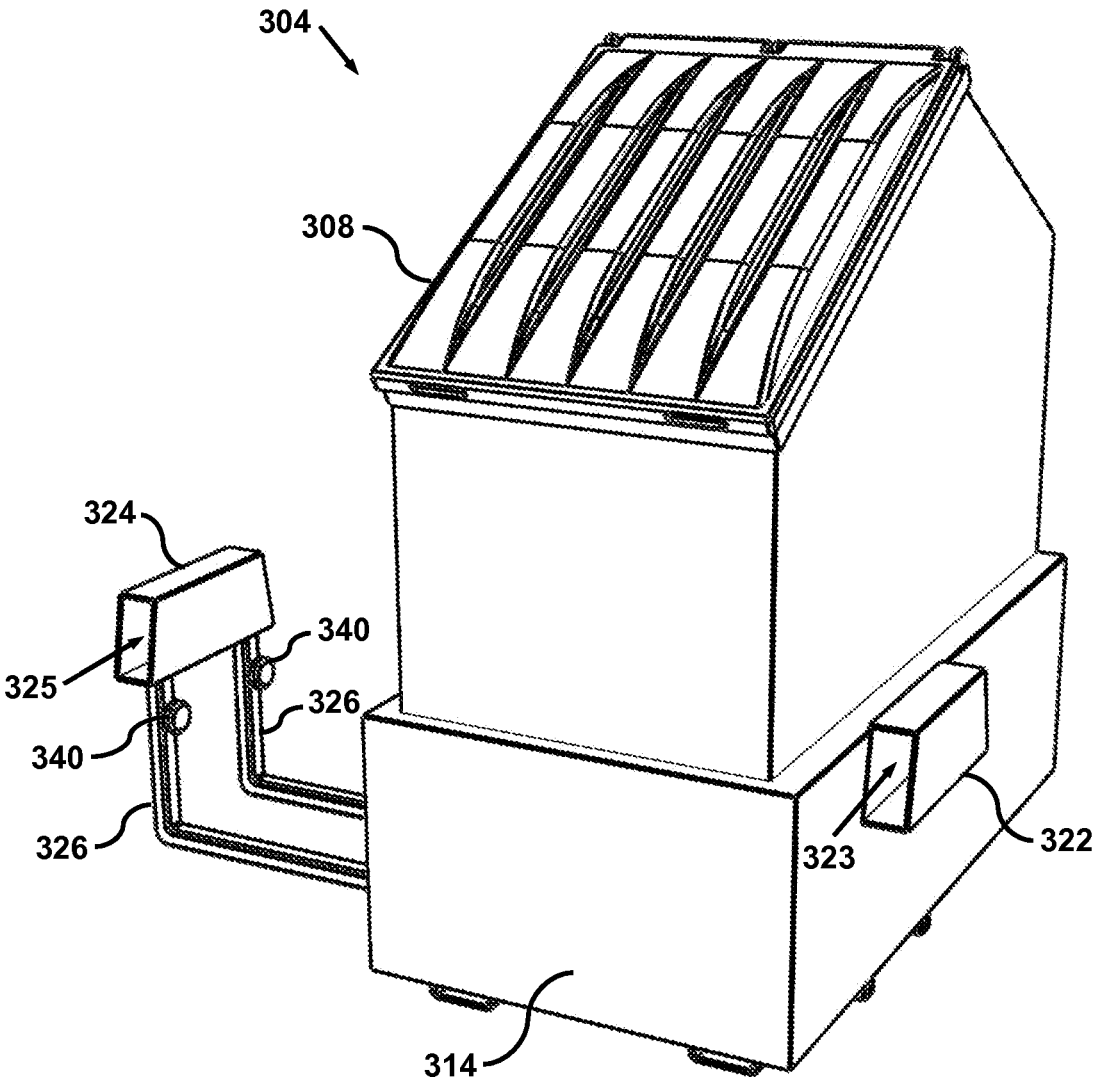

FIGS. 19A-19G show another embodiment of a dual waste collection device, device 300. A brief summary of the views shown in each of the FIGS. 19A-19G is briefly summarized in this paragraph, after which a more detailed description of each of the FIGS. 19A-19G is presented. FIG. 19A shows a perspective view of front and left side of device 300. FIG. 19B shows another perspective view of front and left side of the device 300. FIG. 19C shows a perspective view of the rear and left side of device 300. FIG. 19D shows a front perspective view of the device 300 similar to what was shown in FIG. 19A, but with a first container being individually lifted by the forks of a standard waste collection vehicle. FIG. 19E shows a front perspective view of the device 300 similar to the view from FIG. 19B, but with the first and second containers being lifted together by the forks of a standard waste collection vehicle. FIG. 19F shows a perspective view of the front and left side of first container of the device 300. FIG. 19G shows a perspective view of the front and right side of the second container of the device 300.

Accordingly, FIGS. 19A-19G show the device 300 comprises a first container 302 and a second container 304. In device 300, either first container 302 or second container 304 can house recyclable or non-recyclable material. For convenience of discussion, the first container 302 will be referred to as housing recyclable waste while the second container 304 will be referred to as being used for non-recyclable waste. However, the opposite could also be true. The first container 302 and the second container 304 can be made of materials that are similar or identical to those described above with respect to the first container 202 and the second container 204, respectively. Similarly, the first container 302 can comprise a lid 306 that can be similar or identical to the lid 206 disclosed above, the lid 306 of course being configured and adapted to match the first container 302 and the opening in the first container 302 covered by the lid 306. Additionally, the second container 304 can comprise a lid 308 that can be similar or identical to the lid 208 disclosed above, the lid 308 of course being configured and adapted to match the second container 304 and the opening in the second container 304 covered by the lid 308.

In the embodiment shown in FIGS. 19A-19G, the first container 302 and second container 304 are disposed in a side-by-side or substantially side-by-side arrangement relative a position of a waste collection vehicle ready to empty one or more of the containers of the device 300. As such, the side-by-side position of the first container 302 and the second container 304 can also be made with reference to the relative position of the sleeves used for receiving the forks 301 of the standard waste collection vehicle so that the front surface 312 of the first container 302 and the front surface 314 of the second container 304 are approximately flush, or contained within a same plane, when the containers are in their resting position, or are being lifted together without relative movement between one another.

The first container 302 can comprise a first pair of sleeves for lifting the first container 302 that includes sleeve 316 that is formed as a left sleeve at a left side of the first container 302 and sleeve 318 that is formed as a right sleeve at a right side of the first container 302. The first pair of sleeves comprising 316 and 318 can be made of materials that are the same or similar to the materials of sleeves 216, 218, first container 202 and second container 204. Sleeves 316 and 318 can be joined or coupled to the first container 302 in a same or similar manner as to how sleeves 216 and 218 can be coupled to the first container 202. The first pair of sleeves including sleeves 316 and 318 can be used to lift the first container 302 individually. Sleeve 316 and 318 can be aligned parallel or substantially parallel to each other, so that forks 301 of a standard waste collection vehicle comprising a fixed position and width can be inserted into sleeves 316 and 318 for lifting and emptying the first container 302. The sleeve 316 can comprise a hollow channeling 317 and sleeve 318 can comprise a hollow channeling 319. Hollow channeling 317 and 319 can be similar or identical to hollow channeling 217 and 218 as described above.

Sleeve 316 can be coupled to a side surface of the first container 302, and in some instances is directly attached to the left side surface of the first container 302. Sleeve 316 can extend horizontally along a left side of the side surface of the first container between front and back surfaces of the first container 302. Sleeve 316 can be parallel or substantially parallel with the left side of the first container 302, or can comprise a relative angle that is within plus or minus a measure that is less than or equal to 5 degrees, 10 degrees, 15 degrees, 20 degrees, 25 degrees, or more of the left side of the first container. Sleeve 316 can be positioned to accept a fork 301 of a front load waste collection vehicle when the pair of forks 301 is in a first position and aligned with sleeves 316 and 318 to lift the first container 302 individually. Sleeve 318 can be offset away from the left side of the first container 302 opposite right side of the first container 302 to which sleeve 316 is coupled, and oriented towards. A position or offset of sleeve 318 away from the first container 302 and oriented towards a left side of the first container 302 can be maintained by one or arms 320. Sleeve 318 can extend horizontally along, and offset from, a right side of the side surface of the first container between planes containing the front and back surfaces of the first container 302. Sleeve 318 can be parallel or substantially parallel with the right side of the first container 302, or can comprise a relative angle that is within plus or minus a measure that is less than or equal to 5 degrees, 10 degrees, 15 degrees, 20 degrees, 25 degrees, or more of the right side of the first container. The sleeve 318 can be positioned so as to accept one of the forks 301 when the pair of forks 301 are placed in the first position in alignment with sleeves 316 and 318 to lift the first container 302 individually.

Arm 320 can be formed, positioned, and attached to the first container 302 so as to create an opening for the second container 304 within a space or opening created by the arm 320 and adjacent the first container 302 when the first container 302 and second container 304 are in side-by-side resting positions. Arm 320 can also be formed so that it positions sleeve 318 to the far side, or right of the right side, of the second container 304. Additionally, arm 320 can be formed and positioned to align the first container 302 with respect to the second container 304, and can also prevent relative side-to-side movement of the containers with respect to each other. A size, shape, cross-sectional area, strength and number of arms 320 can vary according to the configuration and design of device 300, including anticipated loads. Examples configurations presented with respect to support members 240 are equally applicable with respect to arms 320. As such, an angle, curve, or radius of arm 320 connecting side portions of the arm 320 disposed adjacent side surfaces of the device 300 to a front portion of arm 320 disposed adjacent front surfaces 312 and 314 can match an angle, curve, or radius of the containers 302 and 304 transitioning between the front surfaces to side surfaces of the containers 302 and 304.

The device 300 can also comprise a second pair of sleeves comprising sleeves 322 and 324. The second pair of sleeves comprising sleeves 322 and 324 can be made of materials that are similar or identical to those of the first and second containers 302 and 304. Sleeve 322 and 324 can be coupled, or directly attached to, outer opposing surfaces of device 300 such as with sleeve 322 coupled to a right outer side surface of second container 304, and with sleeve 324 coupled to a left outer side surface of first container 302. While sleeves 322 and 324 are shown disposed below or lower than sleeves 318 and 316, respectively, in alternate embodiments, sleeves 322 and 324 can also be included above sleeves 318 and 316. Sleeves 322 and 324 can be aligned parallel or substantially parallel to each other, or can comprise a relative angle that is within plus or minus a measure less than or equal to 5 degrees, 10 degrees, 15 degrees, 20 degrees, 25 degrees, or more from each other. Similarly, sleeves 322 and 324 can be parallel or substantially parallel the side surfaces of container 302 and 304 to which they are coupled, or can comprise a relative angle that is within plus or minus a measure less than or equal to 5 degrees, 10 degrees, 15 degrees, 20 degrees, 25 degrees, or more from each other. The sleeve 322 can comprise a hollow channeling 323 and sleeve 324 can comprise a hollow channeling 325 that allows for the forks of a standard waste collection vehicle to be inserted through the pair of sleeves 322 and 324 to lift the first container 302 and second container 304 together. Hollow channeling 323 and 325 can be similar or identical to hollow channeling 317 and 319.

Sleeve 322 can be attached to a side surface of the second container 304 and be positioned to accept a fork of a front load waste collection vehicle when the pair of forks are placed in a second position to lift the first container 302 and second container 304 together. Sleeve 324 can be coupled to and offset with respect to the second container 304 by being coupled or directly attached to one or more arms or supports 326. A first side of arms 326 can be coupled to a bottom surface of the second container 304 and extend away from the second container 304 a distance greater than or equal to width of the first container 302 such that a second end of arms 326 opposite the first end of arms 326 can be disposed adjacent sleeves 316 and adjacent a left side of the first container 302. Arms 326 can comprise one or more materials of a number, size, shape, position, and cross-sectional area similar to arm 320 and support members 240.

For ease of illustration, a pair of arms 326 is shown formed in the shape of rails, the arms 326 comprising a horizontal section disposed below bottom surfaces of first container 302 and second container 304, as well as a vertical section comprising a relative angle of approximately 90 degrees with respect to the horizontal section, although any other angle could be used, such as angle that is within plus or minus a measure less than or equal to 5 degrees, 10 degrees, 15 degrees, 20 degrees, 25 degrees, or more from each other. A shape, contour, or both of arms 326 can also follow or mirror a shape, contour, or both of the first and second containers 302 and 304. The arms 326 can extend and position the sleeve 324 to be aligned with sleeve 328 of the first container 302 and to accept the companion fork when the pair of forks 301 are in a second position, different from the first position, and in-line with sleeves 322 and 324 to lift the first container 302 and the second container 304 together.

In an embodiment, the arms 326 can be attached to the bottom surface of the second container 304 and run under the first container 302 and up the far side of container 302. The sleeve 324 can be attached to the end of the vertical section of arm 326. Sleeve 324 can be aligned with sleeve 322 and positioned such to accept the companion fork of the pair of forks when the forks are placed in a second position to lift the first container 302 and second container 304 together. Arms 326 can comprise any suitable form of attachment to the second container 304, such as by welding, or by mechanical or chemical attachment such as with mechanical fasteners like nuts and bolts, rivets, soldering, adhesives, including epoxies. As a non-limiting example, the arms 326 can be attached to the side of the second container 304 and follow the same shape of arm 320 along the front of containers 302 and 304 but be positioned below arm 320 and achieve the same function.

The second pair of sleeves, including sleeves 316 and 318, can comprise a third pair of sleeves, comprising sleeves 328, that are coupled or directly attached to a bottom surface of sleeves 316 and 318, respectively. Sleeves 328 can be formed to comprise an open central section that is similar or identical to the open central area described above with respect to device 200. Thus, below each sleeve 316 and 318 can be a sleeve 328 comprising a central area below sleeve 316 and 318 that is open. The pair of sleeves 324 can be in alignment with the second pair of sleeves 322 and 324 on the second container 304. The central area of sleeve 328 can opened and spaced to enable the second pair of sleeves 322 and 324 of the second container 304 to be disposed within the opening. The sleeve 328 can serve at least two purposes. First, sleeve 328 can be used in combination with sleeves 322 and 324 to simultaneous lift the two containers 302 and 304 without, or with minimal, relative movement of the two containers 302 and 304 with respect to one another. Second, the opening in sleeves 328 can also be used as an alignment device when placing the first container 302 back in position so that the front surface 312 of the first container 302 and the front surface 314 of the second container 304 are approximately flush.

The second pair of sleeves 322 and 324, like the openings described above, can be formed to comprise angled side edges. Sleeves 328 also comprise angled side edges so that the side edges of sleeves 322 and 324 run approximately parallel with the side edges of sleeves 328. The angled side edges of the sleeves 322, 324 and 328 can further serve as alignment mechanisms for placing the first container 302 back in position so that the front surface 312 of the first container 302 and the front surface 314 of the second container 304 are approximately flush. In this regard, device 300 is similar to device 200, and the discussion included above with respect to device 200 is applicable here.

To accommodate simultaneous lifting of the two containers 302 and 304, device 300 can also include a locking device 330 to secure the lid 306 of the first container 302. This can allow the emptying of only second container 304 when simultaneous lifting of the two containers 302 and 304 for emptying. The first container 302 can still be lifted and emptied individually like in the previous embodiment.

In the present embodiment, the locking mechanism 330 for lid 306 can include a bar 332. The lid lock bar 332 can be rotatably or hingedly coupled to the front surface 312 of the first container 302. When the first container 302 is at rest or when the forks 301 of a standard waste collection vehicle are in a first position and inserted into hollow openings 317 and 319 of the pair of sleeves 316 and 318 to lift just the first container 302 individually, the lock bar can be disengaged and rotated away from the lid 306. This rotation allows for the lid 306 to be lifted to place waste (either recyclable or non-recyclable, as designated for use) inside and also allows for the lid to open when emptying just the first container 302 individually.

When the forks of a standard waste collection vehicle are in a second position and inserted into hollow openings 323, 325, and 329 of the pair of sleeves 322 and 324 and pair of sleeves 328 to lift the first container 302 and second container 304 together, the lid lock bar 332 engages and secures the lid 306 and prevents lid 306 from opening. The lid lock bar 332 can be made to rotate towards the front surface 312 of the first container 302 and secure lid 306 by the forks engaging an actuating mechanism 334 and linkage 336. The lock bar 332 can also disengage the lid 306 and return to its open position when the forks of the waste collection vehicle are retracted from the sleeves by means of a spring or spring-like member 338. In some embodiments, member 338 is a torsional spring hinge that couples the actuating mechanism 334 to the front surface 312 of the first container 302.

In some embodiments, the actuating mechanism 334 can be a bar that is moveably or hingedly coupled to the front surface 312 of the first container 302. The linkage 336 can be any of a rod, belt, cable, chain, or similar device for transferring motion.

In some embodiments, wheels 340, similar to wheels 242, can be placed on the interior side of arms 326 on the second container 304. The wheels 340 can be positioned on the vertical section of arms 326. The wheels 340 can be used to allow the first container 302 to more easily be lifted away from and realigned with the second container 304. The wheels 340 can be used with guide rails 342 to properly align the first and second containers 302 and 304 respectively. The discussion from above relative to wheels 242 and device 200 is also applicable here, and applies equally to wheels 340 and device 300.

The first container 302, second container 304, or both, can also comprise feet 344 attached to, or extending below, the bottom surfaces of the first and second containers 302 and 304. Feet 344 can adjust or determine a placement of the first container 302 upon during its resting position. The feet 344 can also raise the containers 302 and 304 off of the ground, provide room for arms 326, and level the first container 302 and second container 304 relative to each other.

As shown, e.g., in FIG. 19C, adjacent side walls of first and second containers 302 and 304 disposed at an interior or middle portion of device 300 can comprise interlocking sidewalls as shown in FIG. 19C. Interlocking sidewalls will allow first container 302 to be lifted without contacting second container 304, and a lip or ledge that will prevent second container 304 from being lifted without contacting first container 302. Alternatively, the first and second containers 302 and 304 can comprise substantially planar sidewalls without a lip or ledge on adjacent side walls at an interior or middle portion of device 300 that will allow either the first or second containers 302 and 304 to be lifted without contacting the other.

Figure 20A:
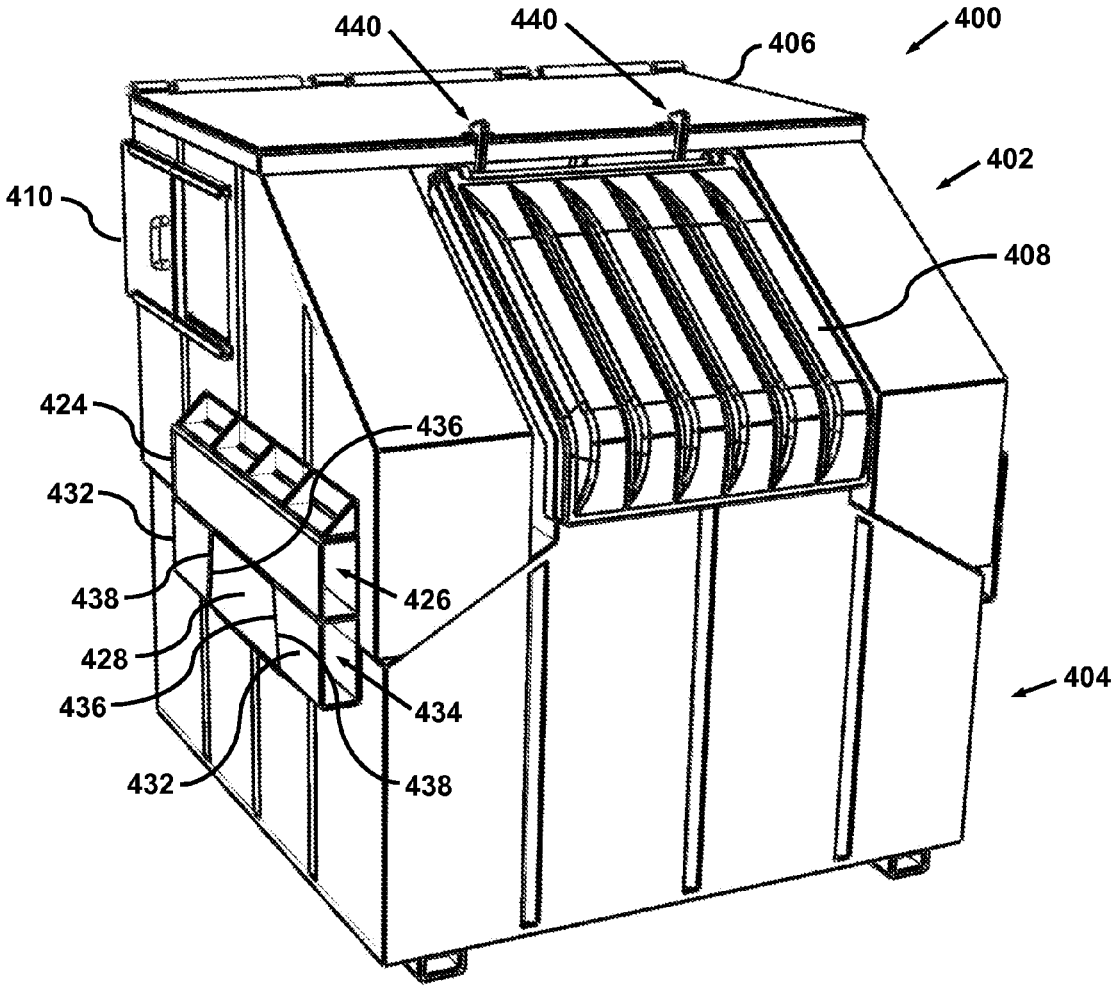
FIGS. 20A-20E show various views of another embodiment of a dual waste collection device comprising stacked top and bottom containers.
Figure 20B:
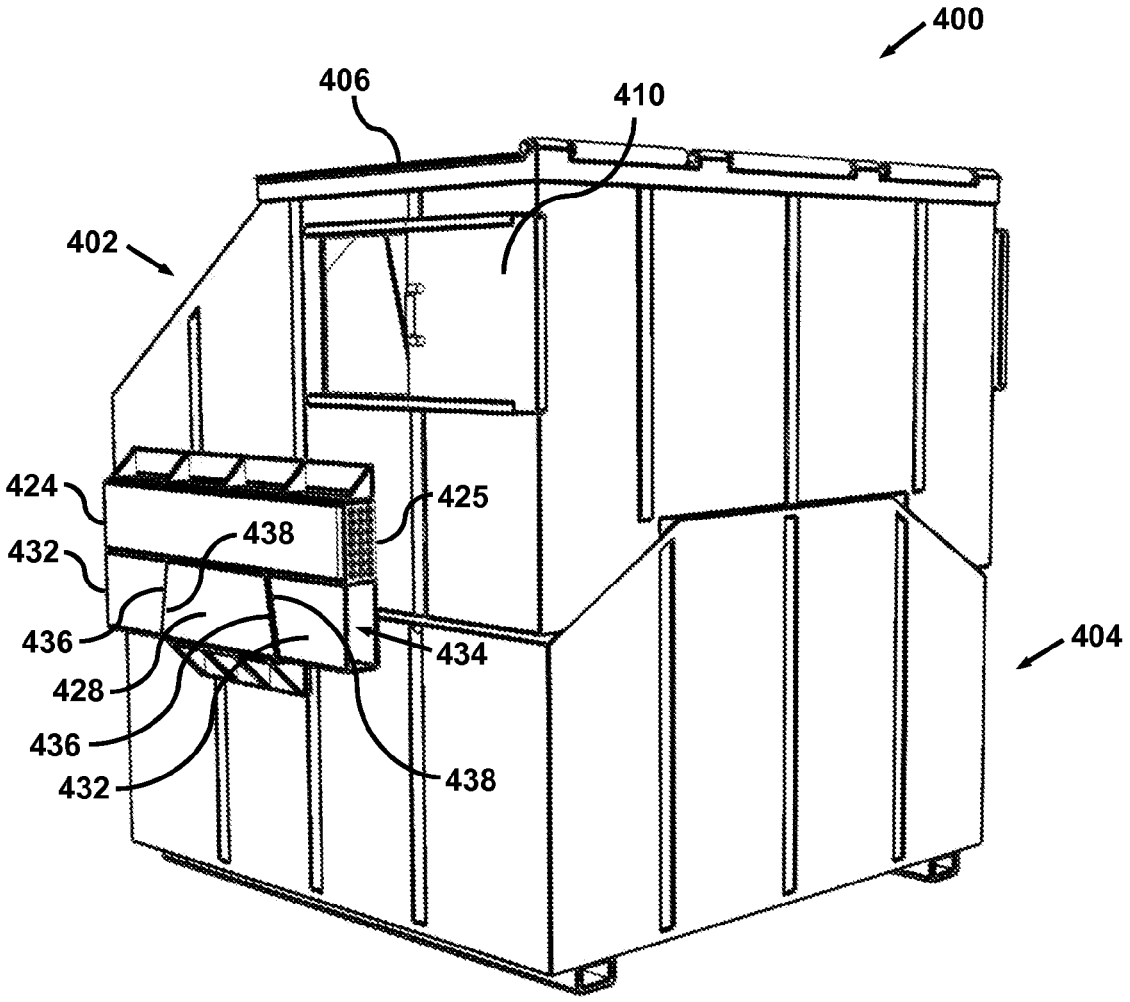
Figure 20C:
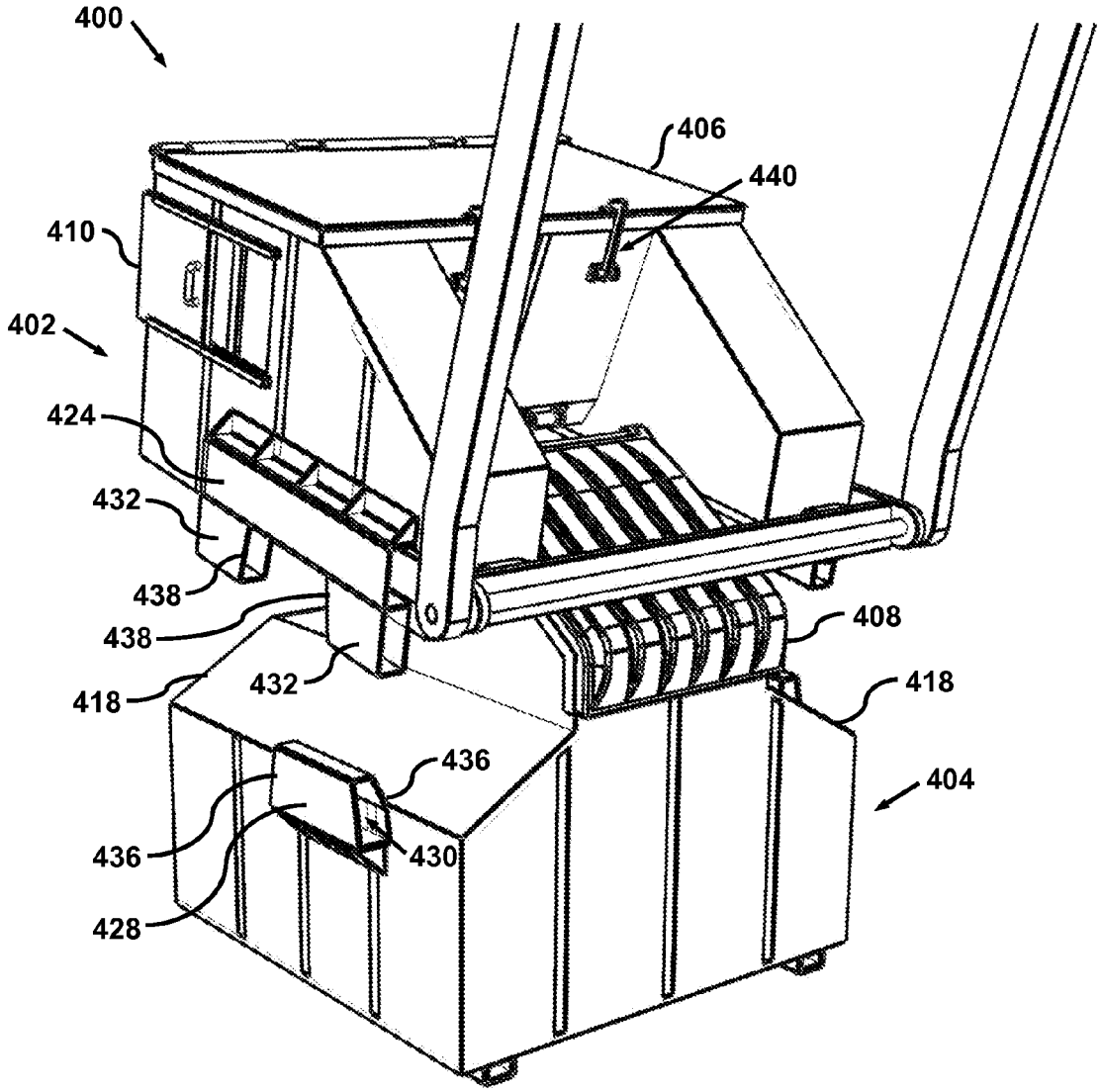
Figure 20D:
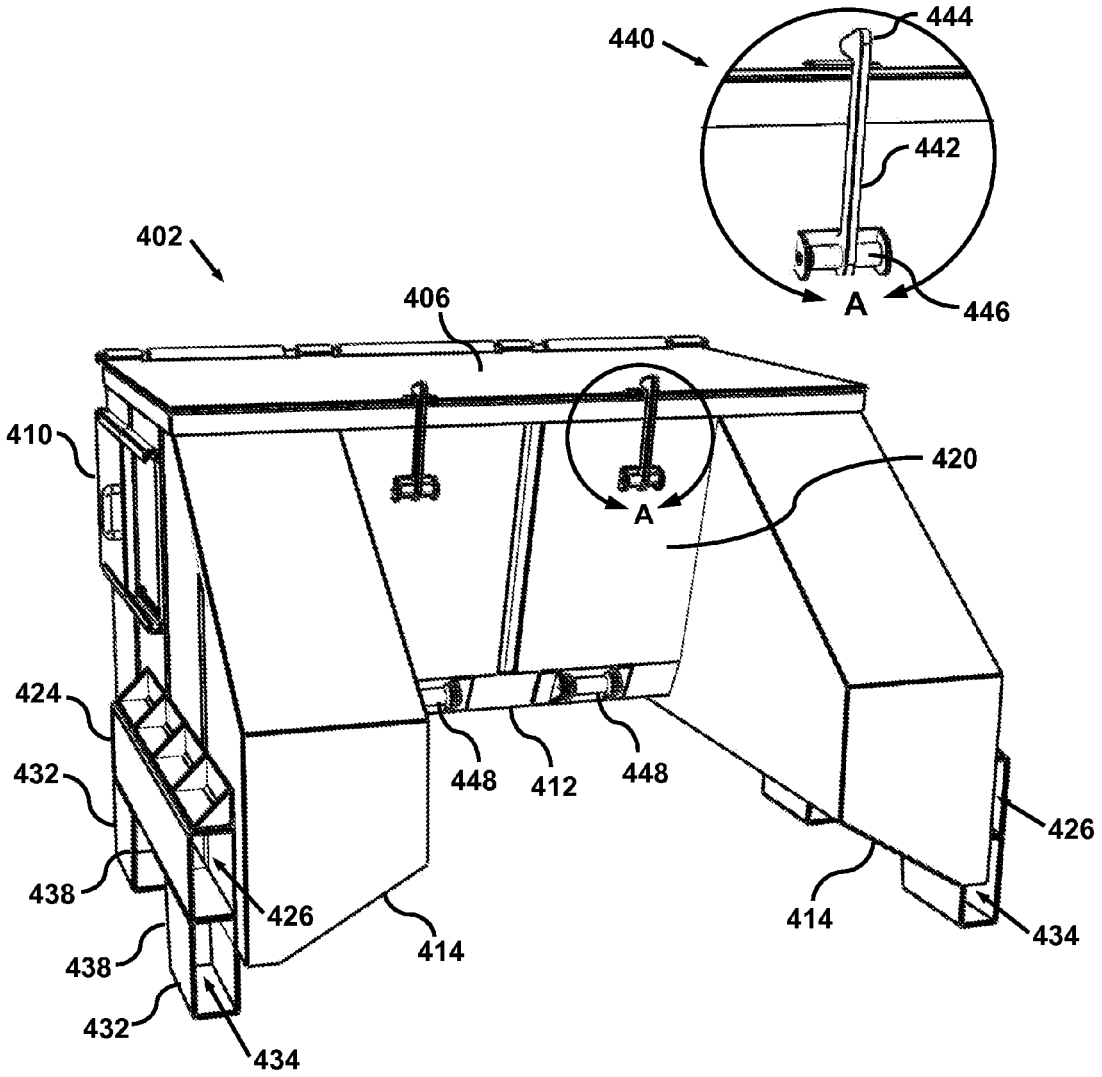
Figure 20E:
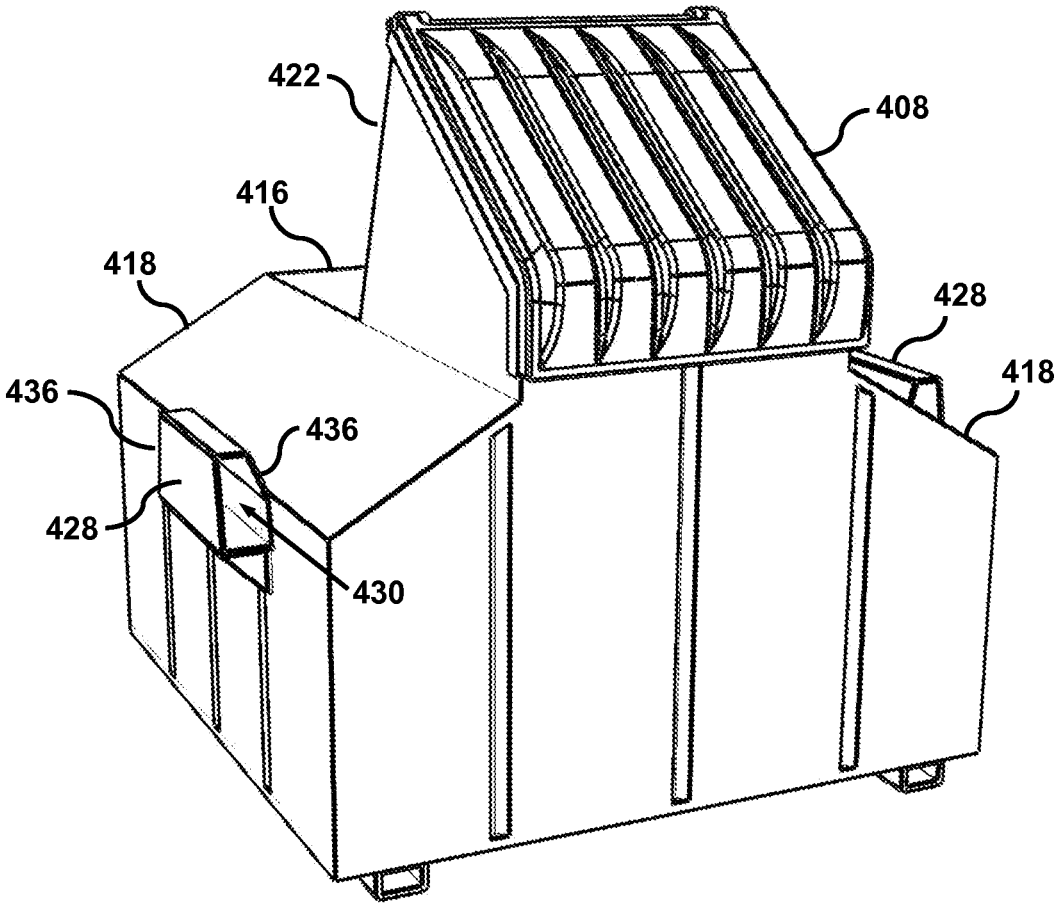

FIGS. 20A-20E show another embodiment of dual waste collection device shown as device 400. As in the previous embodiments, the device 400 comprises a first container 402 and a second container 404. A brief summary of the views shown in each of the FIGS. 20A-20E is briefly summarized in this paragraph, after which a more detailed description of the features shown in each of the FIGS. 20A-20E is presented. FIG. 20A shows a perspective view of a front and left sides of the device 400. FIG. 20B shows a perspective view of a rear and right surface of the device 400. FIG. 20C shows a perspective view of the front and left of the device 400 with the additional detail of the first container 402 being lifted individually by the forks of a standard waste collection vehicle from the second container 404. FIG. 20D shows a perspective view of the front and left sides of the first container 402 without the second device 404 and a detail view A of a lid locking mechanism. FIG. 20E shows a perspective view of front and left sides of the second container 404 without the first container 402.

In this embodiment, either container 402 or 404 can house recyclables or non-recyclables. For further discussion, the first container 402 is used for recyclable waste collection and the second container 404 is used for non-recyclable waste collection. The first container 402 and second container 404 can be made of any suitable material, including materials that are the same or similar to those discussed above with respect to device 200, including the first container 202 and the second container 204.

In the embodiment shown in FIGS. 20A-20E, the majority of the volume and weight of the first container 402 is placed on top of the second container 404 when the two containers are in a resting position and while the first container 402 and second container 404 are lifted together.

The first container 402 and second container 404 can comprise lids 406 and 408, respectively. Lids 406 and 408 can be similar or identical to lids 206, 208, 306, and 308, and the previous discussion of lids is applicable here. Side doors 410 can also be formed on the first container 402 and second container 404, respectively. Side doors 410 can be similar or identical to side doors 210, and the previous discussion of side doors is applicable here. In some embodiments, doors 410 formed in the first container 402. In other embodiments, side doors 410 can also be formed on the second container 404 in addition to, or in place of, side doors 402 on the first container.

In some embodiments, the first container 402 can comprise a bottom surface with a flat, central section 412 (see, e.g., FIG. 20D) and angled exterior sections 414 (see, e.g., FIG. 20D). The second container 404 can comprise a top surface with a flat, central section 416 (see, e.g., FIG. 20E) and angled exterior sections 418 (see, e.g., FIG. 20E). The bottom surface sections 412 and 414 of the first container 402 and the top surface sections 416 and 418 of the second container 404 can be formed such that surface 412 mates to surface 416 and surfaces 414 mate to surfaces 418 when the first container 402 is at rest on top of the second container 404. While the particular angles and portion of the first and second containers 402 and 404 can vary according to the needs, configuration, and design of the device 400, the specific configuration selected can comprising a matching, mirror image, or conjugate contour or surface that is mateable or interlocking between the first container 402 and the second container 404.

Advantageously, the angle of the bottom exterior surfaces 414 and the top exterior surfaces 418 can be selected to make it easier to better align the first and second containers 402 and 404 so that there is approximately equal gap between the side surfaces of the first container 402 and the second container 404. The angle of the bottom exterior surfaces 414 and the top exterior surfaces 418 further keeps the first container 402 from moving side to side relative to the second container 404 when the containers are at rest.

In some embodiments, the first container 402 can comprise an angled, central front surface 420 (see, e.g., FIG. 20D) and the second container 404 can comprise an angled, central rear surface 422 (see, e.g., FIG. 20E). The central front surface 420 and the central rear surface 422 can be parallel or substantially parallel to one another. The angle of the central front surface 420 and the rear surface 422 can be in a range of 0-60° from vertical, 5-40° from vertical, 10-20° from vertical, 5-20° from vertical, 5-15° from vertical, or similar suitable range that can allow the first container 402 to more easily be raised and lifted away from the second container 404. The angle of the central front surface 420 and the central rear surface 422 can also facilitate and make easier an align between the first and second containers 402 and 404, respectively, which in turn can provide a small or a minimal gap between the central front surface 420 and the central rear surface 422 of the first and second containers 402 and 404. In some instances, a distance of the gap can be minimized or can be in a range less than or equal to 1-30 cm, 1-20 cm, 1-10 cm, or other similarly suitable range.

The first container 402 can comprise a pair of sleeves 424. Sleeves of device 400, including the pair of sleeves 424 can be made of a material that is the same or similar to the material of the first and second containers 402 and 404. Sleeves of device 400, like sleeves 424 and the other sleeves discussed herein, can be coupled to device 400, including first and second containers 402 and 404 by welding, or by mechanical or chemical attachment such as with mechanical fasteners like nuts and bolts, rivets, soldering, adhesives, including epoxies. An individual sleeve of the pair of sleeve members 424 can be attached to each side section of the first container 402, or to a left side surface and an opposing right surface. All the sleeves of device 400, including pair of sleeves 424, can comprise a hollow channeling 426. Hollow channeling 426, and the other hollow channeling of device 400 can be the same or similar to hollow tubing 217 discussed above with respect to device 200, and the same discussion is applicable here with respect to device 400. The hollow channeling 426 can allow a standard fork lift-operated waste collection vehicle to insert its fork through the pair of sleeves 424 to raise and empty the first container 402 by itself.

An end cap 425 (see, e.g., FIG. 20B) can be placed at the end of each sleeve 424. The end caps prevent the first container 402 from sliding down the forks as it is being emptied. Without this feature, the first container 402 could slide down the forks as it was lifted and emptied if the forks of the waste collection vehicle are not fully inserted into sleeves 424. As the first container 402 was lowered back into position on top of the second container 404, there could be insufficient space to properly position the first container 402 with respect to the second container 404.

The second container 404 can comprise a pair of sleeves 428. An individual sleeve of the pair of sleeve members 428 can be attached to each side section, or to opposing left and right side sections, of the second container 404 and below the pair of sleeves 424 on the first container 402. The pair of sleeves 428 can comprise a hollow channeling 430 (see, e.g., FIG. 20E).

Each sleeve 424 can comprise another sleeve 432 coupled to the underside of the sleeve 424. Each sleeve 432 can also comprise a hollow channeling 434.

Sleeve 432 can be formed to comprise an open central section, similar to the other sleeves discussed above that comprise open central sections, and as such, the discussion from above is applicable with respect to device 400. Thus, below each end of the sleeve 424 can be the sleeve 432 with the central area below sleeve 424 open. The pair of sleeves 432 can be in alignment with the second pair of sleeves 428 on the second container 404. The central area of sleeve 432 can be open and spaced to enable the pair of sleeves 428 of the second container 404 in between the opening. The sleeve 432 can serve at least two purposes. First, sleeve 432 can be used in combination with sleeves 428 to simultaneous lift the two containers 402 and 404 without movement of the two containers 402 and 404 with respect to one another. Second, the openings in sleeves 432 can be used as an alignment device when placing the first container 402 back in position so that there is a minimal gap between the central front surface 420 and the central rear surface 422 of the first and second containers 402 and 404.

The second pair of sleeves 428 can be formed to comprise angled side edges 436. The discussion of angled sides from above is also applicable here. Sleeves 432 can comprise angled side edges 438 so that the side edges 436 of sleeves 428 run approximately parallel with the side edges 438 of sleeves 432. The angled sides edges 436 and 438 can further serve as alignment mechanisms for placing the first container 402 back in position so that there is a small or minimal gap between the central front surface 420 and the central rear surface 422 of the first and second containers 402 and 404. As used herein, small or minimal gap comprises gaps with a distance less than or equal to 15 cm, 10 cm, 5 cm or other similarly suitable distance. Similarly, a distance of the gap can be minimized or can be in a range of 1-30 cm, 1-20 cm, 1-10 cm, or other similarly suitable range.

Because device 400 enables simultaneous lifting of the two containers 402 and 404, device 400 can also include a locking device 440 to secure the lid 406 of the first container 402. This can allow the emptying of only second container 404 when simultaneous lifting of the two containers 402 and 404 for emptying. The first container 402 can still be lifted and emptied individually like in the previous embodiment. The discussion of securing a lid and emptying a first, second, or both the first and second container discussed above is also applicable here with respect to the first container 402 and the second container 404 of device 400.

In some embodiments, the locking mechanism 440 for lid 406 can be a latch 442 (see, e.g., FIG. 20D, Detail A). The latch 442 can be rotatably or hingedly coupled to the front surface 420 of the first container 402. The latch 442 can comprise a hook 444 that can engage the lid 406 to lock the lid 406 when the first container 402 and second container 404 are positioned together. When the first container 402 and the second container 404 are lifted together, the second container 404 can press the latch 442 rotating it upwards and towards the front surface 420 and lid 406 so that the hook 444 can engage and lock the lid 406. Thus, the lid 406 can remain closed when both the first container 402 and second container 404 are lifted together. When the forks of a standard dump truck pass through the pair of sleeves 424 to lift just the first container 402 slightly above the second container 404, the angle of the front surface of the first container can cause the latch 442 to fall forward and away from front surface 420 and lid 406 so that the hook disengages the lid 406. The movement of the latch 442 away from the front surface 420 can be further enhanced by use of a spring or spring-like member 446 (see, e.g., FIG. 20D, Detail A). In the current embodiment, the spring member can be a hub comprising an internal torsional spring that can unlock the lid 406, thereby allowing the lid 406 to open when the first container 402 is emptied.

In some embodiments, rollers 448, can be placed on or near the bottom edge of the central front surface 420 of the first container 402. The rollers 448 are used to allow the first container 402 to more easily be lifted away from and realigned with the second container 404. Rollers 448 can be similar or identical to rollers or wheels 242 and 244, and as such the discussion relative to rollers or wheels 242 and 244 is applicable here with respect to device 400.

Figure 21A:
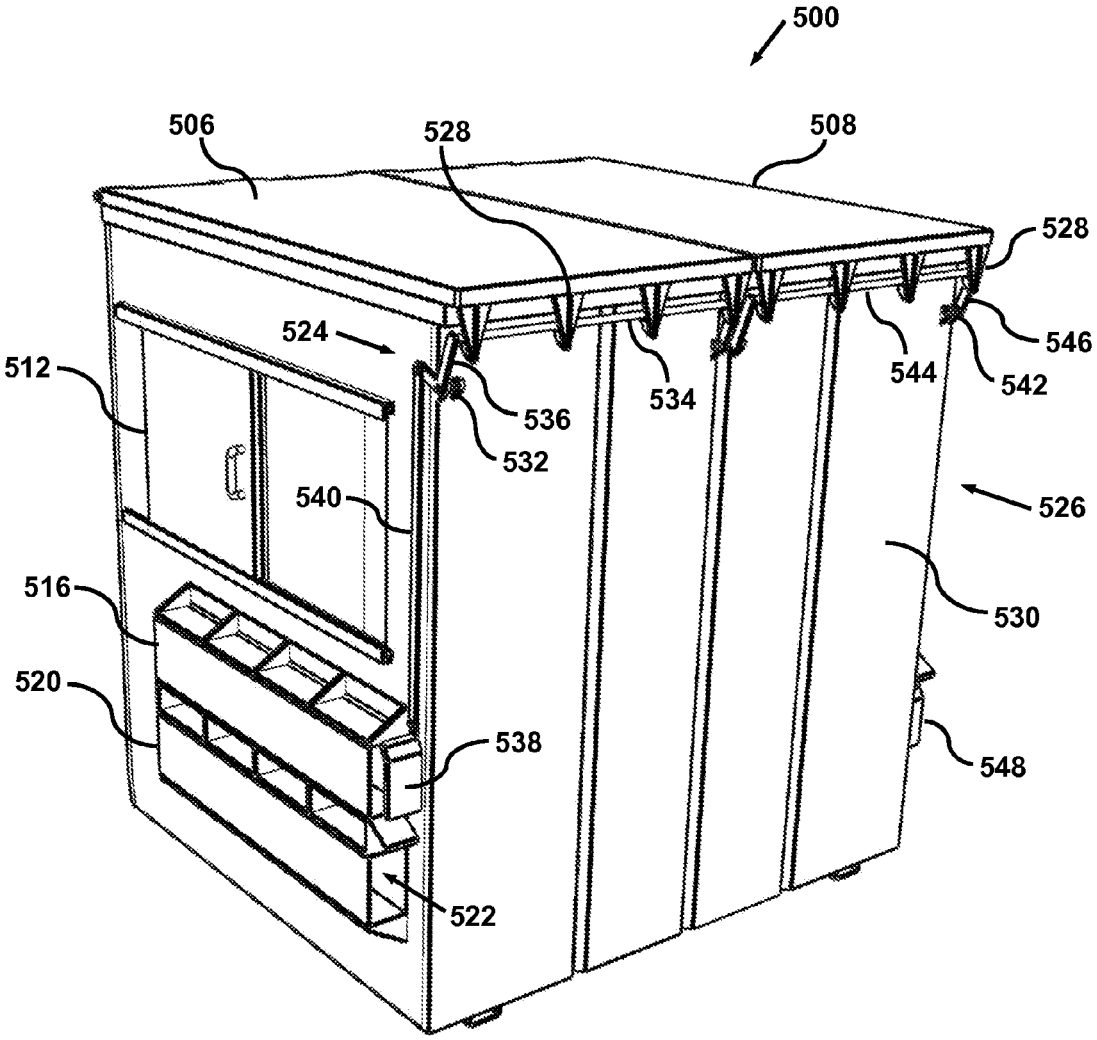
FIGS. 21A-21D show various views of another embodiment of a dual waste collection device comprising a container comprising multiple compartments and multiple sets of sleeves.
Figure 21B:
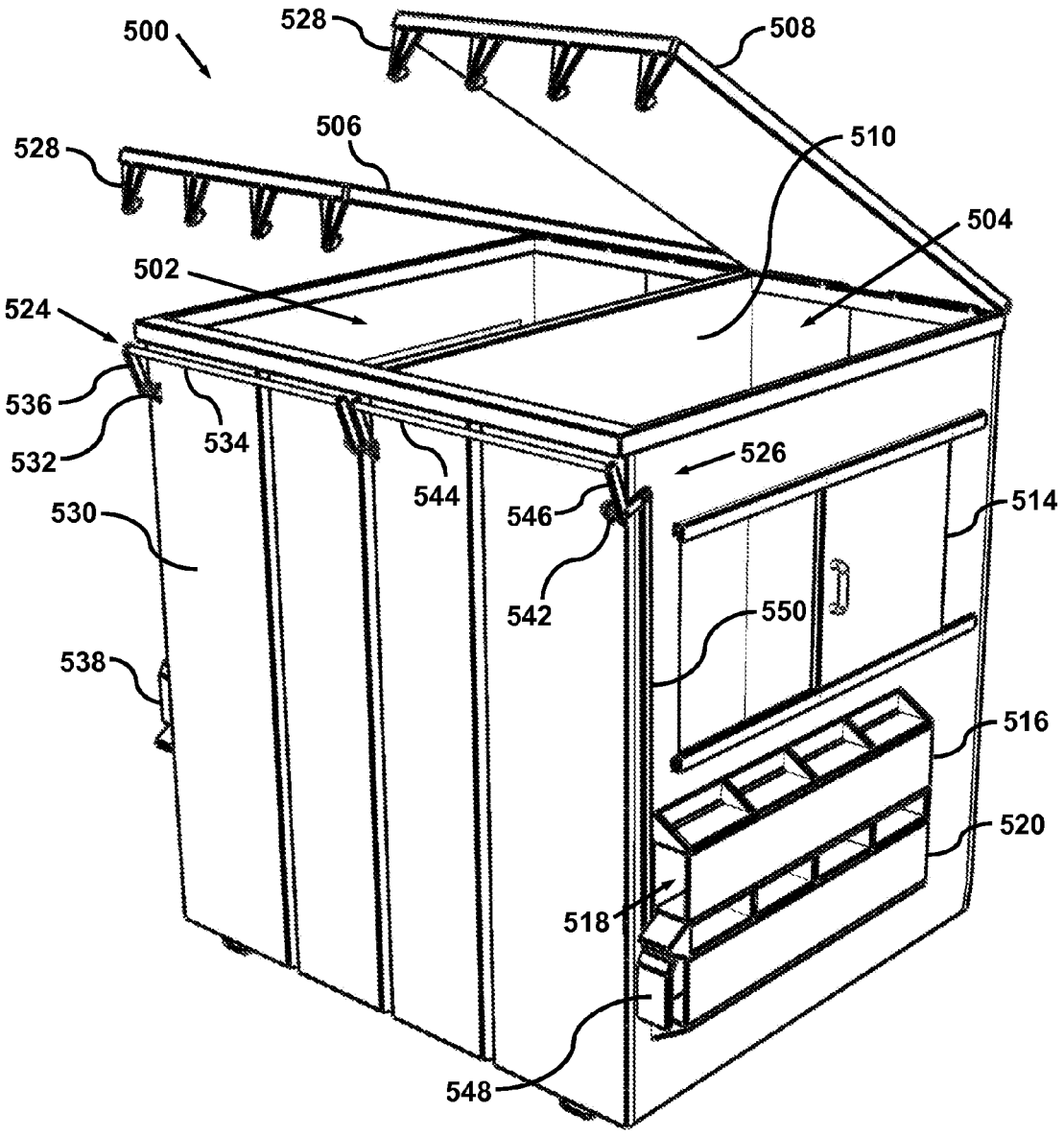
Figure 21C:
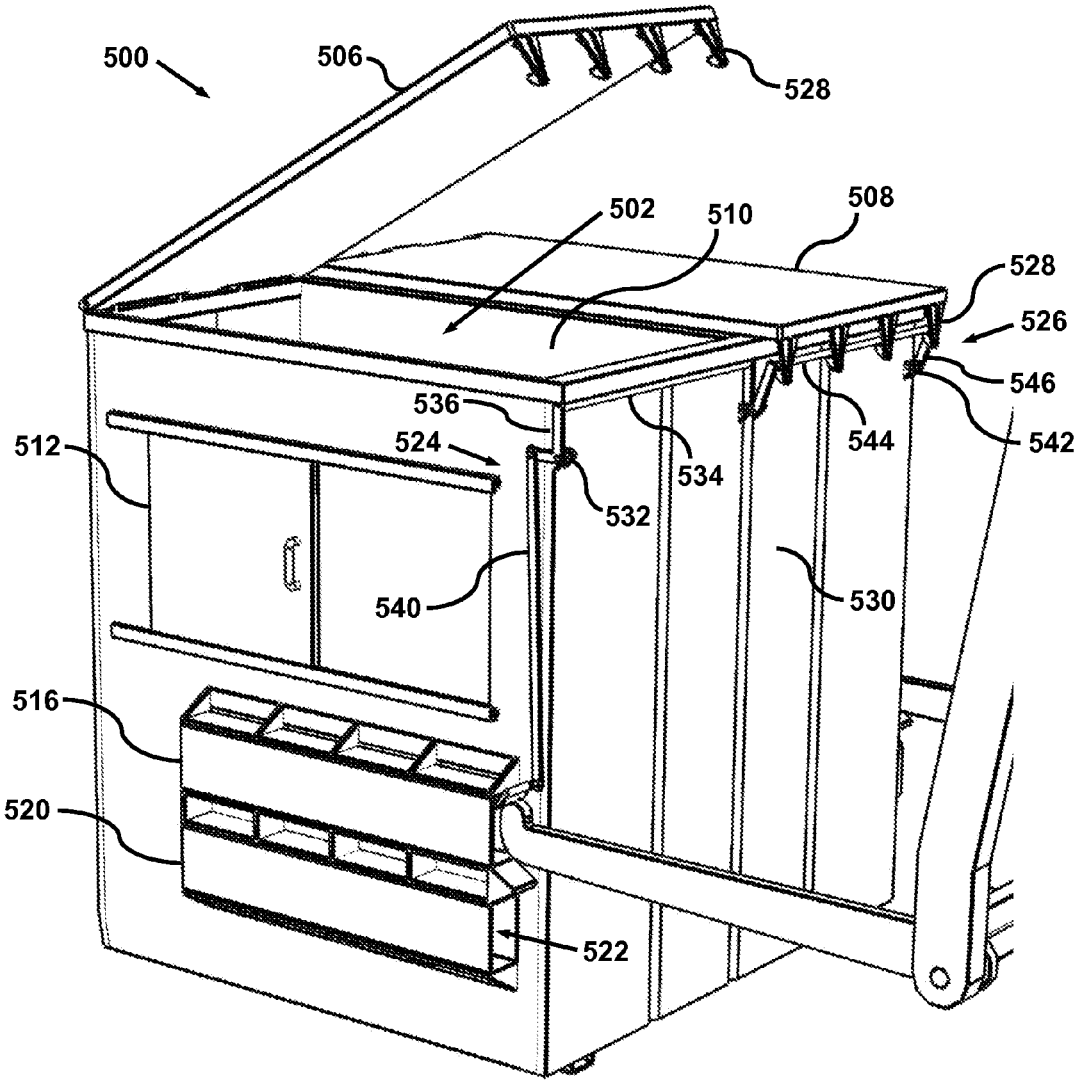
Figure 21D:
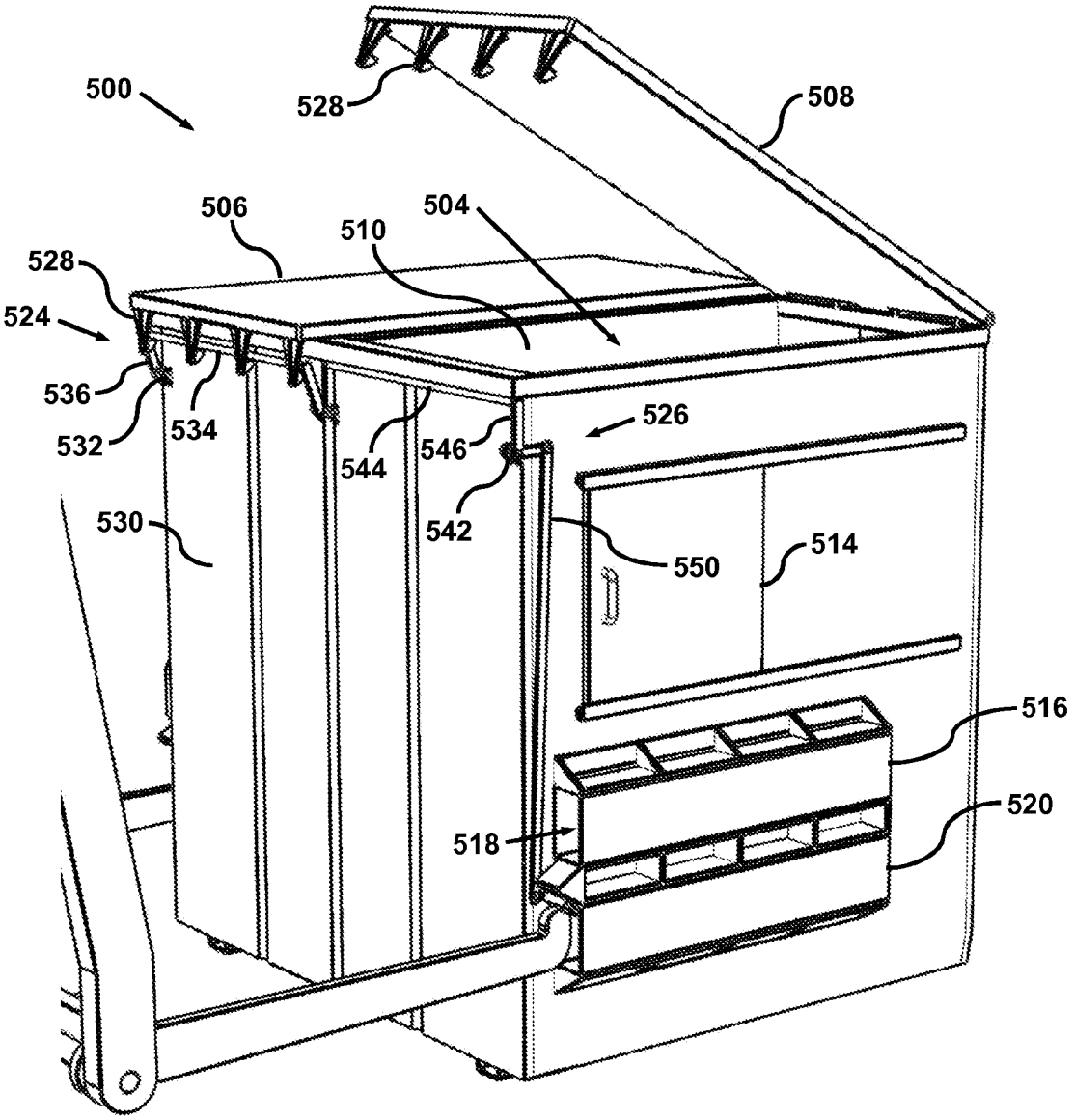

FIGS. 21A-21D show another embodiment of a dual waste collection device shown as device 500. As disclosed with respect to device 500, a dual waste collection device can comprise a single container comprising a first compartment 502 and a second compartment 504. A brief summary of the views shown in each of the FIGS. 21A-21D is briefly summarized in this paragraph, after which a more detailed description of each of the FIGS. 21A-21D is presented. FIG. 21A shows a perspective view of front and left sides of the device 500. FIG. 21B shows another perspective view of front and right side views of the device 500 with lids open to reveal first compartment 502 and the second compartments 504 together with a partitioning wall 510 that divides the first and second compartment walls 502 and 504, respectively. FIG. 21C shows another perspective view of front and left sides of the device 500 similar to that shown in FIG. 21A, but with a locking mechanism securing a lid of the first compartment 502 disengaged by the forks of a standard waste collection vehicle in a first position and with a lid open. FIG. 21D shows another perspective view of front and right sides of the device 500 with a locking mechanism securing a lid of the second compartment 504 disengaged by the forks of a standard waste collection vehicle in a second position and with a lid open and forks being disposed within sleeves of the device 500.

The device 500 can comprise two or more compartments, and as such can comprise compartments in addition to the first compartment 502 and the second compartment 504. Compartments 502 and 504 can be made of materials that are the same or similar to the materials used for containers 202 and 204, such that the discussion of materials from above is applicable here with respect to compartments 502, 504, and partitioning wall 510, discussed below. However, for ease of discussion, the embodiment illustrated with respect to device 500 comprises just two compartments. Each compartment can comprise a lid, and as shown in the figures, the first compartment 502 can comprise a lid 506 and the second compartment 504 can comprise a lid 508. Lids 506 and 508 can be similar or identical to lids 206 and 208 discussed above, and as such that discussion is applicable here, with respect to device 500.

Each compartment of the device 500 can comprise at least one partitioning wall 510 disposed between the compartment and each adjacent compartment. FIGS. 21B-21D show the partitioning wall 510 separating the first compartment 502 and second compartment 504.

Each compartment 502 and 504 can comprise a door for receiving either recyclable waste or non-recyclable waste inside a corresponding compartment. As such, the first compartment 502 can comprise a door 512 and the second compartment 504 can comprise a door 514. Doors 512 and 514 can be similar or identical to doors 210 discussed above, and as such that discussion is applicable here, with respect to device 500.

The device 500 can comprise number of sleeves, including a first pair of sleeves 516. All of the sleeves of device 500, including the first pair of sleeves 516, can be made of materials that are the same or similar to the first and second compartments 502 and 504 or the same as sleeves 216 and 218 from device 200, and can be formed and coupled to other elements in the same ways. An individual sleeve of the pair of sleeve members 516 can be attached to each side section of the device 500, or to opposing left and right sides. The first pair of sleeves 516 can comprise hollow channeling 518. The hollow channeling can be the same or similar to hollow channeling 217 or 219 from device 200, and the same discussion from above is applicable here with respect to all sleeves of device 200, including the first pair of sleeves 516. The hollow channeling 518 can allow for, among other things, a standard fork lift-operated waste collection vehicle to insert a fork through the pair of sleeves 516 to raise the device 500 and empty the first compartment 502.

The device 500 can comprise a second pair of sleeves 520. The second pair of sleeves 520 can be made out of the same material as the side walls of device 500. An individual sleeve of the second pair of sleeve members 520 can be attached to each side section, or opposing left and right side walls, of the device 500 and can be positioned above or below the first pair of sleeves 516. Alternatively, and as can be true all embodiments comprising pairs of sleeves stacked in a top-and-bottom configuration, the second pair of sleeves 520 can be coupled to the left or right of the first pair of sleeves 516 as discussed in greater detail above. The pair of sleeves 520 can also comprise a hollow channeling 522. The hollow channeling 522 can allow for a standard fork lift-operated waste collection vehicle to insert its forks through the pair of sleeves 520 to raise the device 500 and empty the second compartment 504.

Because an entirety of the device 500 is lifted each time one or more of the compartments within the device 500 is emptied, the device 500 can also include one or more locking mechanisms to secure the lid to each respective compartment. This can allow the emptying of only one compartment when lifting the device 500. In some embodiments, a locking mechanism 524 can secures the lid 506 of the first compartment 502 and prevents it from opening when emptying just the second compartment 504. A locking mechanism 526 can likewise secure the lid 508 of the second compartment 504 and prevent it from opening when emptying just the first compartment 502. The discussion above regarding the locking mechanisms of other embodiments is also applicable to the discussion of device 500.

In some embodiments, each locking mechanism can engage hook members 528 protruding from the front edge of each lid, securing each lid individually and preventing it from opening when emptying another compartment. When lid locking mechanism 524 engages the hook members 528 of lid 506, the lid 506 can be secured and kept from opening when the device 500 is lifted to empty the second compartment 504. When lid locking mechanism 526 engages the hook members 528 of lid 508, the lid 508 can be secured and kept from opening when the device 500 is lifted to empty the first compartment 502.

In some embodiments, the locking mechanism 524 can comprise one or more hinged members 532 that are coupled to a top area of the front surface 530 of the device 500. At one end of locking mechanism 524, a hinge member or members 532 can be connected to a locking bar 534 that is positioned near the top of the device 500 by a linkage 536. When device 500 is in a resting position without the forks of a waste collection vehicle inserted into sleeves 516, the locking mechanism 524 can be in a first, locked position. In a first position, the locking bar 534 can engage the hook members 528 of lid 506, which secures lid 506 and prevents it from opening.

Attached to a second end of the locking mechanism 524 can be one or more actuating plates 538 that can be connected by a linkage 540, such as a rod, chain, belt, or other suitable device. The actuating plate 538 can be positioned in front of one or both individual sleeve members of the pair of sleeves 516. When the forks of a waste collection vehicle are inserted into sleeves 516, the locking mechanism 524 can be in a second, unlocked position. In a second position, the forks of a waste collection vehicle can push the actuating plat 538, rotating it upwards. The rotation of plate 538 can pull the linkage 540, which can in turn pull the locking bar 534 open, allowing the hook members 528 of lid 506 to disengage and the lid to open.

In some embodiments, the locking mechanism 526 can comprise one or more hinged members 542 coupled to a top area of the front surface 530 of the device 500. At one end of locking mechanism 526, a hinge member or members 542 can be connected to a locking bar 544 that is positioned near the top of the device 500 by a linkage 546. When device 500 is in a resting position without the forks of a waste collection vehicle inserted into sleeves 520, the locking mechanism 526 is in a first, locked position. In the first position, the locking bar 544 can engage the hook members 528 of lid 508 to secure lid 508 and prevent the lid from opening.

Coupled or attached to a second end of the locking mechanism 526 can be an actuating plate 548 that can be further coupled or connected by a linkage 550, such as a rod, chain, belt, or other suitable device. The actuating plate 548 can be positioned in front of one or both individual sleeve members of the pair of sleeves 520. When the forks of a waste collection vehicle are inserted into sleeves 520, the locking mechanism 526 can be in a second, unlocked position. In the second position, the forks of the waste collection vehicle can push the actuating plate 548, rotating it upwards. The rotation of the plate 548 can pulls the linkage 550, which in turn, pulls the locking bar 544 open, allowing the hook members 528 of lid 508 to disengage and the lid to open.

While various features including plates, linkages, locking mechanisms, locking bars, and hinge mechanisms have been discussed specifically with regards to device 500, this description is also applicable to all the other devices disclosed herein. Similarly, the features used for, and discussed in relation to, securing lids in other embodiments and devices is also applicable to device 500. In other embodiments, other recognized mechanical or electromechanical structures and devices can be used in securing lids of the dual waste collection device to accomplish the desired accessibility of recyclable and non-recyclable waste within the dual waste collection device.

While embodiments of the disclosure have been described in terms of various specific embodiments, those skilled in the art will recognize that the embodiments of the disclosure can be practiced with modifications within the spirit and scope of the claims.

What is claimed is:

1. A dual purpose waste collection device for recyclable and non-recyclable material, comprising:

a first container;

a second container;

a first pair of lifting sleeves comprising a length in a range of 0.6-1.3 meters (m) coupled to first and second opposing side surfaces of the first container;

a second pair of lifting sleeves comprising a length in a range of 0.6-1.3 m and fixedly attached to the first pair of lifting sleeves and coupled to the first and second opposing side surface of the first container; and a third pair of lifting sleeves coupled to first and second opposing side surfaces of the second container and releasably coupled to the second pair of lifting sleeves with an interlocking geometry.

2. The waste collection device of claim 1, wherein the first container is disposed behind the second container, wherein a front and back of the waste collection device, first container, and second container are determined with respect to a relative position of a waste collection vehicle positioned to insert forks of the waste collection vehicle into either the first pair of lifting sleeves, the second pair of lifting sleeves, or the third pair of lifting sleeves.

3. The waste collection device of claim 2, wherein the first pair of lifting sleeves and the second pair of lifting sleeves are horizontally separated in a side-by-side arrangement.

4. The waste collection device of claim 1, wherein the first container is stacked over the second container, and the first container comprise a bottom surfaces that matches a contour of a top surface of the second container.

5. The waste collection device of claim 2, wherein the second container comprises at least one support member coupled to a bottom surface of the second container that extends behind the second container to a distance greater than a distance of sidewall of the first container such that the at least one support can extend beyond a footprint of the first container and second container.

6. The waste collection device of claim 1, wherein the first pair of lifting sleeves and the second pair of lifting sleeves are vertically separated in an over-under arrangement.

7. The waste collection device of claim 1, wherein the first container and second container are releasably coupled to each other with at least one wheel.

8. A method of selective collection or recyclable and non-recyclable waste with the dual purpose waste collection device of claim 1, comprising:

positioning forks of a waste collection vehicle within the first pair of lifting sleeves and raising the forks of the waste collection vehicle to lift the waste collection device and to empty a contents of the first container of the waste collection device into the waste collection vehicle; or positioning forks of a waste collection vehicle within the second pair of lifting sleeves and raising the forks of the waste collection vehicle to lift the waste collection device and to empty a contents of the second container of the waste collection device into the waste collection vehicle.

9. A dual purpose waste collection device for recyclable and non-recyclable material, comprising:

a first container;

a second container;

a first pair of lifting sleeves coupled to first and second opposing side surfaces of the first container;

a second pair of lifting sleeves-fixedly attached to the first pair of lifting sleeves and coupled to the first and second opposing side surface of the first container; and a third pair of lifting sleeves coupled to first and second opposing side surfaces of the second container and releasably coupled to the second pair of lifting sleeves with an interlocking geometry.

10. The dual purpose waste collection device of claim 9, wherein:

the first pair of lifting sleeves further comprises an outer left sleeve and an inner right sleeve; and the second pair of lifting sleeves further comprises an inner left sleeve and an outer right sleeve.

11. The dual purpose waste collection device of claim 9, wherein:

the first pair of lifting sleeves and the second pair of lifting sleeves comprises a length in a range of 0.6-1.3 meters (m); and the first pair of lifting sleeves and the second pair of lifting sleeves comprise a height in a range of 20-31 centimeters (cm), and further comprises a width in a range of 10-21 cm.

12. The waste collection device of claim 9, wherein the first container is stacked over the second container, and the first container comprise a bottom surfaces that matches a contour of a top surface of the second container.

13. A method of selective collection or recyclable and non-recyclable waste with the dual purpose waste collection device of claim 9, comprising:

positioning forks of a waste collection vehicle within the first pair of lifting sleeves and raising the forks of the waste collection vehicle to lift the waste collection device and to empty a contents of the first container of the waste collection device into the waste collection vehicle; or positioning forks of a waste collection vehicle within the second pair of lifting sleeves and raising the forks of the waste collection vehicle to lift the waste collection device and to empty a contents of the second container of the waste collection device into the waste collection vehicle.

* * * * *